US008256091B2

(12) United States Patent
Duescher

(10) Patent No.: US 8,256,091 B2
(45) **Date of Patent: *Sep. 4, 2012**

(54) EQUAL SIZED SPHERICAL BEADS

(76) Inventor: Wayne O. Duescher, Roseville, MN (US)

( * ) Notice: Subject to any disclaimer, the term of this patent is extended or adjusted under 35 U.S.C. 154(b) by 1047 days.

This patent is subject to a terminal disclaimer.

(21) Appl. No.: 12/221,265

(22) Filed: Jul. 30, 2008

(65) Prior Publication Data

US 2008/0299875 A1 Dec. 4, 2008

Related U.S. Application Data

(63) Continuation-in-part of application No. 12/217,565, filed on Jul. 7, 2008, now Pat. No. 8,062,098, which is a continuation-in-part of application No. 11/029,761, filed on Jan. 5, 2005, which is a continuation-in-part of application No. 10/816,275, filed on Aug. 16, 2004, now Pat. No. 7,520,800, which is a continuation-in-part of application No. 10/824,107, filed on Apr. 14, 2004, now Pat. No. 7,632,434, which is a continuation-in-part of application No. 10/418,257, filed on Apr. 16, 2003, now abandoned, which is a continuation-in-part of application No. 10/015,478, filed on Dec. 13, 2001, now Pat. No. 6,752,700, which is a continuation-in-part of application No. 09/715,448, filed on Nov. 17, 2000, now Pat. No. 6,769,969.

(51) Int. Cl.
*B23P 25/00* (2006.01)

(52) U.S. Cl. ..... 29/527.2; 29/527.1; 451/56; 451/527; 51/300; 264/11; 264/12; 264/13; 264/15

(58) Field of Classification Search ..... 29/527.1, 29/527.2; 264/12, 11, 13, 15; 451/527, 56; 65/21.1, 21.4
See application file for complete search history.

(56) References Cited

U.S. PATENT DOCUMENTS 794,495 A 7/1905 Gorton et al. ..... 451/529
(Continued)

FOREIGN PATENT DOCUMENTS

WO WO 95/00295 1/1995

OTHER PUBLICATIONS

"Superabrasives and Microfinishing Systems" Product Guide. 3M, 1994, 60-4400-4692-2 (104.3) JR (16 pgs).

(Continued)

*Primary Examiner* — Derris Banks
*Assistant Examiner* — Azm Parvez
(74) *Attorney, Agent, or Firm* — Mark A. Litman and Associates, P.A.

(57) ABSTRACT

A method of producing equal-sized spherical shaped beads of a wide range of materials is described. These beads are produced by forming the parent bead material into a liquid solution and by filling equal volume cells in a sheet with the liquid solution. The sheet cells establish the volumes of each of the cell mixture volumes which are then ejected from the cells by an impinging fluid. Surface tension forces acting on the ejected equal sized solution entities form them into spherical beads. The ejected beads are then subjected to a solidification environment which solidifies the spherical beads. The beads can be solid or porous or hollow and can also have bead coatings of multiple material layers.

25 Claims, 7 Drawing Sheets

U.S. PATENT DOCUMENTS

| | | | | |
|---|---|---|---|---|
| 1,657,784 | A | 1/1928 | Bergstrom | 51/295 |
| 1,896,946 | A | 2/1933 | Gauss | 451/527 |
| 1,924,597 | A | 8/1933 | Drake | 451/550 |
| 1,941,962 | A | 1/1934 | Tone | 5/295 |
| 2,001,911 | A | 5/1935 | Wooddell et al. | 451/529 |
| 2,108,645 | A | 2/1938 | Bryant | 427/204 |
| 2,115,897 | A | 5/1938 | Wooddell et al. | 451/529 |
| 2,216,728 | A | 10/1940 | Benner et al. | 51/298 |
| 2,242,877 | A | 5/1941 | Albertson | 451/527 |
| 2,252,683 | A | 8/1941 | Albertson | 51/298 |
| 2,292,261 | A | 8/1942 | Albertson | 451/527 |
| 2,520,763 | A | 8/1950 | Goepfert et al. | 451/536 |
| 2,755,607 | A | 7/1956 | Haywood | 451/527 |
| 2,820,746 | A | 1/1958 | Keeleric | 205/114 |
| 2,838,890 | A | 6/1958 | McIntyre | 451/527 |
| 2,907,146 | A | 10/1959 | Dyar | 451/529 |
| 3,048,482 | A | 8/1962 | Hurst | 51/298 |
| 3,121,298 | A | 2/1964 | Mellon | 451/539 |
| 3,246,430 | A | 4/1966 | Hurst | 451/534 |
| 3,423,489 | A | 1/1969 | Arens et al. | 264/4 |
| 3,495,362 | A | 2/1970 | Hillenbrand | 451/527 |
| 3,498,010 | A | 3/1970 | Hagihara | 451/527 |
| 3,517,466 | A | 6/1970 | Bouvier | 451/466 |
| 3,605,349 | A | 9/1971 | Anthon | 451/534 |
| 3,702,043 | A | 11/1972 | Welbourn et al. | 451/213 |
| 3,709,706 | A | 1/1973 | Sowman | 501/103 |
| 3,711,025 | A | 1/1973 | Miller | 239/222.11 |
| 3,859,407 | A | 1/1975 | Blanding et al. | 241/3 |
| 3,916,584 | A | 11/1975 | Howard et al. | 51/308 |
| 3,921,342 | A | 11/1975 | Day | 451/550 |
| 3,933,679 | A | 1/1976 | Weitzel et al. | 252/301.1 |
| 3,991,527 | A | 11/1976 | Maran | 451/529 |
| 4,018,576 | A | 4/1977 | Lowder et al. | 51/309 |
| 4,038,046 | A | 7/1977 | Supkis | 51/295 |
| 4,106,915 | A | 8/1978 | Kagawa et al. | 51/296 |
| 4,111,666 | A | 9/1978 | Kalbow | 51/295 |
| 4,112,631 | A | 9/1978 | Howard et al. | 51/295 |
| 4,142,334 | A | 3/1979 | Kirsch et al. | 451/539 |
| 4,225,322 | A | 9/1980 | Knemeyer | 51/295 |
| 4,251,408 | A | 2/1981 | Hesse et al. | 524/541 |
| 4,256,467 | A | 3/1981 | Gorsuch | 51/295 |
| 4,272,926 | A | 6/1981 | Tamulevich | 51/216 |
| 4,311,489 | A | 1/1982 | Kressner | 51/298 |
| 4,314,827 | A | 2/1982 | Leitheiser et al. | 51/298 |
| 4,315,720 | A | 2/1982 | Ueda et al. | 425/8 |
| 4,327,156 | A | 4/1982 | Dillon et al. | 428/568 |
| 4,341,439 | A | 7/1982 | Hodge | 350/96.22 |
| 4,364,746 | A | 12/1982 | Bitzer et al. | 51/298 |
| 4,373,672 | A | 2/1983 | Morishita et al. | 239/703 |
| 4,393,021 | A | 7/1983 | Eisenberg et al. | 264/143 |
| 4,421,562 | A | 12/1983 | Sands | 106/603 |
| 4,426,484 | A | 1/1984 | Saeki et al. | 524/541 |
| 4,536,195 | A | 8/1985 | Ishikawa | 51/293 |
| 4,541,566 | A | 9/1985 | Kijima et al. | 239/224 |
| 4,541,842 | A | 9/1985 | Rostoker | 51/296 |
| 4,586,292 | A | 5/1986 | Carroll et al. | 451/329 |
| 4,652,275 | A | 3/1987 | Bloecher et al. | 51/298 |
| 4,710,406 | A | 12/1987 | Fugier et al. | 427/389.8 |
| 4,773,599 | A | 9/1988 | Lynch et al. | 241/69 |
| 4,773,920 | A | 9/1988 | Chasman et al. | |
| 4,776,862 | A | 10/1988 | Wiand | 51/293 |
| 4,799,939 | A | 1/1989 | Bloecher | 51/293 |
| 4,863,573 | A | 9/1989 | Moore et al. | 205/50 |
| 4,903,440 | A | 2/1990 | Kirk et al. | 51/298 |
| 4,918,874 | A | 4/1990 | Tiefenbach, Jr. | 51/293 |
| 4,930,266 | A | 6/1990 | Calhoun et al. | 51/293 |
| 4,931,414 | A | 6/1990 | Wood et al. | 501/103 |
| 4,974,373 | A | 12/1990 | Kawashima et al. | 51/295 |
| 5,014,468 | A | 5/1991 | Ravipati et al. | 51/295 |
| 5,015,266 | A | 5/1991 | Yamamoto | 51/293 |
| 5,020,283 | A | 6/1991 | Tuttle | 451/550 |
| 5,090,968 | A | 2/1992 | Pellow | 51/293 |
| 5,107,626 | A | 4/1992 | Mucci | 451/28 |
| 5,108,463 | A | 4/1992 | Buchanan | 51/295 |
| 5,110,659 | A | 5/1992 | Yamakawa et al. | 428/141 |
| 5,127,197 | A | 7/1992 | Brukvoort et al. | 51/204 |
| 5,137,542 | A | 8/1992 | Buchanan et al. | 51/295 |
| 5,142,829 | A | 9/1992 | Germain | 451/537 |
| 5,152,917 | A | 10/1992 | Pieper et al. | 51/295 |
| 5,174,795 | A | 12/1992 | Wiand | 51/295 |
| 5,175,133 | A | 12/1992 | Smith et al. | 501/127 |
| 5,190,568 | A | 3/1993 | Tselesin | 51/293 |
| 5,199,227 | A | 4/1993 | Ohishi | 451/527 |
| 5,201,916 | A | 4/1993 | Berg et al. | 51/293 |
| 5,213,591 | A | 5/1993 | Celikkaya et al. | 51/293 |
| 5,219,462 | A | 6/1993 | Bruxvoort et al. | 51/293 |
| 5,221,291 | A | 6/1993 | Imatani et al. | 51/293 |
| 5,232,470 | A | 8/1993 | Wiand | 51/295 |
| 5,251,802 | A | 10/1993 | Bruxvoort et al. | 228/121 |
| 5,273,805 | A | 12/1993 | Calhoun et al. | 428/156 |
| 5,297,364 | A | 3/1994 | Tuttle | 451/527 |
| 5,304,225 | A | 4/1994 | Gardziella et al. | 51/298 |
| 5,316,812 | A | 5/1994 | Stout et al. | 428/64.1 |
| 5,318,604 | A | 6/1994 | Gorsuch et al. | 51/293 |
| 5,352,254 | A | 10/1994 | Celikkaya | 51/295 |
| 5,368,618 | A | 11/1994 | Masmar et al. | 51/295 |
| 5,397,369 | A | 3/1995 | Ohishi | 51/295 |
| 5,435,816 | A | 7/1995 | Spurgeon et al. | 51/295 |
| 5,437,754 | A | 8/1995 | Calhoun | 156/231 |
| 5,474,583 | A | 12/1995 | Celikkaya | 51/309 |
| 5,489,204 | A | 2/1996 | Conwell et al. | 432/153 |
| 5,496,386 | A | 3/1996 | Broberg et al. | 51/293 |
| 5,549,961 | A | 8/1996 | Haas et al. | 428/143 |
| 5,549,962 | A | 8/1996 | Holmes et al. | 428/144 |
| 5,551,961 | A | 9/1996 | Engen et al. | 51/298 |
| 5,611,825 | A | 3/1997 | Engen et al. | 51/295 |
| 5,611,828 | A | 3/1997 | Celikkaya | 51/309 |
| 5,628,806 | A | 5/1997 | Celikkaya et al. | 51/309 |
| 5,641,330 | A | 6/1997 | Celikkaya et al. | 51/309 |
| 5,653,775 | A | 8/1997 | Plovnick et al. | 51/309 |
| 5,674,122 | A | 10/1997 | Krech | 451/536 |
| 5,733,175 | A | 3/1998 | Leach | 451/41 |
| 5,820,450 | A | 10/1998 | Calhoun | 451/530 |
| 5,888,121 | A | 3/1999 | Kirchner et al. | 451/41 |
| 5,888,548 | A | 3/1999 | Wongsuragrai et al. | 424/489 |
| 5,910,041 | A | 6/1999 | Duescher | 451/28 |
| 5,910,471 | A | 6/1999 | Christianson et al. | 51/295 |
| 5,924,917 | A | 7/1999 | Benedict et al. | 451/526 |
| 5,967,882 | A | 10/1999 | Duescher | 451/57 |
| 5,975,988 | A | 11/1999 | Christianson | 451/28 |
| 5,984,988 | A | 11/1999 | Berg et al. | 51/293 |
| 5,993,298 | A | 11/1999 | Duescher | 451/56 |
| 6,017,265 | A | 1/2000 | Cook et al. | 451/41 |
| 6,048,254 | A | 4/2000 | Duescher | 451/28 |
| 6,080,215 | A | 6/2000 | Stubbs et al. | 51/295 |
| 6,099,390 | A | 8/2000 | Nishio et al. | 451/36 |
| 6,102,777 | A | 8/2000 | Duescher et al. | 451/36 |
| 6,120,352 | A | 9/2000 | Duescher | 451/41 |
| 6,149,506 | A | 11/2000 | Duescher | 451/59 |
| 6,168,508 | B1 | 1/2001 | Nagahara et al. | 451/527 |
| 6,186,866 | B1 | 2/2001 | Gagliardi | 451/28 |
| 6,217,413 | B1 | 4/2001 | Christianson | 451/28 |
| 6,228,133 | B1 | 5/2001 | Thurber et al. | 51/295 |
| 6,231,629 | B1 | 5/2001 | Christianson et al. | 51/295 |
| 6,277,160 | B1 | 8/2001 | Stubbs et al. | 51/295 |
| 6,277,161 | B1 | 8/2001 | Castro et al. | 51/309 |
| 6,287,353 | B1 | 9/2001 | Celikkaya | 51/309 |
| 6,299,508 | B1 | 10/2001 | Gagliardi et al. | 451/28 |
| 6,312,315 | B1 | 11/2001 | Gagliardi | 451/28 |
| 6,319,108 | B1 | 11/2001 | Adefris et al. | 451/533 |
| 6,371,842 | B1 | 4/2002 | Romero | 451/540 |
| 6,375,559 | B1 | 4/2002 | James et al. | 451/527 |
| 6,521,004 | B1 | 2/2003 | Culler et al. | 51/298 |
| 6,537,140 | B1 | 3/2003 | Miller et al. | 451/259 |
| 6,540,597 | B1 | 4/2003 | Ohmori | 451/443 |
| 6,551,366 | B1 | 4/2003 | D'Souza et al. | 51/309 |
| 6,592,640 | B1 | 7/2003 | Rosenflanz et al. | 51/309 |
| 6,602,439 | B1 | 8/2003 | Hampden-Smith et al. | 252/79.1 |
| 6,607,157 | B1 | 8/2003 | Duescher | 242/417.3 |
| 6,607,570 | B1 | 8/2003 | Rosenflanz et al. | 51/309 |
| 6,613,113 | B2 | 9/2003 | Minick et al. | 51/298 |
| 6,620,214 | B2 | 9/2003 | McArdle et al. | 51/298 |
| 6,641,627 | B2 | 11/2003 | Keipert et al. | 51/296 |
| 6,645,624 | B2 | 11/2003 | Adefris et al. | 428/402 |
| 6,669,749 | B1 | 12/2003 | Rosenflanz et al. | 51/309 |
| 6,752,700 | B2 | 6/2004 | Duescher | 451/59 |
| 6,766,817 | B2 | 7/2004 | da Silva | 137/1 |

| | | | | |
|---|---|---|---|---|
| 6,769,969 | B1 | 8/2004 | Duescher | 451/59 |
| 6,929,539 | B2 | 8/2005 | Schutz et al. | 451/534 |
| 7,632,434 | B2 * | 12/2009 | Duescher | 264/12 |
| 2002/0003225 | A1 | 1/2002 | Hampden-Smith et al. | 252/79.1 |
| 2003/0000151 | A1 | 1/2003 | Rosenflanz et al. | 51/309 |
| 2003/0022604 | A1 | 1/2003 | Annen et al. | 451/59 |
| 2003/0024169 | A1 | 2/2003 | Kendall et al. | 51/297 |
| 2003/0110707 | A1 | 6/2003 | Rosenflanz et al. | 51/307 |
| 2003/0110709 | A1 | 6/2003 | Rosenflanz et al. | 51/307 |
| 2003/0115805 | A1 | 6/2003 | Rosenflanz et al. | 51/307 |
| 2003/0126804 | A1 | 7/2003 | Rosenflanze et al. | 51/307 |
| 2003/0143938 | A1 | 7/2003 | Braunschweig et al. | 451/533 |
| 2003/0207659 | A1 | 11/2003 | Annen et al. | 45/526 |
| 2004/0020245 | A1 | 2/2004 | Rosenflanz et al. | 65/469 |
| 2004/0023078 | A1 | 2/2004 | Rosenflanz et al. | 428/702 |
| 2004/0148868 | A1 | 8/2004 | Anderson et al. | 51/308 |
| 2004/0148869 | A1 | 8/2004 | Celikkaya et al. | 51/308 |
| 2004/0148870 | A1 | 8/2004 | Celikkaya et al. | 51/309 |
| 2004/0148966 | A1 | 8/2004 | Celikkaya et al. | 65/17.4 |
| 2004/0148967 | A1 | 8/2004 | Celikkaya et al. | 65/21.2 |

OTHER PUBLICATIONS

"Experimental Study and Neural Network Modeling of the Ligament Disintegration in Rotary Atomization" Atomization and Sprays, vol. 12, pp. 107-121, 2002, Stephan Stemowsky and Gunther Schulte, University of Bremen, Bremen, Germany and Roberto Guardani and Claudio A. O. Nascimento, Chemical Engineering Department (LSCP), University of Sao Paulo, Sao Paulo, Brazil (15 pgs).

"Simulatios of Sol Gel Materials," Gelb Research Group at Washington University in St. Louis, http://www.chemistry.wustle.edu/~gelb/solgel.html. (later version) (13 pgs).

"Simulatios of Sol Gel Materials" Gelb Research Group at Washington University in St. Louis, http://www.chemistry.wustle.edu/~gelb/solgel.html. (newer version) (12 pgs).

"Silica Aerogels," Microstructures Materials Group, http://eetd.lbl.gov/ECS/aerogels/sa-making.html (6 pgs).

Introduction to Hybrid Organic-Inorganic Materials (12h), University of Bordeaux-1/Doctoral School of Chemical Sciences PhD students, http:www.icmcb.u-bordeaux.fr/duguet/ostdea.htm (30 pgs).

J. B. CalverT, "Colloids," http://mysite.du.edu/~jcalvert/phys/colloid.htm, Dec. 5, 2002. (12 pgs).

Malcolm Summers, et al., "Granulation," Dosage Form Design and Manufacture, pp. 364-378 (15 pgs).

* cited by examiner

EQUAL SIZED SPHERICAL BEADS

CROSS REFERENCE TO RELATED APPLICATION

This invention is a continuation-in-part of U.S. patent application Ser. No. 12/217,565 filed Jul. 7, 2008, now U.S. Pat. No. 8,062,098 which is a continuation-in-part of U.S. patent application Ser. No. 11/029,761 filed Jan. 5, 2005, which is a continuation-in-part of U.S. patent application Ser. No. 10/816,275 filed Aug. 16, 2004, now U.S. Pat. No. 7,520,800 which is a continuation-in-part of U.S. patent application Ser. No. 10/824,107 filed Apr. 14, 2004, now U.S. Pat. No. 7,632,434 which is a continuation-in-part of U.S. patent application Ser. No. 10/418,257, filed Apr. 16, 2003, now Abandoned, which is a continuation-in-part of U.S. patent application Ser. No. 10/015,478 filed Dec. 13, 2001, now U.S. Pat. No. 6,752,700, which is a continuation-in-part of U.S. patent application Ser. No. 09/715,448 filed Nov. 17, 2000, now U.S. Pat. No. 6,769,969, and which applications are incorporated herein by reference.

BACKGROUND OF THE ART

Field of the Invention

The present invention relates to forming equal sized spherical beads of abrasive materials and also beads of non-abrasive materials. Abrasive beads are coated on substrates and are used to abrade workpieces.

Spherical beads are also produced in solid and hollow forms and are used in many applications comprising light reflectors for signs, reflective coatings, as filler materials for plastics, containment devices for gases and other materials, as metal or alloy spheres, as foodstuffs, for agricultural material and for pharmaceuticals. It is desired that these beads have equal sizes and have controlled diameters.

The process of manufacturing equal sized abrasive and non-abrasive material beads described here provides beads having a wide range of nominal diameters where the bead diameters have a very narrow standard deviation in size. By comparison, the production processes that are described for manufacturing the prior art abrasive beads produce beads that typically have a very wide standard deviation of the diameter of the beads.

Here, the equal sized beads are produced from screens having equal volume mold cavity cells. The cavity cells are through holes in the screens where the cavity through holes each have equal sized open cross sectional areas and the through holes have a depth that is equal to the screen thickness. The bead material is made into a liquid solution that is introduced into the screen cavity cells whereby each cavity cell is level-filled to the top and bottom of the substantially flat opposed surfaces of the screen. Equal sized lump entity volumes of liquid bead material contained in the cells are ejected as liquid lumps from the cavity cells. The volume of each individual ejected liquid lump is equal to the contained volume of the cavity cell it resided in prior to the ejection event. Surface tension forces then act on the ejected liquid bead material lumps to form them into spherical material beads that are then solidified. The volumetric size and diameter of each solidified material bead is dependent on the volumetric size of the mold cavity cells. Using screens having precision sized cell cavities allows the production of precisely sized material beads.

Other prior art non-mold bead forming processes that are now used to produce material beads depend on phenomena associated with fluid flow instabilities that promote the periodic formation of lumps of the moving liquid. The individual liquid lumps are then formed into spheres by surface tension forces. Controlled frequency vibration is often applied to the liquid as it is breaking-up into lump segments to minimize the differences in the formed lump sizes. In another bead forming technique, vibration is applied to plates covered with thin layers of liquid materials to form spherical liquid material beads with a process that is roughly analogous to water droplets being formed as moving waves impact rocks on a shoreline. These bead production techniques produce a range of different sized beads even though the nominal or average size of the produced beads can be controlled. Beads are produced that are both larger and smaller than the nominal or average bead size where the statistical size distribution of the beads produced in a batch process is typically broken into size ranges that are centered about the nominal bead size. The larger beads often are twice, or more, the size of the smaller beads.

In another prior art example, abrasive or ceramic beads are produced by directing a liquid stream of a slurry mixture of a water based ceramic precursor material, that can optionally be mixed with abrasive particles, into a container of a dehydrating liquid. The dehydrating liquid is stirred and the slurry mixture liquid stream tends to break into small lumps due to the stirring action. Faster stirring produces nominally smaller lumps but there is typically a wide range of lump sizes that are produced by the stirring action. The individual material lumps then form into spherical shapes due to surface tension forces acting on them. Dehydration of the slurry spheres produces solidified ceramic beads that are heat treated to produce solid or hollow ceramic beads.

In another prior art example, abrasive beads are produced by pouring a liquid stream of a slurry of a water based ceramic precursor material mixed with abrasive particles into the center of a wheel of a atomizer wheel that is rotating at approximately 40,000 RPM (revolutions per minute). The slurry tends to exit the wheel in ligament slurry streams that break up into individual slurry lumps that travel in a trajectory in a hot air environment that dehydrates the slurry lumps. The lumps form into spherical shapes due to surface tension forces acting on the individual liquid slurry lumps. Changing the rotational speed of the wheel changes the average size of the liquid lumps. Dehydration of the slurry spheres produces solidified abrasive precursor beads that are heat treated to produce soft ceramic abrasive beads. These well known prior art abrasive beads produced by the liquid stream stirring system or the rotary atomizer wheel do not produce batches of beads having equal sized diameters. Instead, they produce batches of beads that have a wide range of diameter sizes.

Spray nozzles that break up a stream of pressurized liquid into small droplets is often used but the spray heads produce a large range of droplet sizes. Pipes or tubes are also used to form liquid beads. This is a process that is roughly analogous to water droplets being formed as moving water exits a garden hose. One disadvantage of the use of small tubes is that the liquid droplets are roughly approximate to twice the inside diameter of the tubes. In order to produce the desired 0.002 inch (51 micrometer) abrasion dispersion droplets, the hypodermic-type tubes would need an inside diameter of approximately 0.001 inches (25 micrometers) which is prohibitively small for abrasive bead manufacturing. Also, the abrasive particles contained in the dispersion liquid would quickly erode-out the inside passageways of these small tubes as the dispersion is forced through them.

BACKGROUND OF THE INVENTION

Abrasive agglomerates are preferred to be spherical in shape and to be of a uniform size for precision lapping of workpieces. These spherical abrasive agglomerates are referred to here as abrasive beads or beads. If undersized beads are mixed with full sized beads and coated on the surface of abrasive articles, the undersized beads are often not used in the abrading process as they are too small to come into contact with a workpiece surface. This means also, that the expensive materials commonly used in including diamond particles, are wasted as they are not used. A method is described here for the manufacture of equal sized abrasive beads that can be used for abrasive articles that prevents the non-utilization and waste of undersized beads. Further these equal sized beads have the potential to produce higher precision accuracy workpiece surfaces in flat lapping than can abrasive articles having surfaces coated with a mixture of different sized beads as the workpiece would always be in contact with the same sized beads, each having the same abrading characteristics. It is thought that small diameter beads will have different abrading characteristics, including rate of material removal, as compared to large sized beads, both at very low relative surface contact speeds of less than 1000 surface feet per minute when moving small workpieces, including fiber optic devices, relative to the abrasive article surface and also, at high flat lapping surface speeds of greater than 1000 surface feet per minute where typically, the workpiece is held in contact with a moving abrasive article.

The same techniques that are described here to produce equal sized abrasive beads can also be used to produce equal sized beads of a large range of non-abrasive materials.

U.S. Pat. No. 2,216,728 (Benner et al.) discloses a porous composite diamond particle agglomerate granule comprised of materials including ceramics and a borosilicate glass matrix.

U.S. Pat. No. 3,423,489 (Arens, et al.) discloses a number of methods including single, parallel and concentric nozzles to encapsulate water and aqueous based liquids, including a liquid fertilizer, in a wax shell by forcing a jet stream of fill-liquid fertilizer through a body of heated molten wax. The jet stream of fertilizer is ejected on a trajectory from the molten wax area at a significant velocity into still air. The fertilizer carries an envelope of wax and the composite stream of fertilizer and wax breaks up into a string of sequential composite beads of fertilizer surrounded by a concentric shell of wax. The wax hardens to a solidified state over a free trajectory path travel distance of about 8 feet in a cooling air environment thereby forming structural spherical shapes of wax encapsulated fertilizer capsules. Surface tension forces create the spherical capsule shapes of the composite liquid entities during the time of free flight prior to solidification of the wax. The string of composite capsule beads demonstrate the rheological flow disturbance characteristics of fluid being ejected as a stream from a flow tube resulting in a periodic formation of capsules at a formulation rate frequency measured as capsules per second. Capsules range in size from 10 to 4000 microns.

U.S. Pat. No. 3,709,706 (Sowman) discloses solid and hollow ceramic microspheres having various colors that are produced by mixing an aqueous colloidal metal oxide solution, that is concentrated by vacuum drying to increase the solution viscosity, and introducing the aqueous mixture into a vessel of stirred dehydrating liquid, including alcohols and oils, to form solidified green spheres that are fired at high temperatures. Spheres range from 1 to 100 microns but most are between 30 and 60 microns. Smaller sized spheres are produced with more vigorous dehydrating liquid agitation. Another sphere forming technique is to nozzle spray a dispersion of colloidal silica, including Ludox, into a countercurrent of dry room temperature or heated air to form solidified green spherical particles.

U.S. Pat. No. 3,711,025 (Miller) discloses a centrifugal rotating atomizer spray dryer having hardened pins used to atomize and dry slurries of pulverulent solids.

U.S. Pat. No. 3,916,584 (Howard, et al.), herein incorporated by reference, discloses the encapsulation of 0.5 micron up to 25 micron diamond particle grains and other abrasive material particles in spherical erodible metal oxide composite agglomerates ranging in size from 10 to 200 microns and more. The spherical composite abrasive beads are produced by mixing abrasive particles into an aqueous colloidal sol or solution of a metal oxide (or oxide precursor) and water and the resultant slurry is added to an agitated dehydrating liquid including partially water-miscible alcohols or 2-ethyl-1-hexanol or other alcohols or mixtures thereof or heated mineral oil, heated silicone oil or heated peanut oil. The slurry forms beadlike masses in the agitated drying liquid. Water is removed from the dispersed slurry and surface tension draws the slurry into spheroidal composites to form green composite abrasive granules. The green granules will vary in size; a faster stirring of the drying liquid giving smaller granules and vice versa. The resulting gelled green abrasive composite granule is in a "green" or unfired gel form. The dehydrated green composite generally comprises a metal oxide or metal oxide precursor, volatile solvent, e.g., water, alcohol, or other fugitives and about 40 to 80 weight percent equivalent solids, including both matrix and abrasive, and the solidified composites are dry in the sense that they do not stick to one another and will retain their shape. The green granules are thereafter filtered out, dried and fired at high temperatures. The firing temperatures are sufficiently high, at 600 degrees C. or less, to remove the balance of water, organic material or other fugitives from the green composites, and to calcine the composite agglomerates to form a strong, continuous, porous oxide matrix (that is, the matrix material is sintered). The resulting abrasive composite or granule has a essentially carbon-free continuous microporous matrix that partially surrounds, or otherwise retains or supports the abrasive grains.

U.S. Pat. No. 3,933,679 (Weitzel et al.) discloses the formation of uniform sized ceramic microspheres having 1540 microns and smaller ideal droplet diameters. Mechanical vibrations are induced in an aqueous oxide sol-gel fluid stream to enhance fluid stream flow instabilities that occur in a coaxial capillary tube jet stream to form a stream of spherical droplets. Droplets are about twice the size of the capillary orifice tube diameter and the vibration wavelength is about three times the diameter of the tube. The spherical oxide droplets are solidified in a dehydrating gas or in a dehydrating liquid after which the solidified droplets are sintered.

U.S. Pat. No. 4,018,576 (Lowder, et al.) discloses the metal coating of diamond particles with metal alloys that readily wet the surface of the diamond crystals particularly when used with fluxing agents.

U.S. Pat. No. 4,112,631 (Howard), herein incorporated by reference, discloses the encapsulation of 0.5 micron up to 25 micron diamond particle grains and other abrasive material particles in spherical composite agglomerates ranging in size from 10 to 200 microns.

U.S. Pat. No. 4,314,827 (Leitheiser, et al.) discloses processes and materials used to manufacture sintered aluminum oxide-based abrasive material having shapes including spherical shapes that are processed in an angled rotating kiln at temperatures up to 1350 degrees C. with a final high temperature zone residence time of about 1 minute.

U.S. Pat. No. 4,364,746 (Bitzer, et al.) discloses the use of composite abrasive agglomerates. Agglomerates include spherical abrasive elements. Composite agglomerates are formed by a variety of methods. Individual abrasive grains are coated with various materials including a silica ceramic that is applied by melting or sintering. Agglomerated abrasive grains are produced by processes including a fluidized spray granulator or a spray dryer or by agglomeration of an aqueous suspension or dispersion.

U.S. Pat. No. 4,373,672 (Morishita, et al.) discloses a high speed air-bearing electrostatic automobile body sprayer article that produces 15 micron to 20 micron paint-drop particles by introducing a stream of a paint liquid into a segmented bore opening rotating head operating at 80,000 rpm. Comparatively, a slower like-sized ball-bearing sprayer head rotating at 20,000 rpm produces 55 micron to 65-micron diameter drops. A graph showing the relationship between the size of paint drop particles and the rotating speed of the spray head is presented.

U.S. Pat. No. 4,421,562 (Sands) discloses microspheres formed by spraying an aqueous sodium silicate and polysalt solution with an atomizer wheel.

U.S. Pat. No. 4,541,566 (Kijima, et al.) discloses use of tapered wall pins in a centrifugal rotating head spray dryer that produces uniform 50 to 100 micron sized atomized particles using 1.0 to 4.0 specific gravity, 5 to 18,000 c.p. viscosity feed liquid when operating at 13 to 320 m/sec rotating head peripheral velocity.

U.S. Pat. No. 4,541,842 (Rostoker) discloses spherical agglomerates of encapsulated abrasive particles including 3 micron silicone carbide particles or cubic boron nitride (CBN) abrasive particles encapsulated in a porous ceramic foam bubble network having a thin-walled glass envelope. The composites are formed into spherical shapes by blending and mixing an aqueous mixture of ingredients including metal oxides, water, appropriate abrasive grits and conventional known compositions which produce spherical pellet shapes that are fired. Composite agglomerates of 250-micron size are dried and then fired at temperatures of up to 900 degrees C. or higher using a rotary kiln.

U.S. Pat. No. 4,776,862 (Wiand), herein incorporated by reference, discloses diamond and cubic boron nitride abrasive particle surface metallization with various metals and also the formation of carbides on the surface of diamond particles to enhance the bonding adhesion of the particles when they are brazed to the surface of a substrate.

U.S. Pat. No. 4,918,874 (Tiefenbach) discloses a slurry mixture including 8 micron and less diamond and other abrasive particles, silica particles, glass-formers, alumina, a flux and water, drying the mixture with a 400 degree C. spray dryer to form porous greenware spherical agglomerates that are sintered. Fluxes include an alkali metal oxide, such as potassium oxide or sodium oxide, but other metal oxides, such as, for example, magnesium oxide, calcium oxide, iron oxide, etc., can also be used.

U.S. Pat. No. 4,930,266 (Calhoun, et al.) discloses the application of spherical abrasive composite agglomerates made up of fine abrasive particles in a binder in controlled dot patterns where preferably one abrasive agglomerate is deposited per target dot by use of a commercially available printing plate. He teaches that the composite abrasive agglomerate granules should be of substantially equal size, i.e., the average dimension of 90% of the composite granules should differ by less than 2:1. Abrasive grains having an average dimension of about 4 microns can be bonded together to form composite sphere granules of virtually identical diameters, preferably within a range of 25 to 100 microns. Preferably, the abrasive composite granules have equal sized diameters where substantially every granule is within 10% of the arithmetic mean diameter so that the granules protrude from the surface of the binder layer to substantially the same extent and also so the granules can be force-loaded equally upon contacting a workpiece.

U.S. Pat. No. 4,931,414 (Wood, et al.) discloses the formation of microspheres by forming a sol-gel where a colloidal dispersion, sol, aquasol or hydrosol of a metal oxide (or precursor thereof) is converted to a gel and added to a peanut oil dehydrating liquid to form stable spheriods that are fired. A layer of metal (e.g. aluminum) can be vapor-deposited on the surface of the microspheres. Various microsphere-coloring agents were disclosed.

U.S. Pat. No. 5,175,133 (Smith, et al.) discloses bauxite (hydrous aluminum oxide) ceramic microspheres produced from a aqueous mixture with a spray dryer manufactured by the Niro company or by the Bowen-Stork company to produce polycrystalline bauxite microspheres. Gas suspension calciners featuring a residence time in the calcination zone estimated between one quarter to one half second where microspheres are transported by a moving stream of gas in a high volume continuous calcination process. Scanning electron microscope micrograph images of samples of the microspheres show sphericity for the full range of microspheres. The images also show a wide microsphere size range for each sample, where the largest spheres are approximately six times the size of the smallest spheres in a sample.

U.S. Pat. No. 5,201,916 (Berg et al) describes abrasive particles that are formed with the use of a mold cavity cell belt or mold sheet that has a planar surface. Berg produces sharp-edged, flat-surfaced abrasive particles from aluminum oxide dispersion materials.

His system is not capable of making spherical abrasive particles. The production of spherical shaped abrasive particles would require that the dispersion used to fill his mold cavities would be ejected from the cavities in a liquid form to allow surface tension forces to act on the ejected dispersion lumps to form them into spherical shapes. However, he must solidify his dispersion while it resides in the cavities to assure that the dispersion lump particles assume the particle sharp-edge corners from the sharp-edged mold cavities. If the Berg ejected dispersion particles were in a liquid state, surface tension forces would act on them and form the dispersion lumps into spherical shapes with the associated loss of the sharp particle cutting edges. Also, spherical abrasive particles made of his materials by his system would be useless for abrading purposes because the resultant spherical particles do not provide sharp cutting edges.

Berg describes the use of alpha aluminum oxide (alumina) particles that are dispersed and suspended in water as a liquid colloidal solution. The colloidal solution is then gelled, a process whereby the individual suspended colloidal aluminum oxide particles are first joined together into strings or fibers of oxide particles. These oxide strings then come into random-position contact with each other to form a matrix, or interconnected network, of oxide particle branches. Water is present in the areas between the individual particle branches. A gelled colloidal dispersion solution has the appearance of a brush pile made up of tree branches that are piled together. In addition, the individual strings or branches of alumina dispersion particles are bonded together at each intersection of two strings, which completely joins together the gelled oxide dispersion. Because of the water surrounding the branches, a gelled dispersion of oxide particles is analogous to a pile of branches that is submerged in lake water where the individual branches are bonded together at each intersection point. Here the whole brush pile could be lifted or more as a brush pile entity because of the structural bonding of each branch to all of the other branches that it is in contact with. As is well known in colloidal chemistry, once a colloidal oxide solution is gelled, the gelling process is irreversible, where the original suspended alumina (or silica) oxide particles do not go back into colloidal suspension or reform back into a liquid. Surface tension forces can only form a non-gelled liquid dispersion solution into a spherical shape. They can not formed a gelled dispersion solution into a spherical shape.

After the dispersion is gelled into solidified lumps, the gelled lumps are chopped up with rotary blades and these gelled pieces are extruded into the cell cavities with the use of an auger device as shown in his drawings. As would be recognized by those skilled in the art, his dispersion gel cutter blades and augers are not used to process a liquid dispersion. Instead, these cutter blades would be used to process a partially-solidified material such as the gelled dispersion. When the gelled dispersion is forced into the mold cavities by the extruder system, all the individual chopped-up pieces of the gelled dispersion in a cavity readily bond with adjacent pieces to form an integrally bonded gelled dispersion lump within each mold cavity. The force-fitting of the gelled dispersion material into the individual cavities assures that the gelled dispersion lump assumes the sharp-edged shapes of the mold cavities. The molded gelled material is then subjected to heating to assure that the material contained in each individual is further solidified and also, that the cavity lump is shrunk in size. Shrinking the dispersion lump material that is contained in each cavity allows the dispersion lump to be reduced in size relative to the fixed-size cavities whereby the shrunken sharp edge solidified dispersion lump will simply fall out of the open cavity due to the effects of gravity. Heating is continued until the alumina material contained in each cavity shrinks enough that the individual alumina particles drop freely out of the cavities due to gravity.

Berg shows a completely passive particle ejection system in his drawings. There are no shown external forces that are applied to the particles to eject them from the cavities. The collection pan that is used to collect the dried and shrunken abrasive precursor particles that fall out of the mold belt allows many particles to be collected in a common mass where the sharp edges of each individual particle is not damaged in the fall into the pan. Also, each individual particle is sufficiently solidified that the individual particles do not fuse to each other as they reside in the collection pan. If these particles were to fuse to each other while residing in the collection pan, those sharp edges of one particle that were joined with an adjacent particle would be destroyed, which would be an very undesirable event for Berg. He does not have to apply a pressure on the mold cavities to eject them (except if his mold filling process is defective).

However, if Berg has a defective mold filling process where some of his gelled dispersion overfills the individual mold cavities and the dispersion is inadvertently smeared in a thin layer along the flat surface of the mold sheet, the smeared dispersion portion tends to overhang the edges of the mold cavity. When the dispersion in the cavities is solidified within the cavity the dispersion overhanging portion is also solidified. Because the solidified overhanging dispersion portion is an integral part of the dispersion lump contained within the cavity it is impossible for the dried and shrunken particles to fall out of the cavities just due to gravity. Instead, these shrunken particles hang-up on the upper edges of the mold sheet because the undesirable thin dispersion layer, that is attached to the now-shrunken dispersion lump, overhangs the cavity walls and acts as a cantilever bridging dispersion member that extends past the cavity walls. The overhanging dispersion portion will also shrink a small percentage of its overhanging length but its nominal overhanging length will remain substantially the same as its original overhanging length. At the intended time of ejection of the dispersion lump from the cavity, all the dispersion has been solidified with a corresponding increase in structural strength of the dispersion material, especially to the overhanging dispersion portion. This relatively strong overhanging ledge portion of the solidified dispersion that extends past the cavity walls can not be easily sheared off as compared to a liquid dispersion material. The strength of the thin overhanging dispersion lip that is attached to the dispersion lump prevents the shrunken dispersion lump, that is now undersized relative to the size of the cavity, to simply drop out of the cavity due to the force effect of gravity. However, because the overhang dispersion material is thin and the solidified dispersion is relatively weak at this stage of gelled solidification, the overhanging edges of the lodged particles can be easily broken off with a small externally applied pressure.

This edge-breakage produces defective abrasive particles that have non-sharp cutting edges on those particle edges (only) that were broken off in the pressure ejection process. The broken-off edges and the defective particles are considered debris. This debris is mixed with the acceptable particles. The debris reduces the quality of his abrasive particle product unless it is separated out, which requires an extra manufacturing step. In addition he has to clean out any cavities that were not emptied. Berg takes great care that it is not necessary to use an external pressure to dislodge particles that are stuck in his mold cavities as shown by the belt surface scrapping devices in his patent drawings.

Even though the gelled material that resides in each mold cavity still contains a high percentage of water, this is not an indicator that the gelled dispersion is in a liquid state. For instance Jello® is an example of a colloidal gelatin material that is suspended in water. It gels into a wiggly substance but solidified substance even when the gelled dispersion is 90% water. Here, only 10% of the Jello® is comprised of gelatin materials. Long curved fibrous strands of the gelatin that are cross-linked together form the structure of the Jello®. These fibrous strands are contained within the same volume that the water is contained within. After it is gelled, it can be cut into rectangular-shaped cake-piece sections that have sharp edges. These individual cut pieces can be stacked into a bowl (collected together in a common mass) without the sharp edges of the Jello® cut pieces becoming damaged. Furthermore, a single rectangular cut-piece of gelled Jello® can be left standing on a hard surface or can be suspended in air without the occurrence of any "rounding-off" of the sharp edges of the cut-piece. This is a demonstration that surface tension forces do not "round the edges" of a gelled colloidal solution when the gelled entity is not subjected to external or applied forces.

Similarly water of hydration is held in salts (e.g., cupric-sulfate-5H2O) and is present in an amount over 35% by weight of the salt and remains a hard solid. It is clear from these examples that the presence of more than 30% water in a composition does not mean the composition is a liquid.

By comparison to Berg, the present invention describes spherical-shaped abrasive beads from silica (silicone dioxide) dispersion materials. The beads encapsulate already-formed, extremely hard and sharp-edged diamond abrasive particles in a soft, low density and porous silica matrix material. The abrasive beads are erodible where the individual encapsulated sharp and hard diamond particles are continuously exposed during an abrading process as the soft and erodible porous silica matrix material is worn down.

In the present invention, an impinging fluid jet or pressure must be used to eject the liquid dispersion entities from the cavities because the liquid entities are attached or bonded or attracted to the walls of the cavities and therefore, can not be ejected from the cavities by use of gravity alone (as in Berg). This is especially the case for the small mold cavities that are used to produce abrasive spheres that are only 50 micrometers (0.002 inches) in diameter. Because the dispersion entities are liquid at the time of ejection from the cavities, where these liquid entities are in full body contact with all the wall surfaces of the cavities, there is liquid adhesion bonding between the entities and the cavity walls. These liquid adhesion forces are so strong that they overcome the cohesion (surface tension) forces that tend to draw the liquid entities together into sphere-like shapes as the liquid entities reside within the cavities. Here the dispersion entities completely fill a cavity but the adhesion forces and the liquid cohesion forces are in equilibrium. To eject the liquid dispersion entities from the cavities, the applied fluid jet ejection forces must be strong enough to overcome the liquid adhesion forces that bond the liquid entities to the wall surfaces of the cavities. Once the adhesion attachment forces are "broken" by the fluid jet forces that are imposed on the liquid entities, the dispersion entities are ejected as a single lump from the cavities. Because the cohesion surface tension forces within the liquid entities are no longer opposed by the adhesion forces (that had attached the entities to the cavity walls) the irregular shaped ejected entities are individually shaped by these surface tension forces into spherical entity shapes.

At this time a critical drying or solidification event must take place where the spherical shaped entities are ejected into a dehydrating or solidification environment. It is critical that these individual abrasive bead entities become dried or solidified sufficiently while they are suspended in the dehydrating fluid or solidification environment before they fall into a common pile where they are collected for further heat treatment or other processing. IF these dispersion entities are not dried at the time of mutual collection, they will stick to each other and the spherical shape of each entity will be destroyed. The production of non-spherical dispersion entities is considered to be a failure of this abrasive bead manufacturing process. By comparison, Berg does not use or need the dehydrating fluid environment immediately after particle ejection from the cavities because his dispersion particle entities are already dry enough that they can be collected together immediately after ejection. His ejected particles are so dry at that time that they do not stick to each other when collected together in a common pile. If his entities did stick together during this common-particle collection event, the sharp edges that he so painstakingly formed on his individual abrasive precusor particles would be lost when adjacent particles merged together into a common mass.

Further, even though his ejected particles still contain significant amounts of water, including bound-water, these same ejected particles are not rounded by surface tension forces because they would lose their sharp edges if they did become so-rounded in this post-ejection event.

It would not be possible to substitute a woven wire screen for Berg's cavity molds to manufacture his dispersion entities. The cavity cell volumes formed by the individual interleaved wire strands in the woven screen are interconnected with adjacent cells. The cells "appear" to be separated by the wire strands as viewed from the top flat surface of the screen. However, the actual screen thickness results from the composite thickness of individual wires that are bent around perpendicular wires where the screen thickness is often equal to three times the diameter of the woven wires. Adjacent "cell volumes" are contiguous across the joints formed by the perpendicular woven wires. Level-filling the screen with Berg's dispersion creates adjacent cell dispersion entities that are joined together across these perpendicular wire joints. When Berg dries and solidifies his screen-cell volume dispersion entitles, the entities shrink and some entities would pull themselves apart from each other at the screen wire joints that mutually bridge adjacent cells. However, the entity shrinkage will not be sufficient that the non-joined solidified entities will pass through the screen cell openings. These entities will remain lodged in the screen mesh as the portions of the solidified dispersion entity bodies that extend across the woven wire joints trap them. Berg can not use a woven screen to process his dispersion entities because the trapped solidified entities can not be ejected from the individual woven wire screen cells.

The liquid dispersion entities contained in the woven wire screen cells described in the present invention can be easily ejected from the individual cells because the entities are ejected when they are in a liquid state. The fluid jet that ejects the dispersion entities from their respective cells separates the portions of the dispersion entity main bodies that extend across the woven wire joints to form ejected individual liquid dispersion entities. Surface tension forces acting on the ejected dispersion entities form the entities into spherical shapes.

Fracturing a solid and hardened sharp edged Berg-type aluminum oxide abrasive during an abrading event is not the same as eroding the present invention abrasive agglomerate that encapsulates existing sharp edged abrasive particles in a soft matrix material. When an abrasive particle erodes, the soft matrix material is worn away whereby individual dull edged abrasive particles are ejected from the matrix material and fresh new individual sharp edged abrasive particles are exposed.

Also, it would not be practical or desirable to incorporate pre-formed sharp diamond particles into Berg's hardened aluminum oxide abrasive particles because of the degradation of the diamond material at the high firing temperatures required to harden his aluminum oxide materials sufficiently that they can be used as an abrasive material.

U.S. Pat. No. 5,489,204 (Conwell, et al.) discloses a non rotating kiln apparatus useful for sintering previously prepared unsintered sol gel derived abrasive grain precursor to provide sintered abrasive grain particles ranging in size from 10 to 40 microns. Dried material is first calcined where all of the mixture volatiles and organic additives are removed from the precursor. The stationary kiln system described sinters the particles without the problems common with a rotary kiln including loosing small abrasive particles in the kiln exhaust system and the deposition on, and ultimately bonding of abrasive particles to, the kiln walls.

U.S. Pat. No. 5,888,548 (Wongsuragrai, et al.) discloses formation and drying of rice starches into 20 to 200 micron spherical agglomerates by mixing a slurry of rice flour with silicone dioxide and using a centrifugal spray head at elevated temperatures.

U.S. Pat. No. 6,319,108 (Adefris, et al.), herein incorporated by reference, discloses the electroplating of composite porous ceramic abrasive composites on metal circular disks having localized island area patterns of abrasive composites that are directly attached to the flat surface of the disk. Glass-ceramic composites are the result of controlled heat-treatment. The pores in the porous ceramic matrix may be open to the external surface of the composite agglomerate or sealed.

Pores in the ceramic mix are believed to aid in the controlled breakdown of the ceramic abrasive composites leading to a release of used (i.e., dull) abrasive particles from the composites. A porous ceramic matrix may be formed by techniques well known in the art, for example, by controlled firing of a ceramic matrix precursor or by the inclusion of pore forming agents, for example, glass bubbles, in the ceramic matrix precursor. Preferred ceramic matrixes comprise glasses comprising metal oxides, for example, aluminum oxide, boron oxide, silicone oxide, magnesium oxide, manganese oxide, zinc oxide, and mixtures thereof. A preferred ceramic matrix is alumina-borosilicate glass. The ceramic matrix precursor abrasive composite agglomerates are fired by heating the composites to a temperature ranging from about 600-950 degree C. At lower firing temperatures (e.g., less than about 750 degree C.) an oxidizing atmosphere may be preferred. At higher firing temperature (e.g., greater than about 750 degree C.) an inert atmosphere (e.g., nitrogen) may be preferred. Firing converts the ceramic matrix precursor into a porous ceramic matrix.

U.S. Pat. No. 6,645,624 (Adefris, et al.), herein incorporated by reference, discloses the manufacturing of abrasive agglomerates by use of a high-speed rotational spray dryer to dry a sol of abrasive particles, oxides and water.

U.S. Pat. No. 6,521,004 (Culler, et al.) and U.S. Pat. No. 6,620,214 (McArdle, et al.) disclose the manufacturing of abrasive agglomerates by use of a method to force a mixture of abrasive particle through a conical perforated screen to form filaments which fall by gravity into an energy zone for curing.

U.S. Pat. No. 4,773,599 (Lynch, et al.) discloses an apparatus for extruding material through a conical perforated screen.

U.S. Pat. No. 4,393,021 (Eisenberg, et al.) discloses an apparatus for extruding a mix of grit materials with rollers through a sieve web to form extruded worm-like agglomerate lengths that are heated to harden them.

SUMMARY OF THE INVENTION

A method to produce equal sized spherical beads from a wide range of materials is described. These spheres can contain abrasive particles that can be coated on the surface of a backing to produce an abrasive article. The spheres can contain other particles or simply consist of ceramic or other materials. After solidifying the spherical beads in an solidifying environment, the spherical particles can be further solidified in heated air or by using other solidifying techniques well know in the art.

DETAILED DESCRIPTION OF THE INVENTION

Figure 1:
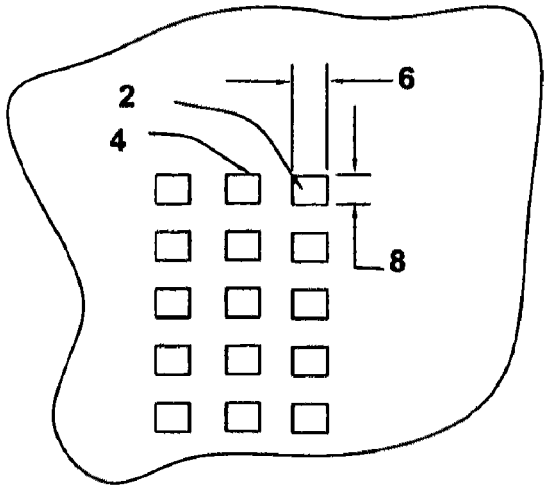
FIG. 1 is a top view of an open mesh screen having a rectangular array of open cells

Abrasive particles or abrasive agglomerates can range in size from less than 0.1 micron to greater than 400 microns. In the abrasive agglomerates, hard abrasive particle grains are distributed uniformly throughout a matrix of erodible material including softer microporous metal or non-metal oxides (e.g., silica, alumina, titania, zirconia-silica, magnesia, alumina-silica, alumina and boria or boria) or mixtures thereof including silica-alumina-boria or others.

Near-spherical composite abrasive shapes can be produced by creating agglomerates of an water based abrasive slurry that are dried when free-span travelling in heated air or in a dehydrating liquid during which time surface tension forces tend to produce near-spherical shapes prior to solidification of the agglomerates. A desirable size of agglomerates having 10 micron or less abrasive particles is 30 to 45 microns or less and a desirable size of agglomerates having 25 micron or less abrasive particles is 75 microns or less.

The present invention may be further understood by consideration of the figures and the following description thereof.

Screen Formation of Spherical Ceramic Abrasive Agglomerates

Problem: It is desired to form spherical ceramic abrasive particle composite agglomerates or beads that are made of abrasive powder particles mixed with metal or non-metal oxides or other materials where each of the agglomerates have the same nominal size. Production of equal-sized beads increases the bead product utilization as expensive composite beads that are not of the desired size at times do not have to be discarded. Also, the use of undersized beads that do not contact a workpiece surface is avoided. Spherical composite abrasive agglomerate beads produced by the present methods of manufacturing tend to result in the simultaneous production of agglomerate beads having a wide range of sizes during the process of encapsulating a single abrasive particle size. When this wide range of different sized agglomerate beads are coated together on an abrasive article, the capability of the article to produce a smooth finish is primarily related to the size of the individual abrasive particles that are encapsulated within a bead body, rather than being related to the diameter of the bead body. Also, when abrasive beads are coated in a monolayer on the surface of an abrasive article, it is desired that each of the individual beads have approximately the same diameter to effectively utilize all of the abrasive particles contained within each bead. If small beads that are mixed with large beads are coated together on an abrasive article, contact of the small beads with a workpiece surface is prevented by the adjacent large diameter beads that contact the surface first. Typically the number of particles contained within a small bead is insufficient to provide a reasonable grinding or lapping abrading life to the abrasive article before all of the particles are worn away. The number of individual particles encapsulated within the body volume of a spherical agglomerate bead is proportional to the cube of the diameter of the bead sphere but the average height of the bulk of the particles, located close to the sphere center, is directly proportional to the sphere diameter. A small increase in a bead diameter results in a modest change of the bulk agglomerate center height above the surface of a backing sheet, but the same diameter change results in a substantial increase in the number of individual abrasive particles that are contained within the bead body. Most of the volume of abrasive particles are positioned at a elevation raised somewhat off the surface of the backing sheet, or the surface of a raised island, that results in good utilization of nearly all the encapsulated abrasive particles during the abrading process before the agglomerate is completely worn down. Even though the spherical bead shape is consumed progressively during the abrading process, the body of the remaining semi-spherical agglomerate bead structure has sufficient strength and rigidity to provide support and containment of the remaining abrasive particles as they are contacted by a moving workpiece surface. It is necessary to provide gap spacing between adjacent agglomerate beads to achieve effective abrading. The presence of coated undersized non-contacted agglomerate beads results in the water and swarf passageways existing between the large diameter agglomerates being blocked by the small agglomerates. The nominal size of the abrasive bead diameters is also selected to have sufficient sphere-center heights to compensate for both the thickness variations in the abrasive sheet article and also the out-of-flatness variations of the abrasive sheet platen or platen spindle. Overly small beads located in low-spot areas on a non-flat platen rotating at very high rotational speeds are not utilized in the abrading process as only the largest sized beads, or the small beads located at the high-spot areas of a rotating abrasive disk article, contact the surface of a workpiece. When a non-flat abrasive surface rotates at high speeds, a workpiece is typically driven upward and away from low-spot areas due to the dynamic impact effects of abrasive article high-spots periodically hitting the workpiece surface during the high speed rotation of a workpiece contacting abrasive platen. Workpieces subjected to these once-around impacts are prevented from travelling up and down in contact with the uneven abrasive surface due to the inertia of the workpiece or the inertia of the workpiece holder. Most of an abrasive article beads can be utilized if the abrasive platen is operated at sufficiently low rotational speeds where a small or low inertia workpiece can dynamically follow the periodically changing contour of a non-flat moving abrading surface. However, the abrasion material removal rate is substantially reduced at these low surface speeds as the material removal rate is thought to be proportional to the abrading surface speed. Use of very large diameter agglomerate spheres or beads addresses the problem of abrasive article thickness variations or platen surface flatness variations. Very large beads introduce the disadvantage of tending to create a non-level abrading surface during abrading operations as the coated abrasive is too thick to retain its original-reference precision flatness over extended abrading use. A non-level abrasive surface typically can not generate a flat surface on a workpiece. There is a trade-off in the selection of the abrasive coating thickness or selection of the size of abrasive beads coated on an abrasive article. If the abrasive coating is too thick or the beads too large, the original flat planer surface of the abrasive article ceases to exist as abrading wear proceeds. If the abrasive coating is too thin, or the beads are too small, the abrasive article will wear out too fast. High surface speed operation with super hard abrasive particles, including diamond and cubic boron nitride, is very desirable for abrading manufacturing processes because of the very high material removal rates experienced with these abrasives when used in a high surface speed abrading operation. It is not a simple process to separated the undesirable under-sized beads from larger sized beads and crush them to recover the expensive abrasive particle material for re-processing to form new correct-sized beads. In many instances, the too-small beads are simply coated with the correct-sized spherical agglomerate beads even though the small beads exist only as a cosmetic component of the abrasive coated article. It is preferred that equal-sized bead agglomerates have a nominal size of less than 45 microns when enclosing 10 micron, or smaller, abrasive particles that are distributed in a porous ceramic erodible matrix.

Another use for equal-sized non-abrasive spherical beads is for creating raised islands on a backing sheet by resin coating island areas and coating the wet resin with these beads to form equal height island structures that can be resin coated to form island top flat surfaces. Equal sized beads can also be used in many commercial, agricultural and medical applications.

Solution: A microporous screen endless belt or microporous screen sheet having woven wire rectangular openings can be used to form individual equal-sized volumes of an aqueous based ceramic slurry containing abrasive particles. The cell volumes are approximately equal to the volume of the desired spherical agglomerates or beads. Cells are filled with a slurry mixture and an impinging fluid is used to expel the cell slurry volumes into a gas or liquid environment. Surface tension forces acting on the suspended or free-travelling slurry lumps forms the liquid slurry volumes into individual spherical bead shapes that are solidified. Beads can then be collected, dried and fired to produce abrasive composite beads that are used to coat flexible sheet backing material. Box-like cell volumes that are formed by screen mesh openings have individual cell volumes equal to the average thickness of the woven wire screen times the cross-sectional area of the rectangular screen openings. Individual rectangular cell openings formed by the screen interwoven strands of wire have irregular side walls and bottom and top surfaces due to the changing curved paths of the woven screen-wire strands that are routed over and under perpendicular wires to form the screen mesh. These irregular rectangular cell openings can be made more continuous and smooth by immersing the screen in a epoxy, or other polymer material, to fully wet the screen body with the polymer, after which, the excess liquid polymer is blown off at each cell by a air nozzle directed at a angle to the screen surface. The polymer remaining at the woven wire defined rectangular mesh edges of each cell will tend to form a more continuous smooth surface shape to each cell due to surface tension forces acting on the polymer, prior to polymer solidification. Screens can also be coated with a molten metal that has excess metal residing within the rectangular cell shape interior that is partially removed by mechanical shock impact, or vibration, or air jet to make the cell wall openings more continuous and smooth. Also, screens can be coated with release agents including wax, mold release agents, silicone oils and a dispersion of petroleum jelly dissolved in a solvent, including Methyl ethyl keytone (MEK). Screen materials having precision small sized openings are those woven wire screens commonly used to sieve size-grade particles that are less than 0.002 inches (51 micrometers) in diameter. These screens can be used to form small sized abrasive agglomerates. Another open cell sheet material having better defined cell walls than a mesh screen is a uniform thickness metal sheet that has an array pattern of circular, or other shaped, perforation holes created through the sheet thickness by chemical etching, laser machining, electrical discharge machining (EDM), drilling or other means. The smooth surface of both sides of the perforated metal sheet cell-hole material allows improved hole slurry filling, slurry expelling and slurry clean-up characteristics as compared to a mesh screen cell-hole material. A endless screen or perforated belt can be made by joining two opposing ends of a very thin mesh screen, or of a perforated sheet, together to form an joint that is welded or adhesively bonded. Butt joint, angled butt joint, or lap joint belts can be constructed of the cell-hole perforated sheet material or sheet screen material. A belt butt joint that has inter-positioned serrated joint edges that are bonded together with an adhesive, solder, brazing material or welding material allows a strong and flat belt joint to be made. Butt joint bonding materials that level-fill up belt material cell holes may extend beyond the immediate borders of the two joined belt ends to strengthen the belt joint as these filled cell holes are not significant in number count compared to the remainder of open cell holes contained in the belt. The belt lap joint is practical as a 25 micron (0.001 inch) thick cell sheet material would only have a overlap joint thickness of approximately 50 microns (0.002 inches) and preferably would have a 0.5 to 1.5 inch (12.7 to 38 mm) long overlap section. This overlap section area can easily pass through a doctor blade or nip roll cell filling apparatus. Cell openings that reside at the starting and trailing edges of the joint may be smaller than the average cells but these undersized cells would be few in number compared to the large number of cells contained in the main body of the belt. Cell openings within the belt joint overlap area would typically be filled with adhesive. Extra small agglomerates produced by the few extra small cells located at the leading and trailing belt joint edges can simply be discarded with little economic impact. The endless belt can have a nominal width of from 0.25 to 40 inches (0.64 to 101.6 cm) and a belt length of from 2.5 to 250 inches (6.4 to 640 cm) or more. The belt can be mounted on two rollers and all or a portion of the rectangular or round cell openings in the belt can be filled with abrasive slurry. Belt cell holes would be filled level to the top and bottom surfaces of the belt by use of a nipped coating roll, or one or more doctor blades, or by other filling means. Two flexible angled doctor blades can be positioned directly above and below each other on both sides of the moving belt to mutually force the slurry material into the cell holes to provide cells that are slurry filled level with both surfaces of the belt. Another form of open cell hole sheet or screen that can be used to form spherical beads is a screen disk that has an annular band of open cell holes where the cell holes can be continuously level filled in the screen cell sheet with a oxide mixture solution, or other fluid mixture material, on a continuous basis by use of doctor blades mutually positioned and aligned on both the upper and lower surfaces of the rotating screen disk. The solution filled cell volumes can then be continuously ejected from the screen cells by an impinging fluid jet, after which, the cell holes are continuously refilled and emptied as the screen disk rotates. Inexpensive screen material may be thickness and mesh opening size selected to produce the desired ejected mixture solution sphere size. The screen disk can be clamped on the inner diameter and the inner diameter driven by a spindle. The screen disk may also be clamped on the outer diameter by a clamp ring that is supported in a large diameter bearing and the outer support ring rotationally driven by a motor which is also belt coupled to the inner diameter support clamp ring spindle shaft. A stationary mixture solution dual doctor blade device would level fill the screen cell openings with the mixture solution and a stationary blow-out head located at another disk tangential position would eject the mixture solution cell volume lumps from the disk screen by impinging a fluid jet on the screen. Multiple pairs of solution filler and ejector heads can be mounted on the disk screen apparatus to created the ejected solution lumps at different tangential locations on the disk screen. A disk screen apparatus can be constructed with many different design configurations including those that use hollow spindle shafts and support arms that clamp the outer screen diameter. Also, the screen cell holes located in the area of the support arms may be permanently filled to prevent filling of the cell holes with a liquid mixture solution in those areas to prevent ejected solution lumps from impacting the support arms. A cone shaped screen can also be constructed using similar techniques as those used for construction of the disk screens It is preferred that the individual abrasive or other material particles have a maximum size of 65% of the smallest cross-section area dimension of a cavity cell that is formed by the rectangular opening in the wire mesh screen, or perforated belt circular holes, to prevent individual particles from lodging in a belt cell opening. A fluid jetstream, including air or other gas or water or solvent or other liquids, or sprays consisting of liquids carried in a air or gas can be directed to impinge fluid on each slurry filled cell to expel the volume of slurry mixture from each individual cell into an environment of air, heated air or heated gas or into a dehydrating liquid. A liquid or air jet having pulsating or interrupted flows can also be used to dislodge and expel the volume of slurry contained in each belt cell hole from the belt. It is desired to expel the full volume of slurry contained in a cell opening out of the cell as a single volumetric slurry entity rather than as a number of individual slurry volumes consisting of a single large volume plus one or more smaller satellite slurry volumes. Creation of single expelled slurry lumps is more assured when each slurry lump residing in a cell sheet is subjected to the same dynamic fluid pressure slurry expelling force across the full cross-sectional area of each cell slurry surface. The fluid jet nozzles can have the form of a continuous fluid slit opening in a linear fluid die header or the linear fluid jet nozzle can be constructed from a single or multiple line of hypodermic needles joined at one open end in a fluid header. The linear nozzle would typically extend across the full width of the cell sheet or belt. A fluid nozzle can also have a single circular or non-circular jet hole and can be traversed across the full width of the cell sheet or cell belt. Slurry volumes would be expelled from the multiple cell openings that are exposed to a fluid jet line where the cell sheet or cell belt is either continuously advanced under the fluid jet or moved incrementally. A fluid jet head can also move in straight-line or in geometric patterns in downstream or cross-direction motions relative to a stationary or moving cell sheet or cell belt. Further, a linear-width jet stream can be directed into the gap formed between two closely spaced guard walls having exit edges positioned near the cell sheet surface. The guard walls focus the fluid stream into a very narrow gap opening where the fluid impinges only those cells exposed within the open exit slit area. Another technique is to use a single guard wall that concentrates and directs a high energy flux of fluid toward slurry filled cell holes as they arrive under the wall edge from an upstream belt location of a moving cell belt. Other mechanical devices can be used that expose a fixed bandwidth of slurry filled cells to the impinging fluid on a periodic basis where sections of a cell belt or screen are advanced incrementally after each bandwidth of slurry lumps are fluid expelled from the cell sheet during the previous fluid expelling event. Slurry lumps can also be expelled from cells holes by mechanical means instead of impinging fluids by techniques including the use of vibration or impact shock inputs to a filled cell sheet. Pressurized air can be applied to the top surface or vacuum can be applied to the bottom surface of sections of slurry filled cell sheets or belts to expel or aid in expelling the slurry lumps from the cell openings.

A cell belt may be immersed in a container filled with dehydrating liquid and the slurry cell volumes expelled directly into the liquid. Providing a dry porous belt that does not directly contact a dehydrating liquid reduces the possibility of build-up of dehydrated liquid solidified agglomerate slurry material on the belt surface as a submerged belt travels in the dehydrating liquid. The expelled free-falling lump agglomerates can individually travel some distance through air or other gas onto the open surface of a dehydrating liquid where they would become mixed with the liquid that is still or agitated. The agitated dehydrating liquid can be stirred with a mixing blade to assure that the slurry agglomerates remain separated and remain in suspension during solidification of the beads. The use of dehydrating liquids is well known and includes partially water-miscible alcohols or 2-ethyl-1-hexanol or other alcohols or mixtures thereof or heated mineral oil, heated silicone oil or heated peanut oil. In the embodiment where one end of the open-cell belt is submerged in a container of dehydrating liquid provides that the slurry lumps are expelled directly into the liquid without first contacting air after being expelled from the belt. The expelled free-falling agglomerates can also be directed to enter a heated air, or other gas, oven environment. A row of jets can be used across the width of a porous belt to assure that all of the slurry filled belt cell openings are emptied as the belt is driven past the fluid jet bar. The moving belt would typically travel past a stationary fluid jet to continuously expel slurry from the porous belt cell openings. Also, the belt would be continuously refilled with slurry as the belt travels past a nip-roll or doctor blade slurry filling station. Use of a moving belt where cells are continuously filled with slurry that is continuously expelled provides a process where production of spherical beads can be a continuous process. Surface tension forces, or other forces, acting on the individual ejected free-travelling or suspended slurry lumps causes them to form spherical agglomerate beads. In aqueous ceramic slurry mixtures, water is removed first from the exterior surface of the beads that causes the beads to become solidified sufficiently that they do not adhere to each other when collected for further processing. Agglomerate beads are solidified into green state spherical shapes when the water component of the water-based slurry agglomerate is drawn out at the agglomerate surface by the dehydrating liquid or by the heated air. Instead of using a slurry mixture in the open cell sheets, molten thermoplastic-type or other molten cell filling materials may be maintained in a liquid form within the sheet or belt cell openings with a high temperature environment until they are fluid spray jet ejected into a cooling fluid median to form sphere shaped beads. A flat planar section of open-cell mesh screen material or of perforated-hole sheet material can also be used in place of an open cell sheet belt to form slurry or other material beads.

Dehydrated green composite agglomerate abrasive beads generally comprises a metal oxide or metal oxide precursor, volatile solvent, e.g., water, alcohol, or other fugitives and about 40 to 80 weight percent equivalent solids, including both matrix and abrasive, and the composites are dry in the sense that they do not stick to one another and will retain their shape. The green granules are filtered out, dried and fired at high temperatures to remove the balance of water, organic material or other fugitives. The temperatures are sufficiently high to calcine the agglomerate body matrix material to a firm, continuous, microporous state (the matrix material is sintered), but insufficiently high to cause vitrification or fusion of the agglomerate interior into a continuous glassy state. Glassy exterior shells can also be produced by a vitrification process on oxide agglomerates, including abrasive agglomerates, where the hard glassy shell is very thin relative to the diameter of the agglomerate by controlling the ambient temperature, the dwell time the agglomerate is exposed to the high temperature and also by controlling the speed that the agglomerate moves in the high temperature environment. Using similar techniques glassy shells can be produced by the oxide vitrification process to produce glassy shells on hollow agglomerates. The sintering temperature of the whole spherical composite bead body is limited as certain abrasive granules including diamonds and cubic boron nitride are temperature unstable at high temperatures. Solidified green-state composite agglomerate beads can be fired at high temperatures over long periods of time with slowly rising temperature to heat the full interior of an agglomerate at a sufficiently high temperature to calcine the whole agglomerate body. Solidified agglomerates that are produced in a heated air or gas environment, without the use of a dehydrating liquid, can also be collected and fired. A retort furnace can be used to provide a controlled gas environment and a controlled temperature profile during the agglomerate bead heating process. An air, oxygen or other oxidizing atmosphere may be used at temperatures up to 600 degrees C. but an inert gas atmosphere may be preferred for firing at temperatures higher than 600 degrees C. Dry and solidified agglomerates having free and bound water driven off by oven heating can also be further heated very rapidly by propelling them through an agglomerate non-contacting heating oven or kiln. The fast response high temperature agglomerate bead surface heating can produce a hard shell envelope on the agglomerate surface upon cooling. The thin-walled hardened agglomerate envelope shell can provide additional structural support to the soft microporous ceramic matrix that surrounds and supports the individual hard abrasive particles that are contained within the spherical agglomerate shape. The spherical agglomerate heating can be accomplished with sufficient process speed that the interior bulk of the agglomerate remains at a temperature low enough that over-heating and structurally degrading enclosed thermally sensitive abrasive particles including diamond particles is greatly diminished. Thermal damage to temperature sensitive abrasive particles located internally within the spherical agglomerates during the high temperature process is minimized by a artifact of the high temperature convective heat transfer process wherein very small spherical beads have very high heat transfer convection coefficients resulting in the fast heating of the agglomerate surface. Agglomerates can be introduced into a heated ambient gas environment for a short period of time to convectively raise the temperature of the exterior surface layer while there is not sufficient time for significant amounts of heat to be thermally conducted deep into the spherical agglomerate interior bulk volume where most of the diamond abrasive particles are located. The diamond particles encapsulated in the interior of the agglomerate are protected from thermal damage by the heat insulating quality of the agglomerate porous ceramic matrix surrounding the abrasive particles. Special ceramics or other materials may be added to the bead slurry mixture to promote relatively low temperature formation of fused glass-like agglomerate bead shell surfaces.

Equal sized abrasive beads formed by open cell sheet material can be attached to flat surfaced or raised island metal sheets by electroplating or brazing them directly to the flat sheet surface or to the surfaces of the raised islands. Brazing alloys include zinc-aluminum alloys having liquidus temperatures ranging from 373 to 478 degrees C. Corrosion preventing polymer coatings or electroplated metals or vapor deposition metals or other materials may be applied to the abrasive articles after the beads are brazed to the article surface. These beads can be individually surface coated with organic, inorganic and metal materials and mixtures thereof prior to the electroplating or brazing operation to promote enhanced bonding of the beads to the electroplating metal or the brazing alloy metal. Bead surface deposition metals can be applied to beads by various techniques including vapor deposition. Metal backing sheet annular band abrasive articles having resin coated, electroplated or brazed abrasive particles or abrasive agglomerates bonded to raised flat-surfaced islands are preferred to have metal backing sheets that are greater than 0.001 inch (25.4 microns) and more preferred to be greater than 0.003 inches (76.2 microns) thickness in the backing sheet areas located in the valleys positioned between the adjacent raised islands.

It is desired to use a color code to identify the nominal size of the abrasive particles encapsulated in the abrasive equal sized beads that are coated on an abrasive sheet article. This can be accomplished by adding a coloring agent to the water based ceramic slurry mixture prior to forming the composite agglomerate bead. Coloring agents can also be added to non-abrasive component slurry mixtures that are used to form the many different types of spherical beads that are created by mesh screen or perforated hole sheet slurry cells to develop characteristic identifying colors for the resultant beads. Coloring agents used in slurry mixtures to produce agglomerate sphere identifying colors are well known in the industry. These colored beads may be abrasive beads or non-abrasive beads. The formed spherical composite beads can then have a specific color that is related to the specific encapsulated particle size where the size can be readily identified after the coated abrasive article is manufactured. The stiff and strong spherical form of an agglomerate bead provides a geometric shape that can be resin wetted over a significant lower portion of the bead body when bonding the bead to a backing surface. The wet resin forms a meniscus shape around the lower bead body that allows good structural support of the agglomerate bead body. Resin surrounding the bottom portion of a bead reinforces the bead body in a way that prevents total bead body fracture when a bead is subjected to impact forces on the upper elevation region of the bead. This resin also provides a strong bonding attachment of the agglomerate bead to a backing sheet or to an island top surface after the resin solidifies. It is desired that very little, if any, of the resin extend upward beyond the bottom one third or bottom half of the bead. A strong resin bond allows the top portion of the bead to be impacted during abrading action without breaking the whole bead loose from the backing or the island surfaces.

Composite ceramic agglomerate abrasive beads may have a nominal size of 45 or less microns enclosing from less than 0.1 micron to 10 micron or somewhat larger abrasive particles that are distributed in a porous ceramic erodible matrix. Composite beads that encapsulate 0.5 micron up to 25 micron diamond particle grains and other abrasive material particles in a spherical shaped erodible metal oxide bead can range in size of from 10 to 300 microns and more. Composite spherical beads are at least twice the size of the encapsulated abrasive particles. A 45-micron or less sized bead is the most preferred size for an abrasive article used for lapping. Abrasive composite beads contain individual abrasive particles that range from 6 to 65% by volume. Bead compositions having more than 65% abrasive particles generally are considered to have insufficient matrix material to form strong acceptable abrasive composite beads. Abrasive composite agglomerate beads containing less than 6% abrasive particles are considered to have insufficient abrasive particles for good abrading performance. Abrasive composite beads containing from 15 to 50% by volume of abrasive particles are preferred. Hard abrasive particles including diamond, cubic boron nitride and others are distributed uniformly throughout a matrix of softer microporous metal or non-metal oxides (e.g., silica, alumina, titania, zirconia, zirconia-silica, magnesia, alumina-silica, alumina and boria, or boria) or mixtures thereof including alumina-boria-silica or others.

Spherical agglomerate beads produced by use of screens or perforated sheets can be bonded to the surface of a variety of abrasive articles by attaching the beads by resin binders to backing materials, and by attaching the beads by electroplating or brazing them to the surface of a metal backing material. Individual abrasive article disks and rectangular sheets can have open cell beads attached to their backing surfaces on a batch manufacturing basis. Screen or perforated sheet beads can also be directly coated onto the flat surface of a continuous web backing material that can be converted to different abrasive article shapes including disks or rectangular shapes. These beads can be bonded directly on the surface of backing material or the agglomerates can be bonded to the surfaces of raised island structures attached to a backing sheet, or the agglomerates can be bonded to both the raised island surfaces and also to the valley surfaces that exist between the raised islands. Disks may be coated continuously across their full surface with cell sheet beads or the disks may have an annular band of abrasive beads or the disks can have an annular band of beads with an outer annular band free of abrasive. The cell sheet beads may be mixed in a resin slurry and applied to flat or raised island backing sheets or the backing sheets can be coated with a resin and the beads applied to the wet resin surface by various techniques including particle drop-coating or electrostatic particle coating techniques. Agglomerate beads may range in size from 10 microns to 200 microns but the most preferred size would range from 20 to 60 microns. Abrasive particles contained within the agglomerate beads include any of the abrasive materials in use in the abrasive industry including diamond, cubic boron nitride, aluminum oxide and others. Abrasive particles encapsulated in cell sheet beads can range in size from less than 0.1 micron to 100 microns. A preferred size of the near equal sized abrasive agglomerates for purposes of lapping is 45 micrometers but this size can range from 15 to 100 micrometers or more. The preferred standard deviation in the range of sizes of the agglomerates coated on an abrasive article is preferred to be less than 100% of the average size of the agglomerate, or abrasive bead, and is more preferred to be less than 50% and even more preferred to be less than 20% of the average size. Abrasive articles using screen abrasive agglomerate beads include flexible backing articles used for grinding and also for lapping. These cell sheet beads can also be bonded onto hubs to form cylindrical grinding wheels or annular flat surfaced cup-style grinding wheels. Mold release agents can be applied periodically to mesh screen, or perforated metal, sheet or belt materials to aid in expelling slurry agglomerates and to aid in clean up of the sheets or belts. Mesh screens and cell hole perforated sheets can be made of metal or polymer sheet materials. The mesh screens or metal perforated sheets can also be used to form abrasive agglomerates from materials other than those consisting of a aqueous ceramic slurry. These materials include abrasive particles mixed in water or solvent based polymer resins, thermoset and thermoplastic resins, soft metal materials, and other organic or inorganic materials, or combinations thereof. Abrasive slurry agglomerates can be deposited in a dehydrating liquid bath that has a continuous liquid stream flow where solidified agglomerates are separated from the liquid by centrifugal means, or filters, or other means and the cleaned dehydrated liquid can be returned upstream to process newly introduced non-solidified abrasive slurry agglomerates. Dehydrating liquid can also be used as a jet fluid to impinge on slurry filled cell holes to expel slurry volume lumps from the cell holes.

Near-equal sized spherical agglomerate beads produced by expelling a aqueous or solvent based slurry material from cell hole openings in a sheet or belt can be solid or porous or hollow and can be formed from many materials including ceramics. Hollow beads would be formulated with ceramic and other materials well known in the industry to form slurries that are used to fill mesh screen or perforated hole sheets from where the slurry volumes are ejected by a impinging fluid jet. These spherical beads formed in a heated gas environment or a dehydrating liquid would be collected and processed at high temperatures to form the hollow bead structures. The slurry mixture comprised of organic materials or inorganic materials or ceramic materials or metal oxides or non-metal oxides and a solvent including water or solvent or mixtures thereof is forced into the open cells of the sheet thereby filling each cell opening with slurry material level with both sides of the sheet surface. These beads can be formed into single-material or formed into multiple-material layer beads that can be coated with active or inactive organic materials. Cell sheet spherical beads can be coated with metals including catalytic coatings of platinum or other materials or the beads can be porous or the beads can enclose or absorb other liquid materials. Sheet open-cell formed beads can have a variety of the commercial uses including the medical, industrial and domestic applications that existing-technology spherical beads are presently used for. Commercially available spherical ceramic beads can be produced by a number of methods including immersing a ceramic mixture in a stirred dehydrating liquid or by pressure nozzle injecting a ceramic mixture into a spray dryer. The dehydrating liquid system and the spray dryer systems have the disadvantage of simultaneously producing beads of many different sizes during the bead manufacturing process. The technology of drying or solidifying agglomerates into solid spherical bead shapes in heated air is well established for beads that are produced by spray dryers. The technology of solidifying agglomerate beads in a dehydrating liquid is also well established. There are many uses for equal-sized spherical beads that can, in general, be substituted for variable-sized beads in most or all of the applications that variable-sized beads are presently used for. They can be used as filler in paints, plastics, polymers or other organic or inorganic materials. These beads would provide an improved uniformity of physical handling characteristics, including free-pouring and uniform mixing, of the beads themselves compared to a mixture of beads of various sizes. These equal sized beads can also improve the physical handling characteristics of the materials they are added to as a filler material. Porous versions of these beads can be used as a carrier for a variety of liquid materials including pharmaceutical or medical materials that can be dispensed over a controlled period of time as the carried material contained within the porous bead diffuses from the bead interior to the bead surface. Equal-sized beads can be coated with metals or inorganic compounds to provide special effects including acting as a catalyst or as a metal-bonding attachment agent. Hollow or solid equal-sized spherical beads can be used as light reflective beads that can be coated on the flat surface of a reflective sign article. As is well known in the industry organic or inorganic blowing agents are often used to form hollow beads. These blowing agents are mixed with the parent bead material and spherical beads are formed. Then the beads are subjected to temperatures that are high enough to form gaseous material from the blowing agent material whereby the gaseous material tends to form a hollow bead where the hollow interior portion of the bead comprises the gaseous material and the outer shell of the hollow bead is comprised of the bead parent material. After the hollow bead is formed, the hollow bead is subjected to heat or other energy sources to solidify the outer shell of the hollow bead.

Raised island structures can be quickly and economically constructed from large equal sized beads. Solid, porous, multi-material layer or hollow beads constructed of ceramics or polymers or other materials that have an equal size can be used to construct raised island surfaces on a flexible backing sheet. Equal-sized screen-cell produced spherical beads can be used for creating the raised islands on a backing sheet by resin coating island areas and depositing equal-sized beads on the wet resin areas to form equal height island structures. Beads of a sufficient size, uniformity of diameter, and made of many materials, including metals and manufactured by a variety of bead forming processes can be used to form raised island structures on a backing sheet or backing plate. The top cobblestone surface of these island groups of beads can be resin coated to form uniform height islands having flat surfaces. Resin applied to the top surface of the beads would be somewhat thicker in the areas above individual beads that have a slightly smaller diameter than the largest beads. This resin would tend to form a common resin bond to all of the beads and would also tend to extend a common resin bond with the resin that bonds the beads to the backing sheet. When beads having diameters equal to nominal height of the raised island structures of 300 microns, or more, or less, are applied in excess to the wet resin coated areas, only those beads that are in contact with the wet resin will become attached to the backing sheet. Beads deposited on the wet resin will tend to be positioned adjacent to each other and most beads will be in physical contact with one or more adjacent beads that results in a common planar raised island surface at the top of the resin attached beads located at each island area. Adjacent near-equal-sized spherical beads can be resin bonded to flexible backing sheets or rigid plates in island shaped patterns to provide the elevated raised island structures. Beads would be screened or classified to separate them into a narrow range of sizes with all beads above a certain size eliminated from a batch quantity. In general, beads would be manufactured with the goal of forming a narrow range of bead diameters for use with a specific abrasive article. However, it is preferred that beads present in a working batch used to construct raised islands do not exceed the nominal arithmetic mean bead size by more than 10 to 20%. Also, a new grouping of slightly smaller or larger beads can be grade-selected to form raised islands on a different abrasive article backing as the absolute nominal height of the islands is not as critical as is the uniformity of the height of all of the raised islands on a given abrasive article. Wet resin island shapes can be printed on the surface of a flexible backing sheet or a continuous web using a open-cell rubber stamp resin printing device, a RTV mold plate having an array of flat surfaced raised island, a screen printer or by other resin coating methods. The backing sheet may be an individual backing sheet or the backing sheet may be a continuous web sheet material. Printing plates can be used on a web printer device to apply island shaped deposits of resin to a continuous web. An excess of equal-sized or size-limited beads can be applied to the surface of the backing where only the beads contacting the wet resin become bonded to the backing and the non-wetted loose beads are collected for reuse. Island structures having a height equal to the bead diameter can be established for many different patterns of island array sites. Additional filled or non-filled resin material can be applied to the top surface of the attached beads to form a flat surface on the top of each island. In one embodiment, resin can be applied to the top surface of the beads, the backing sheet turned over and the wet resin laid in flat contact with a flat plate during the time of resin solidification to form a uniformly flat resin surface across each and all raised island surfaces. Another method to develop a flat and uniform height of resin coated bead island surfaces is to contact a release agent coated precision flatness glass sheet with the island top coated resin that will develop a continuous flat surface on the island tops as the resin is solidifying. Resin coated flat surfaced raised islands can be solidified and abrasive particles resin bonded to these island surfaces. The top surface of continuous web resin wetted bead island can be provided with a flatness leveling action by contacting the island surface resin with a stiff and flat release liner web stock sheet that remains in contact with the island backing sheet until the island top surface resin solidifies. Bead island structures can be formed in rectangular or annular band patterns on individual backing sheets or on continuous web backing sheet material. These island surfaces can be ground or machined to increase the accuracy of the thickness of the island backing if desired and then coated with abrasive particles. The bead bonding resin can be in the uncured state, or partially cured state or fully cured state, at different stages of forming the equal-height island structures. Resin that wicks around the surfaces of individual beads tend to form a structurally strong integral mass of beads and this resin provides a stiff and stable base for abrasive particles or abrasive agglomerates that are resin bonded to the island flat top surfaces. Raised island heights can range from 0.003 inches to 0.125 inches (0.076 to 3.2 mm) and extra height islands can be constructed of alternating sandwich layers of resin and beads. Abrasive particles or agglomerates can be applied to the wet resin used to level-off the top of the bead-formed island surfaces or the abrasive can be applied in a separate resin bonding step after the island structure has partially or fully solidified. In some cases, abrasive particles or abrasive beads mixed in a resin or deposited on a resin coating, can be nested in the cavities formed between the tops of the raised island foundation bead spheres that are used to form the raised island structures, without first forming a flat island surface with resin. After a flat island has been solidified, abrasive particles can be abrasive slurry resin coated on the islands or a resin can be applied to the solidified flat surface and abrasive particles or agglomerates drop coated or electrostatically coated or otherwise propelled by means including air jets onto the wet resin coated islands. A width proportioning annular abrasive particle or abrasive agglomerate dispensing or deposition device can be used to apply abrasive particles or agglomerates to the tops of bead-formed raised islands. Beads can be purchased commercially to form raised island structures but they tend to have a wide range of sizes that prevent establishing a flat bead surface in raised island shapes where they are coated on a backing sheet. Example of commercially available hollow glass or ceramic beads are 3M Scotchlite™ Glass Bubbles or 3M Zeeospheres™ Ceramic Microspheres available from the 3M Company (Minnesota Mining and Manufacturing Co.).

A process where rectangular arrays or annular band arrays of raised islands are attached to a continuous web backing by a continuous web coating machine can be quite simple, efficient and easy to use in the production of precise height raised islands from inexpensive materials. Web backing can be routed through a resin island shape printing process where array patterns of island shapes are continuously printed on the web backing surface. An excess of beads can be applied to the wet resin islands as the web continues to move through the coater machine. The web can be routed so that beads not attached to the island site wet resin falls away from the web and the resin can be solidified as the web moves with a variety of energy sources including oven heaters. Another coating station located downstream of the resin dryer oven can apply a resin layer to the tops of the adjacent beads located at each island site, on the same moving web. A second release liner web can be brought into contact with the resin wetted islands to provide a flat surface to the island-surfaced resin that will establish a flat raised island surface while the island bead top resin is solidifying. After resin solidification, the release liner would be separated from the web backing having the attached raised bead-structure islands. Abrasive particles can then be resin bonded to the tops of the raised islands. This whole process of producing rectangular or annular band abrasive coated raised island web backing can be accomplished with a single web coater machine with web backing entering the coater and abrasive coated raised island web leaving the machine. Abrasive articles can be cut out of the continuous web by a number of converting machine processes. If desired, the process can be completed in separate process steps where the web is rolled on a roll and stored or otherwise processed between abrasive article manufacturing process events.

FIG. 1 is a top view of an open mesh screen that has a rectangular array of rectangular open cells 4 that have cross-sectional areas 2 where the areas 2 are equal to the open cell 4 length 8 multiplied by the open cell 4 depth 6.

Figure 2:
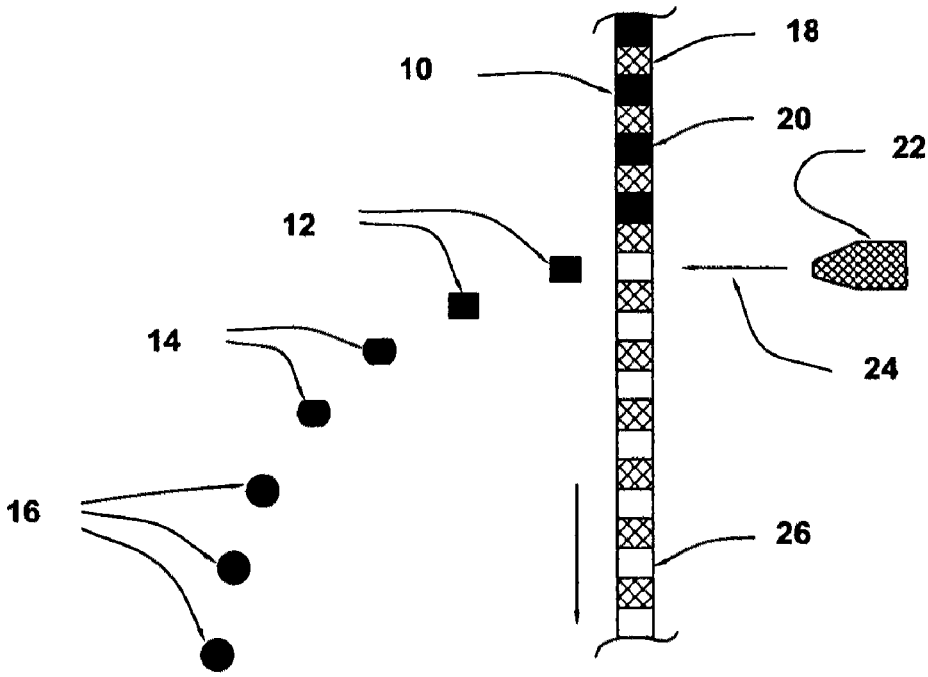
FIG. 2 is a cross-sectional view of an open mesh screen level-filled with an abrasive slurry.

FIG. 2 is a cross-sectional view of an open mesh screen that is level-filled with an abrasive slurry mixture. A open mesh screen or a perforated metal sheet 10 moves in a downward direction where the screen sheet 10 has abrasive slurry mixture filled cells 20 that are adjacent to screen cell walls 18. The screen 10 can be in continuous motion which would present slurry filled cells 20 to a fluid nozzle 22 that projects a fluid stream 24 against the filled cells 20 that causes lumps of slurry 12 to be ejected from the screen 10 body, thereby leaving a screen section 26 having empty screen cell holes. The slurry lumps 12 travel in a free-fall motion where surface tension forces acting on the liquid droplet lumps 12 form lumps having a more spherical shape 14 and the drop shape formation continues until spherical shaped 16 slurry droplets are formed before the slurry shape 16 sphere or slurry bead is solidified.

Figure 3:
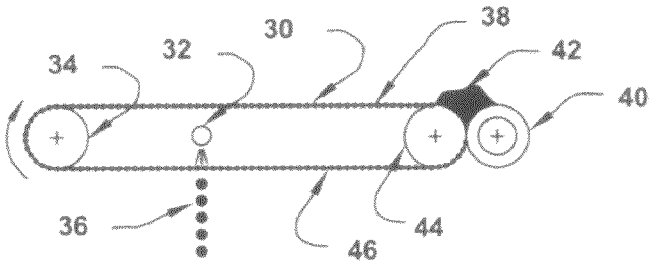
FIG. 3 is a cross-section view of a screen belt abrasive agglomerate forming system.

FIG. 3 is a cross-section view of a screen belt used to form liquid spherical agglomerates of an abrasive particle filled ceramic slurry that are ejected from the screen by pressurized air jets. A screen belt 30 having a multitude of through-holes is mounted on and driven by a drive roll 44 and is also mounted on an idler roll 34. Abrasive slurry 42 is introduced into the unfilled portion 38 of the screen belt 30 mesh opening holes by use of a stiff or compliant rubber covered nip roll 40 supplied with bulk abrasive slurry 42 to produce a section of slurry filled screen belt 46 that is transferred by the belt motion to a fluid-jet blow-out bar 32. High speed air exiting from the jet bar 32 ejects the abrasive slurry contained in each belt 30 mesh opening to create ejected agglomerates 36 that assume a spherical shape due to surface tension forces acting within the ejected agglomerates 36 as they travel in free space independently from each other in an oven or furnace heated air or gas environment (not shown) or dehydrating liquid that is adjacent to the belt. The spherical agglomerates 36 will each tend to have a similar volumetric size as the volume of each of the screen mesh openings are equal in size.

Figure 4:
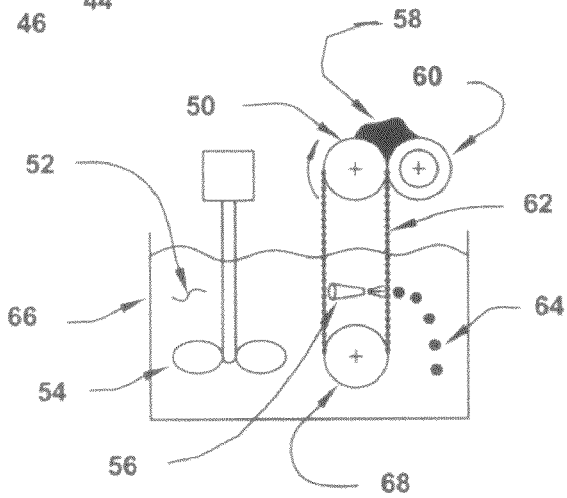
FIG. 4 is a cross-section view of an abrasive agglomerate screen belt in a solvent container.

FIG. 4 is a cross-section view of a solvent tank having an immersed abrasive slurry filled screen belt and fluid blowout jet bar. Abrasive slurry is provided as a slurry bank 58 contained in the top area common to a rubber covered driven nip roll 60 and a screen belt idler roll 50 mounted above a liquid container 66 where the slurry is forced into the screen belt pore holes by the slurry pressure action of the nipped roll 60. The screen belt 62 mounted on the idler rolls 50 and 68 transfers the slurry filled pores downward into a liquid solvent 52 filled container 66 past a fluid jet 56 that blow-ejects individual agglomerates in a trajectory away from the screen belt into the volume of solvent 52. The agglomerates 64 form into spherical shapes due to surface tension forces while in a free state in the solvent 52 fluid that has been selected to dry the spherical agglomerates 64 by drawing water from the agglomerates 64 as they are in suspension in the solvent 52. The spherical agglomerates 64 will each tend to have a similar size, as each of the screen openings is equal in size. A solvent stirrer 54 can be used to aid in suspension of the agglomerates 64 in the solvent 52.

Figure 5:
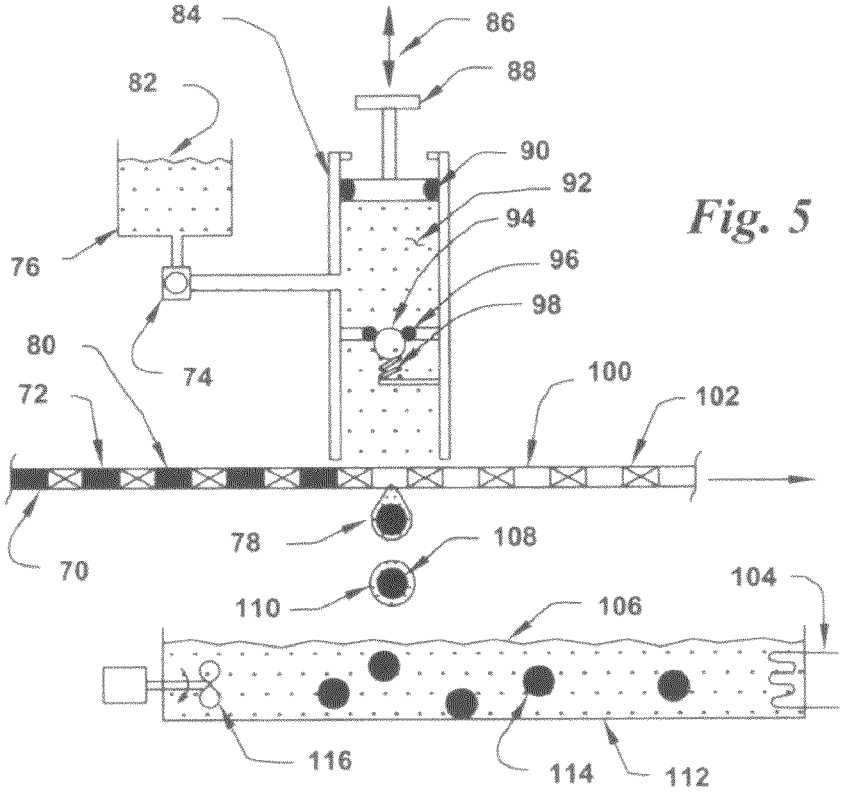
FIG. 5 is a cross-section view of a screen belt used to form oil ejected liquid spherical beads.

FIG. 5 is a cross-section view of a screen belt used to form liquid spherical agglomerates of an abrasive particle filled ceramic slurry that are ejected from the screen by pressure impulses of liquids comprising oils or alcohols. In one embodiment, the ejecting liquid can be a high viscosity room temperature oil where the ejected dispersion lumps having a very small amount of lump-surrounding oil are ejected into a large vat of dispersion lump dehydrating heated oil. The small amount of room temperature oil that is carried into the heated oil vat has little temperature effect on the heated oil. However, the high viscosity of the ejecting oil improves the capability of the ejecting oil to successfully eject whole lumps of the dispersion from the sheet cells without breaking up the ejected lumps into smaller lump entities. Also, the ejecting oil acts as a mold release agent that coats the belt cell molds and tends to repel the water based abrasive dispersion that is introduced into the sheet or belt mold cells to improve the release of the dispersion lump entities from the mold cells. In another embodiment, the ejecting liquid and the collection vat liquid can be an dehydrating alcohol.

A screen belt 70 having a multitude of through-holes cells 100 and non-open cell belt portions 102 is moved incrementally or constantly in close proximity to a liquid ejector device 84. A water based suspended oxide and abrasive particle slurry dispersion mixture 72 is introduced into the unfilled cells 100 of the screen belt 70 to produce dispersion filled cells 80 that progressively advance to the center exit opening of the ejector device 84. The cylindrical ejector device 84 has a plunger 88 that has an o-ring seal 90 that acts against the cylindrical wall of the ejector device 84. An impact solenoid or other force device (not shown) induces an impact motion 86 that is applied to the plunger 88. When the plunger 88 is driven downward as shown by 86 the liquid ejecting oil 92 is pressurized and a check valve ball 94 is driven away from a ball o-ring seal 96 where the ball 94 is nominally held by a compression spring 98 that compresses when the plunger 88 is advanced downward. Upon completion of the downward plunger 88 stroke, a pump 74 pumps more oil 82 into the ejector device 84 from the oil reservoir tank 76 that is filled with oil 82 and returns the plunger 88 to the original pre-activation position. On the downward plunger 88 stroke, oil 92 contained in the ejector device 84 ejects the dispersion lump 78 from the dispersion filled cell 80 along with a lump 78 coating of ejected oil 92. Surface tension forces act on both the oil 110 coating and the dispersion lump 78 to form an oil 110 coated spherical bead 108 as the bead 108 falls by gravity into a tank 112 that is filled with heated oil 106 that is heated by a heating element 104. The heated oil 106 is stirred by a driven stirrer device 116 and the dispersion beads 114 are heated by the hot oil 106 which results in water being removed from the beads 114 which results in the beads 114 becoming solidified. The solidified beads 114 are then collected, dried and subjected to a high temperature furnace process to fully solidify the beads 114.

Figure 6:
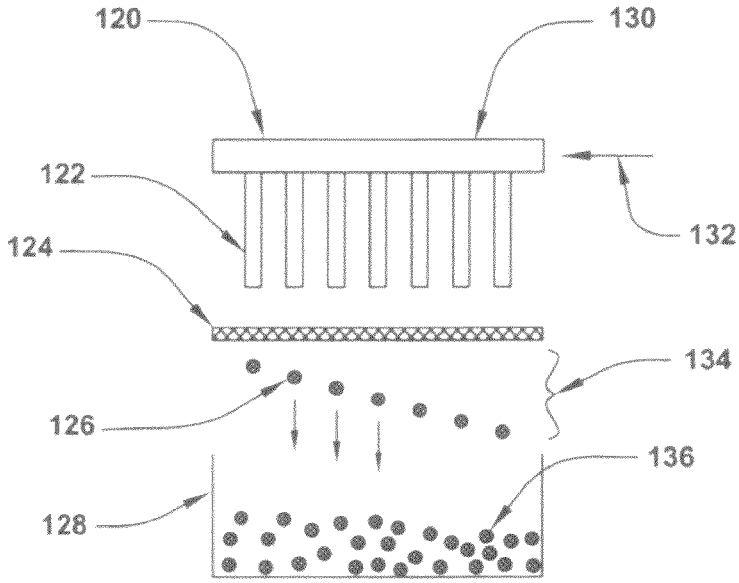
FIG. 6 is a cross-section view of an air-bar blow-jet system that ejects beads from a screen.

FIG. 6 is a cross-section view of an air-bar blow-jet system that ejects liquid precusor abrasive agglomerates from a screen into a heated atmosphere of air or different gasses. The cell screen belt 124 or cell screen segment 124 can be filled with a slurry mixture comprised of water based abrasive particles and ceramic material and individual wet agglomerates 126 can be blow-ejected by an air-bar 130 into a heated gas atmosphere 134 that will dry the agglomerates 126 that are collected as dry agglomerates 136 in a container 128. The free traveling individual agglomerates 126 form spherical shapes due to surface tension forces as they travel from the cell screen belt 124 or cell screen segment 124 to the bottom of the container 128. The air bar 130 can be constructed of a line of parallel hypodermic tubes 122 joined together at one end at an air manifold 120 that feeds high pressure air or other gas 132 into the entry end of each tube 122.

Figure 7:
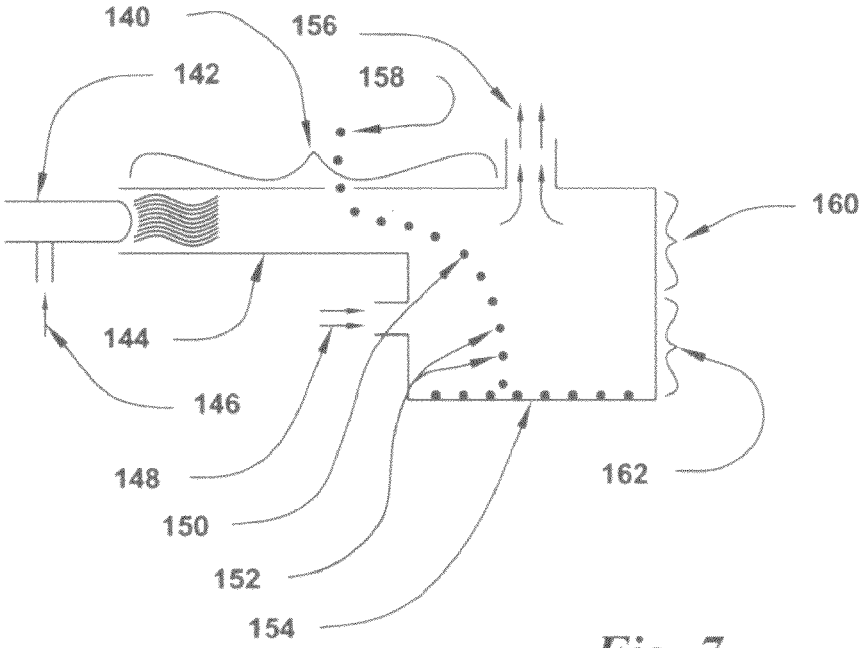
FIG. 7 is a cross-section view of a duct heater system that heats green state solidified beads.

FIG. 7 is a cross-section view of a duct heater system that heats green state solidified ceramic abrasive agglomerates introduced into the duct hot gas stream. A hydrocarbon combustible gas 146 is burned in a gas burner device 142 to produce a flow of temperature controlled gaseous combustion products inside a heat duct 144 that exit the container 154 as exhaust stream 156. The heater zone 160 has a mixture of hot and cold air and therefore has a moderate zone temperature. Green-state solidified agglomerates 158 are introduced into the duct 144 where the agglomerates are heated by the hot gaseous products as the agglomerates 158 are carried along the length of the duct high temperature zone 140 before falling into a low temperature zone 162. Cooling air introduced at the air inlet duct 148 into the agglomerate bead container 154 chills the surface of the hot agglomerates 150 that are collected as chilled agglomerate beads 152.

Screen Disk Production of Equal Sized Beads

Problem: It is desired to produce equal sized spherical beads of materials with the use of a mesh screen device that can produce the beads on a continuous production basis.

Solution: The materials formed into spherical beads include those materials that can be liquefied and then introduced into a flat disk shaped mesh screen having open cells to form equal sized cell-lumps. Mixing some solid materials with solvents can liquefy them and other solid materials can be heated to melt or liquefy them. These lumps are ejected from the screen to free-fall into an environment where the lumps form spherical shapes due to surface tension forces acting on the lumps. Dehydration of the water or solvent based spherical lumps solidifies the material into beads. Subjecting the melted ejected lumps to a cooling environment solidifies the melted material that that is ejected in lumps from the screen cells. The solidified lumps are sufficiently strong that they can hold their structural shapes when they are collected together for further drying or other heat treatment processes.

A disk screen can be formed from a mesh screen sheet that is cut into a circular disk shape where the cut screen disk is mounted on a machine shaft that is supported by bearings where the shaft and screen disk can be rotated. An annular band of open cells are present in the mesh screen flat surface area that extends from the outer periphery of the screen disk to an inner screen open-cell diameter. An inner radial portion of the screen disk cells can be filled with a solidified polymer or metal material to block the introduction of a slurry material into these filled cells. Likewise an outer periphery radial portion of the screen disk cells can be blocked with a polymer or metal. These filled, or blocked, screen cells will tend to structurally reinforce either or both the inner and outer radius areas of the cell disk. Here, the inner diameter of the annular band of open cells can be larger than the screen disk support shaft to form an annular band of open mesh screen cells. All of the screen cells would have equal cell cross-sectional open areas and the screen disk would have a uniform screen thickness.

Also, some other select portions of the open cell annular band can be filled with a polymer or metal material to structurally reinforce the screen disk to allow the disk to better resist torsional forces that are applied by the shaft to the thin screen disk. An open cell bead disk can also be constructed from a perforated sheet that has a uniform thickness and equal sized through-holes where each of the through-holes forms an open material or slurry material cell. In addition, when a woven wire mesh screen is used, a polymer or metal liquid filler material can be applied to the screen to fill in the corners of the woven wire screen cells. Excess filler material is removed from the woven screen prior to solidification of the filler material to provide cells that are open in the central cell areas but filled in at the woven wire cell corners. The removed filler material will tend to leave the mesh cell openings with continuous cell walls and provide that the wire-joint areas of the wires that bridge between the adjacent mesh cells are filled with the added filler material. Liquid slurry material can be more easily ejected from a woven wire screen cell when the mesh screen has been woven-wire-joint-treated with the wire-joint filler material. The mesh screen filler material can be a solvent based flexible filler material that is applied in a number of application steps to gradually fill up the mesh cell woven wire corners where the wires that form adjacent screen cells intersect due to the screen wire weaving process The open cells in the horizontal screen sheet disk can be level filled with a water, or solvent, based slurry mixture after which the material lumps contained in each cell can be ejected from the screen disk by impinging a jet or stream of a liquid against the surface of the screen. The lumps can be ejected into a dehydrating fluid that will remove the water or solvent from the lumps that fall freely in the dehydrating fluid while the liquid lumps are subjected to surface tension forces that form the lump into a spherical shape as they fall through the dehydrating fluid. After the lumps are formed into spheres, they are solidified enough that they can be collected together without adhering to each other. The screen disk can be constantly rotated in the process where the open screen cells are continuously filled or re-filled with the liquid material, and also, the material contained in the filled cells can continuously be ejected into the dehydrating environment. Here the screen disk cells are continuously filled with the slurry mixture to form equal volume sized slurry lumps within the confines of the equal sized mesh screen cells and the ejected cell material lumps are formed into equal volume spherical shaped beads.

The rotational speed of the disk screen can be optimized for the formation of slurry material beads. The rotational speed will depend on many process factors including: the diameter of the screen disk, the annular width of the screen cell disks, the viscosity of the slurry or material mixture, the size of the mesh screen cells, the type of apparatus used to level fill the screen cells with the slurry, the type of apparatus that is used to eject the slurry lumps and other factors. Mesh screen disks can also be used to produce non-spherical equal sized abrasive particles by solidifying increased-viscosity ejected slurry lumps before surface tension forces can produce spherical shapes from the ejected liquid lump shapes.

Different shaped areas of screen cells located in the annular band of open screen cells can be filled with a solidified structural polymer material where the shapes include "X" or other structural shapes. These structural polymer shapes can provide structural stiffening of the screen sheet in a planar direction to enable the screen sheet disk to resist torsional forces that are applied by a screen disk shaft to rotate the screen disk during the material lump formation process. The reinforcing polymer shapes that would extend across the annual band of open sheet cell holes would also be flush with the planar surface of the cell sheet. The flush-surfaced polymer shapes provide that the open cell holes that are in planar areas adjacent to the structural polymer reinforcement shapes can be level filled with liquid materials with the use of a wiper blade that contacts the surface of a rotating screen disk as the disk is continuously filled with the liquid material as the disk rotates.

The technique of producing equal sized spherical beads from a liquid material using a mesh screen or perforated sheet can be used to produce beads of many different materials that can be used in many different applications in addition to abrasive beads. Equal sized beads can be solid or hollow or have a configuration where one spherical shaped material is coated with another material. Bead materials include: ceramics, organics, inorganics, polymers, metals, pharmaceuticals, artificial bone material, human implant material, plant, animal or human food materials and other materials. The equal sized material beads produced here can have many sizes and can be used for many applications including but not limited to: abrasive particles; reflective coatings; filler bead materials; hollow beads; encapsulating beads; medical implants; artificial skin or cultured skin coatings; drug or pharmaceutical carrier devices; and protective coatings. It is only necessary to form a material into a liquid state, introduce it into the mesh screen cells where the cells are fully filled and eject it from the screen cells into an environment that will solidify the beads.

A material can be made into a liquid state by mixing it or dissolving it in water or other solvents. Also, a material can be melted, introduced into mesh screen cells using a screen material that has a higher melting temperature than the melted material after which the melted material is ejected from the screen cells. Surface tension forces acting on the ejected equal sized cell lumps form the lumps into spherical shapes during their free fall into a cold environment, which solidifies the spherical shaped material lumps. For example, molten copper metal can be processed to form spherical copper beads with a stainless steel screen as the stainless steel screen material has a higher melting temperature than the molten copper. When the molten copper lumps are ejected from the screen cells, they are first formed into spherical shapes and then are solidified as they travel in a free-fall in a cooling air environment.

Spherical material lumps having equal sizes, or non-spherical lump equal sizes, where the lumps can be formed by use of a mesh screen that has uniform volume sized cells where the ejected material lumps have individual volumes approximately equal in volumes to the screen cells contained volumes. The screen cell volumes are equal to the open cross-sectional screen-plane cell areas times the average thickness of the screen. A uniform thickness sheet material that is perforated with circular or non-circular through-holes where each independent hole has a hole cross-sectional area that is equal in area size can be used in place of a mesh screen to form equal volume size material beads. Spherical beads having diameters that range in size from less than 0.001 inch (25.4 micrometers) to more than 0.125 inches (3.18 mm) can be formed with screen sheets or perforated sheets using the process described here.

The screen disk equal sized material bead production system allows a portion of the disk to be operated within an enclosure and another portion of the disk to be operated external to the enclosure. Here, the external portion of the rotating disk can be continuously filled with a liquid material in an environment that is sealed off from the material lump ejection and solidification environments. The material filling environment can operate at room or cold or elevated temperatures and can be enclosed to prevent the loss of solvents to the atmosphere. The enclosed ejection environment may be a gaseous liquid or it may a liquid. The ejection environment can be held at an elevated temperature or the environment can be maintained at a cold temperature. Also, enclosure of the ejection environment prevents the escape of solvent fumes during the bead lump solidification process.

Figure 8:
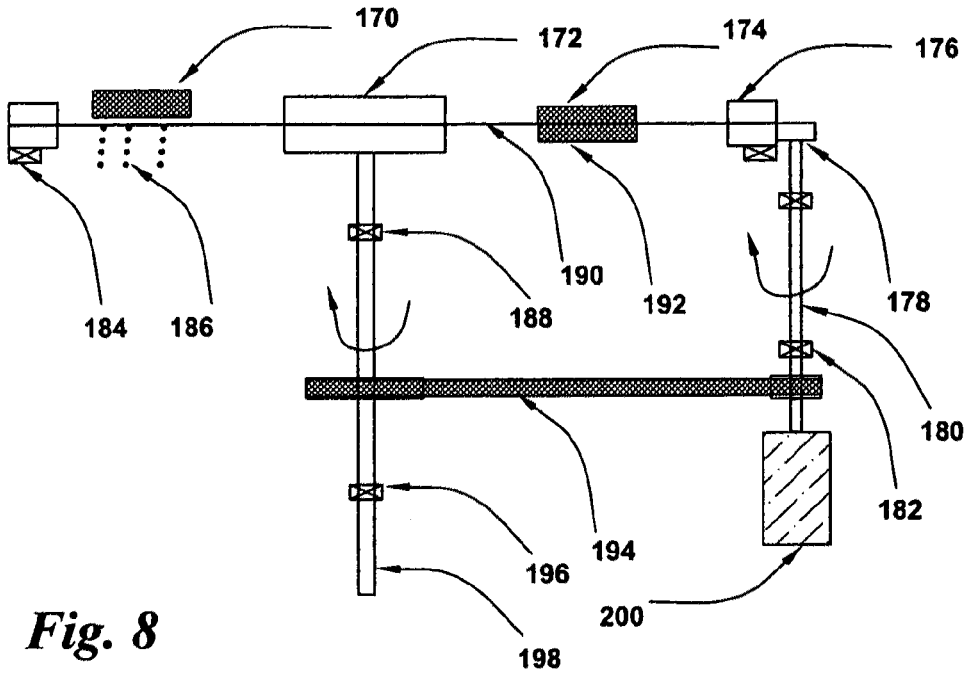
FIG. 8 is a cross-sectional view of a screen disk equal sized bead manufacturing system.

FIG. 8 is a cross-sectional view of a screen disk agglomerate manufacturing system. A screen disk 190 is clamped with a inner diameter clamp 172 that is mounted on a spindle shaft 198 that is supported by shaft bearings 188 and 196. The disk 190 is also supported by an outside-diameter ring clamp 176 that is supported by a ring bearing 184 and the clamp 176 is also rotated by a gear 178 that is mounted on a shaft 180 that is supported by shaft bearings 182. The shaft 180 is driven by a drive motor 200 and the shaft 180 is drive belt 194 coupled with belt pulleys to the disk spindle shaft 198 to allow the screen disk 190 to be rotated mutually by the drive motor 200 at both the inner and outer disk 190 diameters to overcome friction applied to the screen surface by the mixture solution application devices 174 and 192. The stationary upper mixture solution application device 174 introduces the solution mixture into the rotating screen disk screen cells and a doctor blade portion of the application device 174 levels the solution contained in the screen cells to be even with the top surface of the screen 190. The stationary lower doctor blade device 192 is aligned axially with the upper doctor blade device 174 to allow the lower device 192 to level the solution mixture contained within the moving cells to be even with the lower surface of the screen resulting in screen cells that are completely filled with a mixture solution level with both the upper and lower surfaces of the screen disk. The filled cells rotationally advance to a blow-out or ejector head 170 where the mixture solution fluid is ejected from the screen cells by a jet of fluid from the ejector head 170 to form lumps 186 of mixture solution material where each lump has a volume approximately equal to the volume of the individual screen cells.

Figure 9:
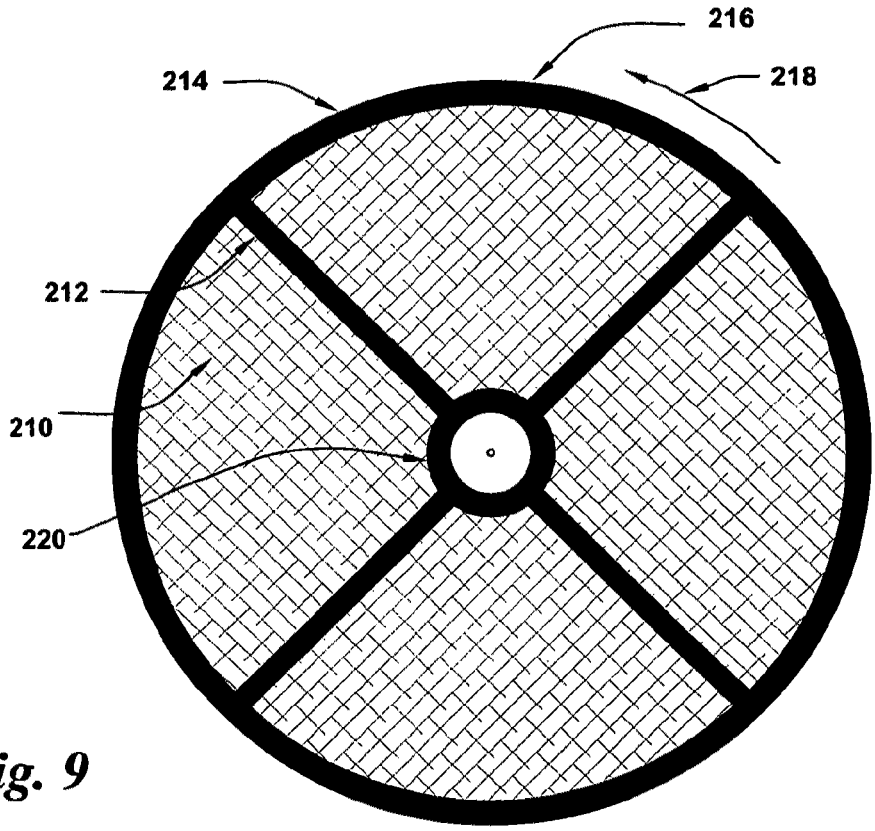
FIG. 9 is a top view of an open cell screen disk used to make equal sized beads.

FIG. 9 is a top view of an open cell screen disk used to make equal sized beads. The screen disk 214 has four central annular band segments 210 having open cell holes and has a outer periphery band 216 and an inner radius band 220 that have filled non-open cell holes. The screen disk 214 would rotate in a direction 218. Also, portions of the central annular band of open cell holes have four radial bars 212 that have filled cell holes where the bars 212 provide structural reinforcement of the open cell hole central band area primarily to resist torsional forces that are applied to the screen 214 at the inner band 220 by a rotating shaft (not shown). The cell hole filler material can include polymers or metal materials where the hole filler material is flush with the two surface planes of the screen disk 214 and the band segments 210. Open mesh woven wire screen materials used to fabricate the screen disk 214 are nominally weak or flexible in both in-plane directions and out-of-plane directions. Filling some of the open cell holes with a structural polymer or a metal filler material can reduce the disk 214 flexibility. Screen 214 patterns of structural material filled holes can have a variety of bar patterns, such as the shown bars 212, that provide structural beam members that lie within the plane surface s of the disk. The screen disk 214 is shown with structural beam element bars 212 that are radial but other beam bars can intersect with each other and act as spokes to structurally join both the inner annular band 220 and the outer annular band 216. In addition to using a open mesh screen to construct a open-cell disk, a open cell disk can be constructed from sheet metal that is perforated with equal sized through holes. An open cell disk 214 can also be fabricated by electro-depositing metal to form an equal thickness disk that has patterns of equal sized open cell through holes. Both the perforated sheet metal and electrodeposited open celled disks have good torsional rigidity and structural strength so it would not be necessary to fill bar patterns 212 of holes in theses disks to provide torsional structural rigidity. Open cell bead disks can have open cell annular outside diameters that range in size from less than 4 inches (10.2 cm) to greater than 48 inches (122 cm) to provide large continuous quantities of equal sized beads from one bead making apparatus.

Spherical Ceramic Abrasive Agglomerates

Problem: It is desired to form spherical shaped composite agglomerates of a mixture of abrasive particles and an erodible ceramic material where each of the spheres has the same nominal size. Applying a single or mono layer of theses equal sized spheres to a coated abrasive article results in effective utilization of each spherical bead as workpiece abrading contact is made with each bead. The smaller beads coated with the larger beads in the coating of commercially available abrasive articles presently on the market are not utilized until the larger beads are ground down. A desired size of beads is from 10 to 300 micrometers in diameter.

Solution: Various methods to manufacture like-sized abrasive beads and also specific diameter, or volume, beads include the use of porous screens, perforated hole font belts, constricted slurry flow pipes with vibration enhancement and flow pipes with mechanical blade or air-jet periodic fluid droplet shearing action. Each of these systems can generate abrasive bead sphere volumes of a like size.

Abrasive beads having equal sizes can be manufactured with the use of the constricted slurry flow pipes where these constricted flow pipes have small precision sized inside diameters. Precision diameter hypodermic needle tubing can be used for these constricted slurry flow pipes. Liquid slurry is propelled by pumps or by high pressure from a slurry reservoir through the length of the tubes where the slurry exits the free end of the tubes as slurry droplets into a dehydrating fluid. Equal sized abrasive beads can be produced with the use of a single slurry flow tube that is excited by a vibration source. Also, multiple slurry tubes can be joined together as a tube assembly that is vibrated where liquid abrasive slurry bead droplets exit the ends of each independent slurry tube. The hypodermic tubing can have controlled lengths to provide equal velocity liquid abrasive slurry fluid flow through each independent equal length and equal inside diameter tube. The excitation vibration can be applied at right angles to the axis of the tubes or the vibration can be applied at angles other than right angles, relative to the tube axis, or the vibration excitation can be applied along the tube axis. In addition, the vibration excitation can be simultaneously applied in multiple directions on the tube or tube assembly. The amplitude and vibration frequency of the excitation vibration can be changed or optimized for each abrasive bead manufacturing process. Here, the vibration is controlled as a function of other process parameters including: the inside diameter of the tubes; the velocity of the slurry flow in the tubes; the rheological characteristics of the liquid abrasive slurry; and the desired size of the liquid abrasive slurry droplets.

Equal sized liquid abrasive slurry beads can also be produced with the use of commercially available woven wire mesh screen material having rectangular "cross-hatch" patterns of open cells. Screens that are in sheets or screens that are joined end-to-end to form continuous screen belts can be used to manufacture equal sized abrasive beads. Each individual open cell in the "cross-hatch" woven screen device has an equal sized cross-sectional rectangular area. Each open mesh cell also has a depth or cell thickness where the thickness is equal to the thickness of the mesh screen sheet material. The depth or thickness of the rectangular cell cavity is determined by the diameter of the woven mesh wire that is used and the type of wire weave that is used to fabricate the woven wire screen. The open cells of the mesh screen are used to mold-shape individual volumes of liquid abrasive slurry where the volume of the liquid slurry contained in each independent cell mold is equal in size. Each independent cell hole is uniformly filled with the liquid abrasive slurry by filling each of the open mesh cells to where both the top and the bottom surfaces of the slurry volumes contained in the individual cell holes of a horizontally positioned mesh screen are level with the top and bottom surfaces of the mesh screen sheet. The cell molds impart a rectangular block-like shape to the volumes of liquid slurry that are contained in the screen cells. After the open screen cells are filled with the liquid slurry mixture, the liquid slurry volumes contained in the screen cells are then individually expelled from the screen cells in block-like liquid slurry lumps into a slurry dehydrating fluid. Surface tension forces form the expelled slurry blocks into spherical slurry shapes as the slurry blocks are suspended in a dehydrating fluid. The dehydrating fluids solidify the slurry mixture spherical shapes into spherical beads that are dried and fired. The volumes of the individual liquid abrasive particle-and-ceramic material spheres are equal to the volumes contained within each the independent contiguous block-like slurry lumps that were ejected from the screen cells.

Another embodiment of manufacturing equal sized abrasive beads is to create a pattern of controlled volumetric through-hole slurry cells in a continuous belt by making the belt of an open mesh screen material where the belt thickness is the screen material thickness. Continuous belts, or cell hole sheets, can also be made from perforated sheet material or electro-deposited or etched sheet material. The side walls of the cell holes in the perforated sheets, electro-deposited sheets or the etched sheets are preferred to be circular in shape as compared to the rectangular shaped cell holes in the mesh screen sheets. Perforated sheets can also have rectangular, or other geometric shape, through holes if desired. For perforated sheet material, the ejected liquid slurry sphere volumes are also equal to the perforated cell hole volume. A ceramic abrasive sphere is again produced by filling the open cell hole in either the screen or belt with a slurry mixture of abrasive particles and water or solvent wetted ceramic material. A simple way to level-fill the screen or belt openings is to route the belt through a slurry bank captured between two nip rolls. The slurry volume contained in each slurry cavity is then ejected from the cavity by use of a air jet orifice or mechanical vibration or mechanical shock forces. Liquid slurry lumps that are ejected from these circular shaped cell holes tend to have flat-ended cylindrical block shapes instead of the rectangular brick-shaped slurry blocks that are ejected from the mesh screen sheets. Each ejected slurry volume will form a spherical droplet due to surface tension forces acting on the droplet as the drop free-falls or is suspended as it travels in the dehydrating fluid. If the dehydrating fluid is hot air, the liquid spherical slurry bead lumps tend to travel in a trajectory path as the hot air in the continuously heated atmosphere dries and solidifies the slurry lump droplet beads as they travel. When the beads are heated during the solidification process, the release of the water from the slurry droplets cool the hot air that is in the hot air containment vessel. Heat is continuously provided to the hot air in order to maintain this hot air environment at the desired bead processing temperature. The beads are collected, dried in an oven and then fired in a furnace to develop the full strength of the bead ceramic matrix material. The abrasive particles can constitute from 5 to 90% of the bead by volume. Abrasive bead sizes can range from 10 to 300 micrometers.

In the bead manufacturing techniques described here, mesh screens can be used to also create non-abrasive ceramic beads and non-abrasive non-ceramic beads having equal sizes. For abrasive beads, the slurry can be gelled before it is introduced into the screen cavity openings to increase the adhesion of the liquid slurry material to the screen body. However, it is required that the gelled lumps that are ejected from the screen cavities remain in a free flowing state sufficient that surface tension forces acting on the slurry lumps can successfully form the lumps into spherical shapes before solidification of the lumps.

When an open mesh screen is used to form equal sized liquid abrasive slurry mixture lumps, the mesh screen has rectangular shaped openings that all have the same precise opening size. As the screen has a uniform woven wire thickness and equal sized rectangular shaped openings, the volume of liquid slurry fluid that is contained within each level-filled screen cell opening is the same for all the screen cells. The cell volume is approximately equal to the cross sectional area of the rectangular cell opening times the thickness of the screen material. These precision cell sized mesh screen are typically used to precisely sort out particle materials by particle size. During a particle screening process, a batch of particles is placed on the screen surface and the screen allows only the small particle fraction of the batch to pass through the mesh screen openings. Each mesh screen cell opening has a precise cross sectional area that can be viewed in a direction that is perpendicular to the flat surface of the screen. The screen thickness can be viewed in a direction that is parallel to the flat surface of the screen. Each cell opening in the mesh screen forms a cell volume when considering that the cross sectional area of the rectangular cell opening has a cell depth that is equal to the localized average thickness of the mesh screen sheet material. For purposes of visualization only, the mesh screen cell volume consists of a rectangular brick shape that has six flat-sided surfaces. The cell volumes of all the screen mesh cells are equal in size. Each screen mesh cell is used as a cavity mold that is used to form equal sized lumps of liquid abrasive slurry material. The equal volume lumps are formed by level filling each of the open cell mold cavities with the slurry, after which, these equal volume liquid slurry lumps are ejected from the open cell mold cavities. The ejection of the lumps is caused by the imposition of external forces that quickly accelerate the lumps from the confines of the cell cavities. The near-instantaneous fast motion of each ejected liquid slurry lump breaks the adhering attraction of the slurry liquid lump with the cell walls. The ejection motion also breaks apart any portion of the slurry liquid lump that is mutually attached to a slurry lump that is contained in an adjacent mesh cell mold cavity.

The equivalent "walls" of a mesh screen cell are actually not flat planar wall surfaces. Instead the screen cell "walls" are irregular in shape when viewed along the thin edge of the screen. This is due to the fact that the cell "walls" are formed from interwoven strands of wire that are individually bent into curved paths as they intersect other perpendicular strands of wire. Each cell "wall" typically consists of a single strand of bent wire that extends in a generally diagonal direction across the width of the cell "wall". The typical diameter of the screen mesh wire is approximately the same size as the rectangular cross sectional gap openings in the mesh cells used here. This angled wire strand that forms the cell "wall" is a substantial portion of an equivalent flat-surface wall for a same-sized cell (that has the same rectangular opening and same cell thickness). When a liquid slurry mixture, of abrasive particles and a colloidal solution of silica particles in water, is introduced into these small screen cell cavities and level filled with the screen two flat surfaces, the cell contained-liquid slurry mixture assumes a stable state. Here, the contained liquid slurry lump tends to attach itself to the screen cell "wall" wire strands. Immediately after the screen cells are level filled with the slurry, the screen can be readily moved about and the slurry lumps remain stable within each screen cell. The bond between the slurry lumps and the wire mesh walls is so great that it is necessary to apply substantial external forces to the slurry lumps in order to dislodge and eject these screen lumps from their screen cells. Care is taken with the application of the slurry lump ejection forces that the slurry lumps remain substantially intact as a single lump during and after the ejection event rather than breaking the original cavity cell lumps into multiple smaller slurry lumps.

Bending of the individual strands of wire around other strands of wire at each intersection locks the wire strands together at their desired positions where they are precisely offset a controlled distance from other parallel wire strands. Offsetting parallel screen wire strands in two perpendicular directions forms the precision rectangular gap openings that the particles pass through when the particles are sorted by particle sizes. Bending of the wires about each other structurally stabilizes the shape of each mesh cell in order to maintain its cell opening size when the mesh screen is subjected to external forces.

Even though the "walls" each of the wire mesh screen cells do not have flat wall surfaces, the volume of the liquid slurry that is contained in each wire mesh screen opening cell is substantially equal to the volumes of slurry contained in the other screen cells. Each rectangular shaped screen cell acts as a mold cavity for the liquid abrasive slurry mixture that is introduced into each of the screen cells. Also, each rectangular cell cavity is level filled with the slurry mixture. Because the "walls" that form the rectangular shape of the screen cells are constructed of single curved strands of wire, there is a common mutual joined area of small portions of the liquid slurry volume lumps that are located in adjacent cells. These small joined areas of slurry material exist at the locations in a cell "wall" above and below the wire strands that form the cell "walls". When the slurry lumps are forcefully ejected from the mesh screen cells these portions of liquid slurry that are mutually joined together in the areas of the "wall" wire strands are sheared apart by the stationary wires as both of the slurry lumps are in motion. Cutting of the slurry lumps by the woven wires is somewhat analogous to using a strand of wire to cut a lump of cheese. Some of the slurry portion that was sheared apart by the mesh wires tend to break into small liquid lumps that form into undesirable small liquid slurry spheres. These undersized liquid spheres can be separated by various well known process techniques from the large mold formed slurry lumps. They can be collected for immediate recycling into another mesh screen slurry lump molding event with little or no economic loss.

The mesh screen slurry ejection action produces individual rectangular brick-shaped slurry lumps that are initially separated from adjacent lumps by the width of the screen wires. After leaving the body of the screen, surface tension forces acting on the independent free-space traveling liquid slurry lumps quickly form these irregular shaped lumps into liquid slurry spherical bead shapes. Because the spherical bead shapes are dimensionally smaller than the same-volume slurry distorted-brick shapes, the individual slurry beads are even more separated from adjacent slurry beads that are traveling in a dehydrating fluid.

If a more perfect cell shape is desired than that provided by a woven wire mesh screen, a cell cavity sheet can be formed from a perforated sheet where each of the cell openings has planar or flat-surfaced walls. A preferred cavity hole shape is a cylindrical hole as the cylinder provides a single flat surfaced wall that also has flat ends. This cylindrical shape is easy to level fill with liquid slurry and the hole-contained slurry lumps tend to remain together as a single-pieced lump when it is ejected from the perforated sheet. Here, the volume of the slurry mold cavity can be controlled by either changing the diameter of the hole or by changing the thickness of the perforated metal sheet. The thickness of the perforated sheet can be controlled to provide elongated cavity tubes to improve the stability of the liquid slurry within the tube slurry mold cell. Perforated sheets can be manufactured by punching holes in a sheet metal or in sheets of polymer material, or other sheet material. Sheets that have cavity holes in them can be manufactured by many other production techniques that are all referred to here as perforated sheets. Examples of theses perforated sheets include mechanical or laser drilled sheets, etched metal sheets and electroformed sheet material. In the descriptions of the processes used to form equal sized abrasive beads, and also non-abrasive beads, the bead mold cavity sheets are most often referred as screens but in each case a perforated sheet can also be used in place of the screen sheet, and vice versa. Mesh screen material is very inexpensive and is readily available which makes it economically attractive as compared to perforated sheets, However, the abrasive bead end-product that contains expensive diamond particles can easily make the use of the perforated sheets very attractive economically. Mold cavities having flat-sided walls can be much easier to use in the production of equal sized abrasive beads as compared to the use of open mesh screen material.

The bead droplet dehydration process described here starts with equal sized spherical abrasive slurry bead droplets. In precision-flatness abrading applications, the diameter of the individual abrasive beads that are coated on the surface of an abrasive article are more important than the volume of abrasive material that is contained within each abrasive bead. An abrasive article that is coated with individual abrasive beads that have precisely the same equal sizes will abrade a workpiece to a better flatness than will an abrasive article that is coated with abrasive beads have a wide range of bead sizes. The more precise that the equal sizes of the volumes of the liquid abrasive slurry droplets are the more equal sized are the diameters of the resultant abrasive beads. Any change in the volumes of the abrasive slurry that are contained in the liquid state droplets, that are initially formed in the bead manufacturing process, affect the sizes, or diameters, of the spherical beads that are formed from the liquid droplets. However, as the diameter of a spherical bead is a function of the cube root of the droplet volume, the diameter of a bead has little change with small changes in the droplet volumes. When droplets are formed by level filling the cell holes in mesh screens or a perforated sheets there is the possibility of some variation of the volumetric size of the droplets. These variations can be due to a variety of sources including dimensional tolerances of the individual cell hole sizes in the mesh screens or the perforated sheets that are used to form the equal sized droplets. Also, there can be variations in the level filling of each independent cell hole in the screens or perforated sheets with the liquid abrasive slurry material. The cell hole sizes can be controlled quite accurately and the processes used to successfully level-fill the cell holes with liquid slurry are well known in the web coating industry. As the mesh screen liquid slurry droplet volumes are substantially of equal size, the diameters of the abrasive beads produced from them are even more precisely equal because of the relationship where the volume of the spherical beads is proportional to the cube of the diameter. Abrasive beads described by Howard indicate a typical bead diameter size variation of from 7:1 to 10:1 for beads having an average bead size of 50 micrometers. These beads having a large 7 to 1 range in size would also have a huge 343 to 1 range in bead contained-volume. Beads that are molded with the use of screen sheets that have a bead volume size variation of 10% will only have a corresponding bead diameter variation of only 3.2%. Beads that have a bead volume size variation of 25% will only have a corresponding bead diameter variation of only 7.7%. Beads that have a bead volume size variation of 50% will only have a corresponding bead diameter variation of only 14.5%. Beads that are produced by the 10% volume variation, where some of the beads are 10% larger in volume than the average volume size and some of the beads are 10% smaller in volume than the average volume size, would produce beads that were only 3.2% larger and only 3.2% smaller in diameter than the average diameter of the beads. Here, if the average size of the beads were 50 micrometers, then the largest beads would only be 51.6 micrometers in size and the smallest beads would still be 48.4 micrometers in size (a 1.07 to 1 ratio). This is compared to 50 micrometer averaged sized beads produced by Howard that vary from 20 to 140 micrometers in diameter (a 7 to 1 ratio). The combination of accurately sized cell holes and good-procedure hole filling techniques will result in equal sized liquid abrasive slurry droplets.

Figure 10:
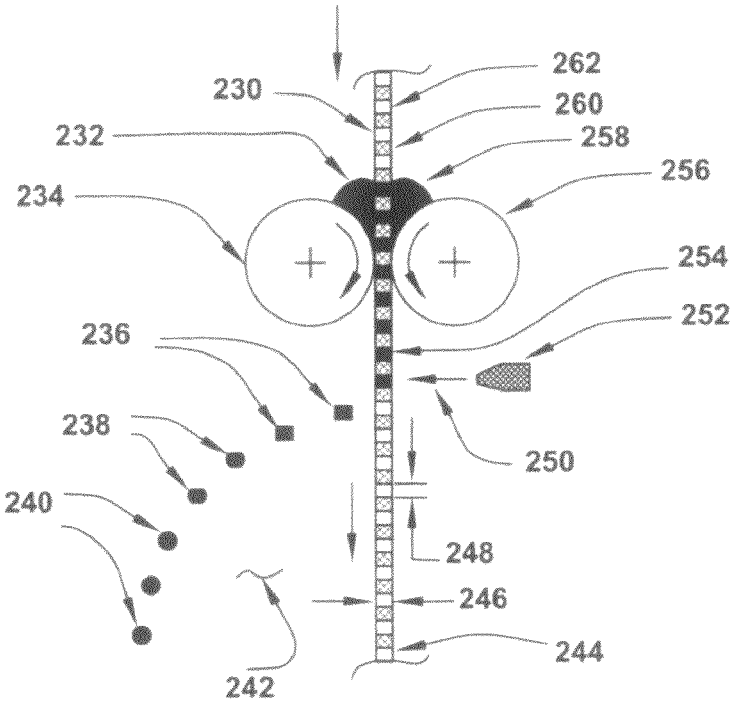
FIG. 10 is a cross-sectional view of a mesh screen bead roll type manufacturing system.

FIG. 10 is a cross-sectional view of a mesh screen abrasive agglomerate manufacturing system using a open mesh screen that is level-filled with an abrasive slurry mixture with nipped rolls. A open mesh screen or a perforated metal sheet 230 moves in a downward direction between two rotating nipped rolls 256 that force a abrasive slurry mixture 258 into the open screen cells 262 that are adjacent to screen cell walls 260. The cell walls 260 can be either a woven wire or other woven material or can be a perforated metal or other perforated material. The open cells 262 can have a circular shape or can be rectangular or can have a irregular or even discontinuous shape such as formed by a woven wire mesh. Each open cell shape will have a consistent average equivalent cross-sectional area that is shown, in part, by the cell opening dimension 248 as this drawing cross section view is two dimensional where the depth of the open cell 262 is not shown. The thickness of the screen 246 also is the thickness of the open cell 262. The open cell 262 contained volume is defined by the open cell 262 cross-section area which is comprised of the open cell 262 area (not shown) which is comprised of the cell length 248 and the cell depth (not shown) multiplied by the screen thickness 246. The small change in the overall cell 262 volume due to the non-perfect cell wall distortions created by the interleaving of the woven wires that form the cell wall 260 is not significant in determining the volumetric size of the ejected slurry volumes 236 that originate in the slurry filled cells 254 as the ejected volumes 236 would be consistent from cell-to-cell. Precision-sized perforation cell holes 262 that can be formed in sheet material typically would not have the same amount of hole wall 260 size or surface variation as would a woven wire screen mesh hole. The screen 230 can be in continuous motion which would present slurry filled cells 254 to a fluid nozzle 252 that projects a interrupted or pulsed or steady flow ejecting fluid stream 250 against the filled cells 254 that causes lumps of slurry 236 to be ejected from the screen 230 body, thereby leaving a screen section 244 having empty screen cell holes 262. The slurry lumps 236 travel in a free-fall motion into a dehydrating fluid 242 and surface tension forces acting on the liquid droplet lumps 236 form lumps having a more spherical shape 238 and the drop shape formation continues until spherical shaped 240 slurry droplets are formed before the slurry shape 240 sphere or slurry bead is solidified. The slurry bead forming and ejection process can take place when all or a portion of the apparatus is enveloped in a dehydrating fluid 242 including being submerged in a dehydrating liquid 242 or located within or adjacent to a hot air dehydrating fluid 242. A release liner sheet made of materials including polytetrafluoroethylene (PTFE), silicone rubber, silicone coated paper or polymer, waxed paper or other release liner material can be placed between the rolls 234 and 256 and the mesh screen 230 to prevent adhesion of the abrasive slurry mixture 258 to the roll 234 and roll 256 surfaces by placing the release liner on the surface of the rolls 234 and 256 before the rolls 234 and 256 surfaces contact the liquid dam of slurry mixture 258.

Figure 11:
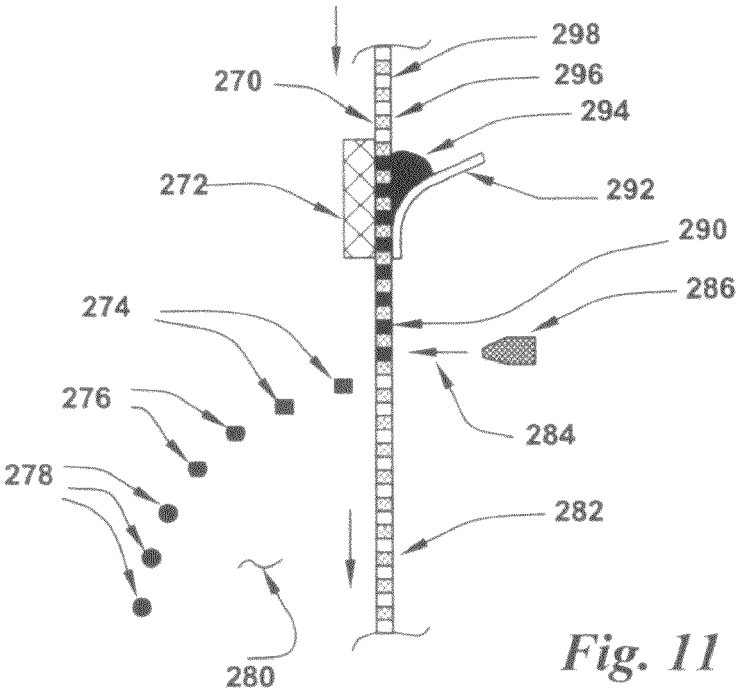
FIG. 11 is a cross-sectional view of a mesh screen bead wiper type manufacturing system.

FIG. 11 is a cross-sectional view of a mesh screen abrasive agglomerate manufacturing system using a open mesh screen that is level-filled with an abrasive slurry mixture with a doctor blade. A open mesh screen or a perforated metal sheet 270 moves in a downward direction between a doctor blade 292 and a support base 272 that force a abrasive slurry mixture 294 into the open screen cells 298 that are adjacent to screen cell walls 296. The cell walls 296 can be either a woven wire or other woven material or can be a perforated metal or other perforated material. The open cells 298 can have a circular shape or can be rectangular or can have a irregular or even discontinuous shape such as formed by a woven wire mesh. The screen 270 can be in continuous motion which would present slurry filled cells 290 to a fluid nozzle 286 that projects a interrupted or pulsed or steady flow fluid stream 284 against the filled cells 290 that causes lumps of slurry 274 to be ejected from the screen 270 body, thereby leaving a screen section 282 having empty screen cell holes. The slurry lumps 274 travel in a free-fall motion into a dehydrating fluid 280 and surface tension forces acting on the liquid droplet lumps 274 form lumps having a more spherical shape 276 and the drop shape formation continues until the spherical shaped 278 slurry droplets are formed before the slurry shape 278 spheres or slurry beads are solidified. The slurry bead forming and ejection process can take place when all or a portion of the apparatus is enveloped in a dehydrating fluid 280 including being submerged in a dehydrating liquid 280 is or located within or adjacent to a hot air dehydrating fluid.

Bead Screen Plunger

Problem: It is desired to create abrasive particle or other non-abrasive material spherical beads that have an equal size by applying a consistent controlled pressure fluid ejection on each liquid bead material cell resulting in uniform sized ejected beads.

When a liquid slurry mixture, of abrasive particles and a colloidal solution of silica particles in water, is introduced into these small screen cell cavities and level filled with the screen two flat surfaces, the cell contained-liquid slurry mixture assumes a stable state. Here, the contained liquid slurry lump tends to attach itself to the screen cell "wall" wire strands. Immediately after the screen cells are level filled with the slurry, the screen can be readily moved about and the slurry lumps remain stable within each screen cell. The bond between the slurry lumps and the wire mesh walls is so great that it is necessary to apply substantial external forces to the slurry lumps in order to dislodge and eject these screen lumps from their screen cells. Care is taken with the application of the slurry lump ejection forces that the slurry lumps remain substantially intact as a single lump during and after the ejection event rather than breaking the original cavity cell lumps into multiple smaller slurry lumps.

Solution: A mesh screen having a screen thickness and open cells where the volume of an open cell thickness and cross-sectional area is approximately equal to the desired volume of a material sphere can be filled with a liquid mixture of abrasive particles and a binder material, including a ceramic sol gel or a resin binder. Also, a liquid mixture of non-abrasive material may be used to fill the screen cells also to produce non-abrasive material beads. After the screen is surface level filled with the liquid bead material, the liquid in the cells can be ejected from the cells with the use of a plunger plate that has a flat plate surface that is substantially parallel to the flat surface of the cell screen. The plunger plate traps an ejection fluid between the plate and the screen surface as the plunger plate is rapidly advanced towards the surface of the cell screen from an initial position some distance away from the cell screen. The ejection fluid trapped between the plate and the screen can comprise air, other gases, or a liquid comprising water, oil based dehydrating liquid, dehydrating liquids, alcohols, or a solvent, or even molten metal or other molten materials, or mixtures thereof. As the plunger plate is rapidly advanced toward the screen surface, the layer of ejection fluid trapped between the plunger flat surface and the cell screen surface is accelerated toward the cell sheet surface whereby the ejection fluid impinges upon the individual liquid mixture volumes that are contained in the cell sheet cells. The impinging ejection fluid impacts the top surface of the individual liquid mixture volumes where the impacting force of the impinging ejection fluid drives the individual liquid mixture volumes as liquid mixture lump entities through the thickness of the cell screen whereby the liquid mixture lump entities are ejected from the bottom side of the cell sheet.

During the ejection process, the plunger plate is advanced an incremental distance toward the cell sheet that is sufficient to eject the liquid mixture lump entities from the cell screen but preferably where the plunger plate does not contact the cell screen. After the ejection process, the plunger is withdrawn to its home position some distance away from the cell screen. The advancing motion of the plunger is preferred to provide a impulse to the ejection fluid to provide the fluid impinging or impacting action of the cell sheet mixture volumes. Here, the plunger has a fast advance motion to eject the liquid lump entities and a slower return motion to replenish the fluid film between the plunger and the cell screen. A slow plunger return motion is preferred to avoid substantially disturbing the cell screen position by the return motion of the plunger that is loosely coupled to the screen by the remaining layer of ejection fluid. The composite advancing-and-withdrawing plunger motions can be optimized for ejecting the liquid mixture lump entities comprising step-functions, ramp withdrawing and sinusoidal motions or combinations thereof.

To provide restoration of the layer of ejection fluid between the plunger and the cell screen, single or multiple flapper, reed, poppet or check valves can be incorporated into the plunger device. These valve devices can allow transport of ejection fluid from the back side of the plunger to the plunger front side that faces the cell screen as the plunger is withdrawn. After the cell sheet is advanced in position to carry new screen cells filled with the liquid mixture under the plunger plate, the plunger plate is again rapidly advanced toward the cell sheet to eject the new liquid mixture lump entities from the cell sheet. A cell sheet continuous belt can be used to carry liquid mixture cells under the plunger plate that continuously repeats the incremental dynamic stroke ejection action.

The screen is rigidly supported at the outer periphery of the plate cross section area thereby leaving the central portion of the screen, corresponding to the plunger area, open for plunger action. This allows the individual screen cell material lumps to be ejected from each of the individual cells from the side of the screen opposite of the plunger plate. The fluid material lumps are ejected into a solidification environment comprising hot air or a dehydrating liquid or an environment having energy sources comprising light, ultraviolet light, microwave or electron beam.

An enclosure wall positioned on the outer periphery of the plunger plate is held in contact with the screen surface and acts as a fluid seal for the plunger and results in a uniform fluid pressure being applied to the material in each cell whereby the ejection force is the same on each cell material. Air is compressible so the fluid ejecting pressure will build up as the plunger advances until the cell material is ejected. A liquid fluid is incompressible and has more mass than air so the speed that the cell material is ejected is controlled by the plunger plate advancing speed and a uniform fluid pressure would tend to exist across the plunger-area even when a few cells become open in advance of other cells. The plunger plate can be circular or rectangular or have other shapes. Cell material may be ejected into either an air environment or ejected when the material is submerged in a liquid vat. In either case, surface tension on the ejected material lumps produces a spherical material shape to each ejected liquid mixture lump entity after the lump entities are ejected from the cell screen.

All of the ejected spherical shaped entities have a diameter the is less than the cross sectional dimensions of the cell areas because the flat-surfaced liquid lump entities are formed into spheres as compared to the planar brick-like or disk-like cell-sheet lumps that are contained within the cell sheet. In addition, each individual ejected liquid lump is separated from adjacent ejected lumps by the wires that form a cell mesh screen or by the screen walls that exist between individual cells in a perforated cell sheet. Taken together, these factors assure that the ejected individual liquid mixtures spheres remain separated during the lump material solidification process. Here, because adjacent liquid spheres do not contact each other prior to solidification, they do not join together to form undesirable larger diameter spheres or beads.

Figure 12:
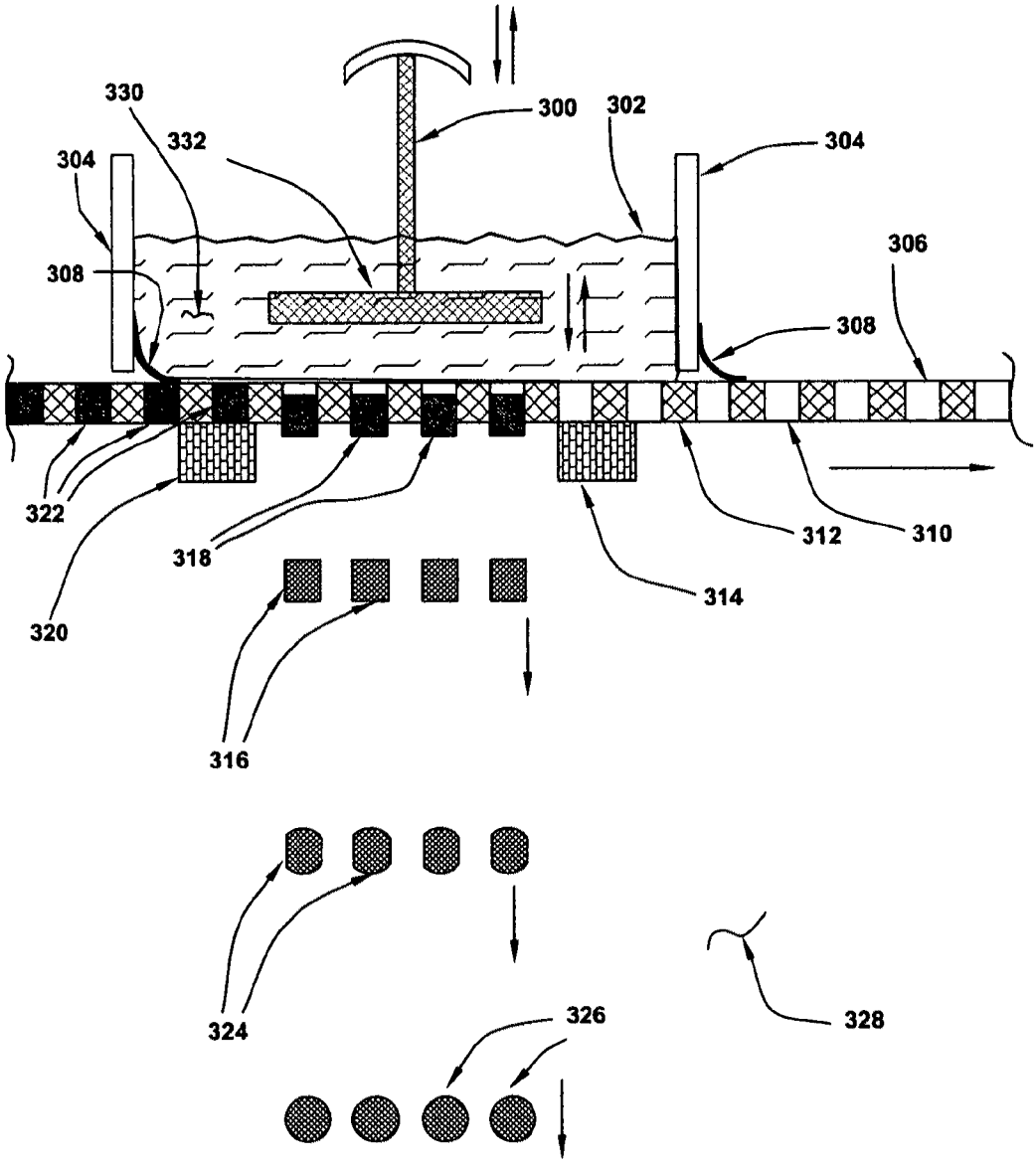
FIG. 12 is a cross-section view of a screen plunger used to form equal sized beads.

FIG. 12 is a cross-section view of a screen slurry lump plunger mechanism ejector that is used to form equal sized abrasive or non-abrasive spherical beads. A screen 306 moves along two screen support bars 320 and 314 where abrasive or non-abrasive slurry volume lumps 318 are ejected from the screen 306 having mesh screen wires 312 that divide screen openings 310 by driving a plunger 300 having a plunger plate 332 from a controlled distance above the screen 306 toward the screen 306 until the plunger plate 332 is in close proximity to the screen 306 surface. A wire mesh screen 306 is shown but a perforated sheet could also be used to form the same abrasive or non-abrasive spherical beads 326 in place of the wire mesh screen 306. Slurry volume lumps 318 are shown partially ejected from the screen 306. The lump ejecting fluid 330, located between the plunger plate 332 and the screen 306, is driven vertically down toward the horizontal screen 306 by the plunger plate 332 as some of this fluid 330 is trapped between the plunger plate 332 and the screen 306 surface as the plate 332 descends. The ejecting fluid 330 is shown here as a liquid but it can be either a liquid or it can be a gas, the gas comprising air. The liquid ejecting fluid 330, has a free-fluid liquid surface 302 and is contained by the shown fluid walls 304 and other walls not shown, where the shown walls 304 have flexible wiper fluid seals 308 that contact the screen 306 and prevent substantial loss of the fluid 330 from the wall 304 fluid container. The moving plunger plate 332 develops a fluid 330 dynamic pressure between the plunger plate 332 and the screen 306 and this dynamic fluid pressure drives the slurry lumps 318 from the screen 306 to form ejected liquid slurry lumps 316 that free-fall travel downward within a dehydrating fluid 328 environment. The dehydrating fluid 328 comprises hot air or a dehydrating liquid. As the liquid slurry lumps 316 travel in the dehydrating fluid 328, surface tension forces on the liquid lumps 316 initially forms them into semi-spherical lumps 324 that are further formed into spherical lumps 326. The screen support bars 320 and 314 provide structural support to the section of flexible screen 306 that extends across the width of the plunger plate 332 and which screen section is subjected to the fluid 330 dynamic pressure exerted by the moving plunger plate 332. The bar 320 also tends to shield or protect the other non-plunger-screen area remote-location slurry lumps 322 that are contained in screen mesh cells that are located upstream of the bar 320 within the moving screen 306 body from the plunger plate 332 induced fluid 330 dynamic pressure. The bar 320 shields the ejecting action of the sides of the moving plunger plate 332 by preventing this ejection fluid flow through the screen 306 in the protected screen 306 areas and tends to prevent these remote-location slurry lumps 322 located in the protected areas from being partially or wholly ejected from the screen 306. The plunger plate 332 movement is preferred to be limited to only that excursion which is required where the fluid 330 is driven downward to successfully eject the slurry lumps 318 from the screen 306. If the ejecting fluid 330 is a liquid, only a limited amount of the stationary liquid will tend to leak through the screen 306 into the dehydrating fluid 328 region as the typical screen openings 310 are small enough that the liquid will not freely pass through the screen 306 unless driven by the plunger 332. Here, a typical very fine 325 mesh screen can be used to produce very small sized liquid-state precursor abrasive or non-abrasive beads due to the fact that the mesh cell openings in the screen 306 are only 45 micrometers (0.002 inches). When a portion of the cell screen 306 is filled with slurry lumps 322 there tends to be substantially small amounts of ejection fluid 330 leaks through that portion of screen 306 because the slurry lumps 322 tend to seal the screen 306. The mesh sizes in the screens, or the through-hole sizes in a perforated font sheet, are selected to produced oversized liquid-state ejected abrasive slurry lumps that will form oversized liquid-state spherical beads to compensate for the bead shrinkage that takes place when the beads are dehydrated and are heat treated to form abrasive particle beads. If the fluid 330 is air or another gas, the volume of gas that passes through the screen 306 with each plunger plate 332 action is small compared to the typical volume of the dehydrating fluid 328, which can be either a liquid or gas, and will not disrupt the dehydrating action of the slurry dehydrating fluid 328 system. The ejecting downward motion speed of a plunger plate 332 can be slower with a liquid ejecting fluid 330 as compared with a gaseous ejecting fluid 330 because the viscosity and mass of the liquid is greater than that of a gas and the impinging liquid will more easily eject lumps 318 from the screen 306 than will a gaseous fluid 330. Screens 306 having larger mesh openings can also be used to produce larger sized slurry beads and ejecting fluid 330 leakage into the dehydrating fluid 328 can be minimized by the use of narrow plunger plates 332.

Screen Drum Spherical Bead Former

Problem: It is desirable to form spherical beads from various liquid materials with a continuous manufacturing process where all the beads are of equal size. Drops of liquid material are separated from each other after formation during which time surface tension forces form spherical drop beads prior to solidification of the beads by hot air or a dehydrating liquid bath.

Solution: A rotatable drum having one side partially open can have a drum circumference formed of silicone rubber coated mesh screen or a perforated metal strip. The drum can have a nonporous solid radial back plate to which plate is attached a bearing supported rotatable shaft. The drum front plate can be a solid nonporous solid material wall that has an annular shape that allows the continuous introduction of a stream of liquid material that can be formed into equal sized drops of liquid, the liquid material can include water based sol gels of oxides and abrasive particles may or may not be mixed with the sol gel. Drops of other materials including fertilizers, hollow sphere forming mixtures, chemicals, medicinal material and glass beads may be formed with the same process. After liquid material is introduced into the open end of the screen drum, the drum is rotated and a set of internal and external flexible wipers force the liquid into the open cells of the mesh screen circular drum band. The cell hole openings in the mesh screen or perforated metal are small enough and the viscosity of the liquid material is high enough that the pool of liquid, which remains on the bottom area of the drum as the drum is rotated, does not freely pass through the screen mesh openings. Wiper filled mesh holes pass upward out of the liquid pool until they arrive at a cell blow-out head that spans the longitudinal width of the screen where an air, gas, or liquid is applied under pressure uniformly across the contacting surface area of the blow-out head that is hydraulically sealed against the drum inner surface of the drum screen. The drum may be rotationally advanced or continuously rotated to present liquid filled screen cells to the blow-out head that ejects drops of liquid material into an environment of heated air or into a vat of dehydrating fluid. Surface tension forces on the drop will form a drop spherical shape prior to drop solidification. The spherical bead drop formed from the material contained in a individual screen cell will have approximately the same volume as the volume of the liquid trapped in a screen cell. The shape of the ejected fluid material lump is changed from an irregular lump shape to a spherical shape by surface tension forces acting within the material lump after the lump is ejected but before the lump is solidified. Once the spherical shape is formed, the sphere or bead shape becomes solidified and the shape retains its spherical shape throughout further sphere processing events. Air or liquid fluid can be fed in pressure or volume pulses or fed at a continuous rate to the sealed blow-out head that can be held stationary through the drum opening.

Non-Abrasive Beads

Problem: It is desired to produce equal sized non-abrasive material beads using open mesh screens or perforated sheets that have sheet cell volumes that are equal sized.

Solution: Sheets having open cells that have sheet cell volumes that are equal sized can be level-filled with liquid materials to form material volumes that are equal in volume size to the sheet cell volumes. Then the liquid material cell volumes can be ejected from the cells by a variety of ejection methods comprising mechanical shaker devices, fluid jets, fluid pressures, electro-mechanical devices or combinations thereof. The process techniques and process equipment comprising those described to produce equal sized abrasive beads can be employed to produce equal sized non-abrasive beads.

Larger sized cavities produce larger sized beads, which allows a wide range of beads to be produced by this technique. The description here of this bead producing technique is based on the formation of abrasive particle filled metal oxide materials. However, this same bead forming technique can be used to produce equal sized beads of many different material compositions. Either solid, porous or hollow ceramic beads can be made simply by selecting the component material that are mixed into a solution and introduced into the font sheet cavities and then ejected, where these same component materials are well known for use with other bead forming techniques including the use of pressurized nozzle spray dryers and rotary wheel spray dryers that atomize the material into beads.

The font sheets can be also used to form equal sized beads of materials the are heated into a liquid form and the liquid introduced into cold, warm or heated cavity font sheets after which the liquid material is ejected from the cavity cells into an atmosphere that cools off the surface tension formed spherical ejected volumetric lumps into partial or wholly solidified beads. These melt-formed beads can also be solid, porous or hollow, again depending on the selection of the component materials in the bead material mixture and the incorporation of blowing agents in the bead material liquid mixture. Furthermore, bead materials can be selected that allow a liquid material to be introduced into the font sheet cavities and after ejection of the liquid material lumps from the cavities the lumps can be formed into spheres by surface tension forces and then the formed bead sphere material can be partially or wholly solidified by either a chemical reaction of the base materials or by subjecting the beads to energy sources including convective or radiant heat, ultraviolet or electron beam energy or combinations thereof. The beads formed here can be porous, solid or hollow, depending on the selection of the bead materials. Beads my contain a variety of materials where some of the bead materials are used to form the beads structure while other of the bead materials are present to perform another function or combination of functions. Porous beads may be used as a carrier device for other materials where an open porous lattice structure of the porous carrier material can allow fluids, including gases and liquids, to penetrate or diffuse into the porous bead structure and contact the other materials that are distributed throughout the bead structure. Examples of the use of porous beads containing other materials include, but are not limited to, the use of catalysts, medicines or pharmacology agents. Equal sized beads can also be used in many commercial, agricultural and medical applications.

The mesh screens or metal perforated sheets can also be used to form abrasive agglomerates from materials other than those consisting of an aqueous ceramic slurry. These materials include abrasive particles mixed in water or solvent based polymer resins, thermoset and thermoplastic resins, soft metal materials, and other organic or inorganic materials, or combinations thereof.

Near-equal sized spherical agglomerate beads produced by expelling a aqueous or solvent based liquid slurry material from cell hole openings in a sheet or belt can be solid or porous or hollow and can be formed from many materials including ceramics.

Hollow beads would be formulated with ceramic and other materials well known in the industry to form slurries that are used to fill mesh screen or perforated hole sheets from where the slurry volumes are ejected by a impinging fluid jet. These spherical beads formed in a heated gas environment or a dehydrating liquid would be collected and processed at high temperatures to form the hollow bead structures. The slurry mixture comprised of organic materials or inorganic materials or ceramic materials or metal oxides or non-metal oxides and a solvent including water or solvent or mixtures thereof is forced into the open cells of the sheet thereby filling each cell opening with slurry material level with both sides of the sheet surface. These beads can be formed into single-material beads or formed into multiple-material layer beads that can be coated with active or inactive organic materials. Cell sheet spherical beads can be coated with metals including catalytic coatings of platinum or other materials or the beads can be porous or the beads can enclose or absorb other liquid materials. Sheet open-cell formed beads can have a variety of the commercial uses including the medical, industrial and domestic applications that existing-technology spherical beads are presently used for. The hollow bead shells can be porous or the shells can be non-porous where the porosity of the bead shell is determined by the selection of the bead mixture materials and the processes used to form the bead spherical shapes and the production processes that are used to process the beads after the beads are formed into spherical shapes. In one embodiment, solidified hollow beads can be subjected to high temperatures that fuse the bead outer shell into a non-pervious glassy shell.

Because the production of the hollow beads described here uses open cell screens that have equal sized cell volumes, the hollow beads that are produced by a screen having equal sized cell produces hollow beads that are also equal sized. The hollow bead production processes that follow the formation of equal sized spherical bead material beads are applied uniformly to all of the beads produced by the screen to assure that these following production processes establish and maintain the same equal sizes for all the beads produced by the screen during a bead production operation.

Commercially available spherical non-abrasive beads can be produced by a number of methods including immersing a material mixture in a stirred dehydrating liquid or by pressure nozzle injecting a material mixture into a spray dryer. The dehydrating liquid system and the spray dryer systems have the disadvantage of near-simultaneously producing beads of many different sizes during the bead manufacturing process. The technology of drying or solidifying agglomerates into solid spherical bead shapes in heated air is well established for beads that are produced by spray dryers. The technology of solidifying agglomerate beads in a dehydrating liquid is also well established. There are many uses for equal-sized spherical beads that can, in general, be substituted for variable-sized beads in most or all of the applications that variable-sized beads are presently used for. They can be used as a filler material in material comprising paints, plastics, polymers or other organic or inorganic materials. These beads would provide an improved uniformity of physical handling characteristics, including free-pouring and uniform mixing, of the beads themselves compared to a mixture of beads of various sizes. These equal sized beads can also improve the physical handling characteristics of the materials they are added to as a filler material. Porous versions of these beads can be used as a carrier for a variety of liquid materials including pharmaceutical or medical materials that can be dispensed over a controlled period of time as the carried material contained within the porous bead diffuses from the bead interior to the bead surface. Equal-sized beads can be coated with metals or inorganic compounds to provide special effects including acting as a catalyst or as a metal-bonding attachment agent. Hollow or solid equal-sized spherical beads can be used as light reflective beads that can be coated on the flat surface of a reflective sign article.

The techniques described herein for the formation of spherical abrasive beads can also be applied, without limitation, to the formation of non-abrasive spherical material shapes that have equal sized diameters. The equal sized material beads can also be used in many commercial, agricultural and medical applications.

In one embodiment, microporous screen endless belt or microporous screen sheet having woven wire rectangular cell openings can be used to form individual equal-sized volumes of a liquid mixture of materials and solvents or water or combinations thereof. The screen cell volumes are approximately equal to the volume of the desired spherical agglomerates or beads. Cells are filled with a liquid mixture and an impinging fluid is used to expel the cell liquid mixture volumes into a gas or liquid or heated or cooled or an energy-field environment. Surface tension forces acting on the suspended or free-traveling liquid mixture lumps forms the liquid mixture volumes into individual spherical bead shapes that are solidified after the volumes are shaped into equal sized spherical beads. Beads can then be collected and subjected to further solidification processes, if desired. Box-like cell volumes that are formed by screen mesh openings have individual cell volumes equal to the average thickness of the woven wire screen times the cross-sectional area of the rectangular screen openings.

Another form of open cell hole sheet or screen that can be used to form spherical beads is a screen disk that has an annular band of open cell holes where the cell holes can be continuously level filled in the screen cell sheet with a material liquid mixture solution, or other fluid mixture material, on a continuous production basis by use of doctor blades mutually positioned and aligned on both the upper and lower surfaces of the rotating screen disk. The solution filled cell volumes can then be continuously ejected from the screen cells by an impinging fluid jet, after which, the cell holes are continuously refilled and emptied as the screen disk rotates. Inexpensive screen material may be thickness and mesh opening size selected to produce the desired ejected mixture solution sphere size.

Equal sized spherical shaped non-abrasive hollow or solid or porous beads can be made in open-cell sheets, disks with an annular band of open cell holes or open cell belts from a variety of materials including ceramics, organic materials, polymers, pharmaceutical agents, living life-forms, inorganic materials or mixtures thereof. Hollow abrasive beads would have an outer spherical shell comprised of a agglomerate mixture of abrasive particles, a gas inducing material and a metal oxide material. These beads would be created after forming the agglomerate mixture lumps in the open cells of the screen and ejecting these lumps from the screen body by the same type of techniques that are commonly used to form hollow ceramic spheres from lumps of a water mixture of ceramic materials. Here, the mixture of water, gas inducing material, metal oxide and abrasive particles would be substituted for the water mixture of metal oxides and other gas inducing materials used to make glass spheres.

These beads can be used in many commercial applications comprise their use as plastic fillers, paint additives, abrasion resistant and corrosion resistant surface coatings, gloss reduction surface coatings, organic and inorganic capsules, and for a variety of agricultural, pharmaceutical and medical capsule applications. Porous cell-sheet spheres can be saturated with specialty liquids or medications and the spheres can be surface coated with a variety of organic, inorganic or metal substances. A large variety of materials can be capsulized in equal sized spheres for a variety of product process advantages comprising improving the material transport characteristics of the encapsulated material or to change the apparent viscosity or rheology of the materials that are mixed with the capsule spheres.

Liquid mixture lumps can also be expelled from cells holes by mechanical means instead of impinging fluids by techniques including the use of vibration or impact shock inputs to a filled cell sheet. Pressurized air can be applied to the top surface or vacuum can be applied to the bottom surface of sections of liquid mixture filled cell sheets or belts to expel or aid in expelling the liquid mixture lumps from the cell openings.

Coloring agents can also be added to non-abrasive component slurry mixtures that are used to form the many different types of spherical beads that are created by mesh screen or perforated hole sheet slurry cells to develop characteristic identifying colors for the resultant beads. Coloring agents used in slurry mixtures to produce agglomerate sphere identifying colors are well known in the industry. These colored beads may be abrasive beads or non-abrasive beads. The formed spherical composite beads can then have a specific color that is related to the specific encapsulated particle size where the size can be readily identified after the coated abrasive article is manufactured.

Material beads can range in size from 0.5 micron to 0.5 cm or even larger. The range of sizes of the near-equal sized beads is a function of the diameter of the spherical beads. Here, the preferred standard deviation in the range of sizes of the material beads is preferred to be less than 50% of the average size of the material bead, and is more preferred to be less than 30% and even more preferred to be less than 20% of the average bead size and even more preferred to be less than 10% of the average material bead size.

These material beads comprise materials mixed in water or solvent based polymer resins, thermoset and thermoplastic resins, soft metal materials, and other organic or inorganic materials, or combinations thereof.

Abrasive Beads and Non-Abrasive Beads

A method is described here for the manufacture of equal sized abrasive and non-abrasive beads. Here, droplets of a liquid mixture are formed from individual mesh screen cells that have cell volumes that are equal to the desired droplet volumetric size. Screens that are commonly used to size-sort 45 micrometer or smaller beads can be used to produce liquid slurry droplets that are individually equal-sized and that have an approximate 45 micrometer size. Larger mesh cell sized screens can be used to compensate for the heat treatment shrinkage of the beads as they are processed in ovens and furnaces. These uniform sized beads prevent the non-utilization and waste of undersized beads that are coated on an abrasive article. Further these equal sized beads have the potential to produce higher precision surfaces for reflective beads and for more uniform and predictable end-use results for beads comprising pharmaceutical and medication beads. The variance in the size of beads can be further reduced by screen sifting processes.

A method of manufacturing non-abrasive beads that produces beads with a very narrow range of bead sizes compared to other bead manufacturing process is described here. The process requires a very low capital investment by using inexpensive screen material that is widely available for the measurement and screening of beads and particles. Perforated or electrodeposited screen material can also be used. The beads can also be produced with very simple process techniques by those skilled in the art of abrasive particle or abrasive bead manufacturing. Those skilled in the art of abrasive article manufacturing can easily employ the new equal sized abrasive beads described here with the composition materials and processes already highly developed and well known in the industry to produce premium quality abrasive articles.

Bead materials comprise ceramics, organics, inorganics, polymers, metals, pharmaceuticals, artificial bone material, human implant material and materials where the materials are encapsulated and coated, or covered, with another material in the same mesh screen bead forming process. It is only necessary to form a material into a liquid state, applying it into a mesh screen having equal volume cells whereby the screen is level-filled with the liquid material and ejecting the liquid material from the screen cells into an environment that will solidify the surface tension formed spherical beads.

A material can be made into a liquid state by mixing it or dissolving it in water or other solvents or by melting it and using a screen that has a higher melting temperature than the melted material. For example, molten copper metal can be processed with a stainless steel screen and molten polymers can be processed with a bronze screen. When the molten copper lumps are ejected from the screen cells, they are first formed into spherical shapes and then are solidified as they travel in a free-fall in a cooling air environment.

Equal sized beads can have many sizes and can be used for many applications comprising but not limited to: abrasive particles; reflective coatings; filler bead materials; hollow beads; encapsulating beads; medical implants; artificial skin or cultured skin coatings; drug or pharmaceutical carrier devices; and protective and light or heat reflective coatings.

These equal sized abrasive beads or non-abrasive beads can be produced with the use of metal or polymer or other non-metal font sheets that have equal sized open cells as described herein. Liquid bead material volumes that are ejected from the cells can be formed into spherical shapes by surface tension forces. These ejected spherical beads can be solidified by subjecting them to energy sources comprising hot air, microwave energy, electron beam energy and other energy sources while the beads independently travel in space between the cell sheet and a bead collection device. In one embodiment ejected spherical beads can be temporarily suspended in a moving jet stream of hot air. Only the outer surface of the beads has to be solidified to avoid individual beads adhering to other contacting beads when the beads are collected together. Full solidification of the whole beads can take place at a later time in other bead processing events. Beads can also be suspended in heated liquids comprising oils or solvents comprising alcohols to effect solidification prior to collection. Filler or other materials can also be incorporated within the spherical beads.

The description here of this bead producing technique is based on the formation of abrasive particle filled metal oxide materials. However, this same bead forming technique can be used to produce equal sized beads of many different material compositions. Either solid, porous or hollow ceramic equal sized beads can be made simply by selecting the component materials that are mixed into a liquid mixture solution. The liquid mixture is introduced into the font sheet cavities and the individual cavities that are level filled. Then the mixture entities are ejected from the cavities after which, the ejected mixture entities are formed into spherical shapes that are then solidified. These same bead mixture component materials are well known for use with other bead forming techniques that are used to form a variety of beads that are comprised of different abrasive and non-abrasive materials. Bead forming techniques include the use of pressurized nozzle spray dryers and rotary wheel spray dryers that atomize the material into beads.

The font cavity sheets can be also used to form equal sized beads of materials the are heated into a liquid state and the liquid introduced into cold, warm or heated cavity font sheets after which the liquid material is ejected from the cavities into an atmosphere that cools off the surface tension formed spherical particles into partial or wholly solidified beads. These melt-formed beads can also be solid, porous or hollow, again depending on the bead material selection. Furthermore, other non-heated bead materials can be selected that allow a liquid material to be introduced into the font sheet cavities and after ejection of the liquid material lumps from the cavities, the ejected entity lumps can be formed into spheres by surface tension forces. Then the formed bead sphere material can be partially or wholly solidified by either a chemical reaction of the bead component materials or by subjecting the beads to energy sources including convective or radiant heat, ultraviolet or electron beam energy or combinations thereof. The beads formed here can be porous, solid or hollow, depending on the selection of the bead materials.

Beads my contain a variety of materials where some of the bead materials are used to form the beads structure while other of the bead materials are present to perform another function or combination of functions. Porous beads may be used as a carrier device for other materials where an open porous lattice structure of the porous carrier material can allow fluids, including gases and liquids, to penetrate or diffuse into the porous bead structure and contact the other materials that are distributed throughout the bead structure. Examples of the use of porous beads containing other materials include, but are not limited to, the use of catalysts, medicines or pharmacology agents.

The bead materials comprise abrasive particles mixed in water or solvent based polymer resins, thermoset and thermoplastic resins, soft metal materials, and other organic or inorganic materials, or combinations thereof.

A slurry mixture comprised of organic materials or inorganic materials or ceramic materials or metal oxides or non-metal oxides and a solvent including water or solvent or mixtures thereof is forced into the open cells of the sheet thereby filling each cell opening with slurry material level with both sides of the sheet surface. These beads can be formed into single-material or formed into multiple-material layer beads that can be coated with active or inactive organic materials. Cell sheet formed spherical beads can be coated with metals including catalytic coatings of platinum or other materials or the beads can be porous or the beads can enclose or absorb other liquid materials. Sheet open-cell formed beads can have a variety of the commercial uses including the medical, industrial and domestic applications that existing-technology spherical beads are presently used for.

Non-abrasive beads that are used as light or other wavelength reflectors will have better reflection performance when equal sized beads having optimized size selections are used as compared to the circumstance when a random size range or a wide range of bead sizes are used in a single reflective coating application.

The screen disk equal sized material bead production system allows a portion of the disk to be operated within an enclosure and another portion of the disk to be operated external to the enclosure. Here, the external portion of the rotating disk can be continuously filled with a liquid material in an environment that is sealed off from the material lump ejection and solidification environments. The material filling environment can operate at room or cold or elevated temperatures and can be enclosed to prevent the loss of environment solvents to the atmosphere. The enclosed ejection environment may comprise a vacuum, a gas or a liquid. The gas environment comprises an inert gas or inert fluid or a gas or a fluid that coats the spherical material or a material that provide a chemical or other reaction with the surface material of the material sphere that is subjected to the enclosed ejection environment, or combinations thereof. The ejection environment can be held at an elevated temperature or the environment can be maintained at a cold temperature. Also, enclosure of the ejection environment prevents the escape of solvent or environment fumes during the bead lump solidification process. A variety of energy sources comprising heat, light, electron beam, ultrasonic or other source can be present in the ejection environment in addition to various fluids or vacuum.

The bead production process described here starts with equal sized spherical bead droplets. In precision-flatness abrading applications, the diameter of the individual abrasive beads that are coated on the surface of an abrasive article are more important than the volume of abrasive material that is contained within each abrasive bead. An abrasive article that is coated with individual abrasive beads that have precisely the same equal sizes will abrade a workpiece to a better flatness than will an abrasive article that is coated with abrasive beads have a wide range of bead sizes. The more precise that the equal sizes of the volumes of the liquid abrasive slurry droplets are the more equal sized are the diameters of the resultant abrasive beads. Any change in the volumes of the abrasive slurry that are contained in the liquid state droplets, that are initially formed in the bead manufacturing process, affect the sizes, or diameters, of the spherical beads that are formed from the liquid droplets. However, as the diameter of a spherical bead is a function of the cube root of the droplet volume, the diameter of a bead has little change with small changes in the droplet volumes. When droplets are formed by level filling the cell holes in mesh screens or a perforated sheets there is the possibility of some variation of the volumetric size of the droplets. These variations can be due to a variety of sources including dimensional tolerances of the individual cell hole sizes in the mesh screens or the perforated sheets that are used to form the equal sized droplets. Also, there can be variations in the level filling of each independent cell hole in the screens or perforated sheets with the liquid abrasive slurry material. The cell hole sizes can be controlled quite accurately and the processes used to successfully level-fill the cell holes with liquid slurry are well known in the web coating industry. As the mesh screen liquid slurry droplet volumes are substantially of equal size, the diameters of the abrasive beads produced from them are even more precisely equal because of the relationship where the volume of the spherical beads is proportional to the cube of the diameter.

Abrasive beads described by Howard (U.S. Pat. No. 3,916,584) indicate a typical bead diameter size variation of from 7:1 to 10:1 for beads having an average bead size of 50 micrometers. These beads having a large 7 to 1 range in diameter size would also have a huge 343 to 1 range in bead contained-volume. Beads that are molded with the use of screen sheets that have a bead volume size variation of 10% will only have a corresponding bead diameter variation of only 3.2%. Beads that have a bead volume size variation of 25% will only have a corresponding bead diameter variation of only 7.7%. Beads that have a bead volume size variation of 50% will only have a corresponding bead diameter variation of only 14.5%. Beads that are produced by the 10% volume variation, where some of the beads are 10% larger in volume than the average volume size and some of the beads are 10% smaller in volume than the average volume size, would produce beads that were only 3.2% larger and only 3.2% smaller in diameter than the average diameter of the beads. Here, if the average size of the beads were 50 micrometers, then the largest beads would only be 51.6 micrometers in size and the smallest beads would still be 48.4 micrometers in size (a 1.07 to 1 ratio). This is compared to 50 micrometer averaged sized beads produced by Howard (U.S. Pat. No. 3,916,584) that vary from 20 to 140 micrometers in diameter (a 7 to 1 ratio). The combination of accurately sized cell holes and good-procedure hole filling techniques will result in equal sized liquid abrasive slurry droplets.

Hollow and Porous Spherical Beads

Problem: It is desired to form spherical hollow beads that have a thin outer shell and also, spherical beads that are porous.

Solution: An abrasive particle fluid slurry can be made of a water or other solvent based mixture of abrasive particles and erodible filler materials including metal or non-metal oxides and other materials, or mixtures thereof. Equal sized spherical shaped abrasive or non-abrasive hollow or solid or porous beads can be made in open-cell sheets, disks with an annular band of open cell holes or open cell belts from a variety of materials including ceramics, organic materials, polymers, pharmaceutical agents, living life-forms, inorganic materials or mixtures thereof. Hollow abrasive beads would have a outer spherical shell comprised of a agglomerate mixture of abrasive particles, a gas inducing material and a metal oxide material. These beads would be created after forming the agglomerate mixture lumps in the open cells of the screen and ejecting these lumps from the screen body by the same type of techniques that are commonly used to form hollow ceramic spheres from lumps of a water mixture of ceramic materials. Here, the mixture of water, gas inducing material, metal oxide and abrasive particles would be substituted for the water mixture of metal oxides and other gas inducing materials used to make glass spheres. A metal oxide material used to make beads is Ludox® a colloidal silica sol, where sol is a suspension of an oxide in water, a product of W.R. Grace & Co., Columbia, Md. These beads can be used in many commercial applications including use as plastic fillers, paint additives, abrasion resistant and corrosion resistant surface coatings, gloss reduction surface coatings, organic and inorganic capsules, and for a variety of agricultural, pharmaceutical and medical capsule applications. Porous cell-sheet spheres can be saturated with specialty liquids or medications and the spheres can be surface coated with a variety of organic, inorganic or metal substances. A large variety of materials can be capsulized in equal sized spheres for a variety of product process advantages including improving the material transport characteristics of the encapsulated material or to change the apparent viscosity or rheology of the materials that are mixed with the capsule spheres.

Hollow abrasive beads can be produced that would have an outer spherical shell comprised of an agglomerate mixture of abrasive particles, a metal oxide material. However, a dispersion mixture of water, gas inducing material, metal oxide and abrasive particles would be substituted for the water mixture of metal oxides and other gas inducing materials that are used to make non-abrasive glass or ceramic spherical beads. Hollow beads would be created after forming the dispersion mixture lump entities in the open cells of the screen and ejecting these lumps from the screen cavities to form spherical entities. The entities would then be heated to form gasses that in turn form the liquid entities into hollow entities by the same type of techniques that are commonly used to form hollow ceramic spheres from lumps of a water mixture of ceramic materials. These liquid hollow entities would then be dehydrated to solidify them into non-sticky hollow spheres before they were in physical contact with each other. Hollow or solid equal-sized spherical beads can be used as light reflective beads that can be coated on the flat surface of a reflective sign article.

It is well known in the industry that the simple addition of organic or inorganic "chemical agents" or "blowing agents" to the slurry mixture can be used in the manufacture of non-abrasive hollow beads. To produce equal sized hollow beads, a liquid dispersion mixture that contains a gas inducing material organic or inorganic is used to fill equal sized mold cavity cells to form dispersion cell entities. These blowing agents are mixed with the parent bead material. These dispersion cell entities are then individually ejected from the cavity cells and the dispersion mixture entities are formed into spherical shapes by surface tension forces. Then the beads are subjected to temperatures that are high enough to form gaseous material from the blowing agent material whereby the gaseous material tends to form a hollow bead where the hollow interior portion of the bead comprises the gaseous material and the outer shell of the hollow bead is comprised of the bead parent material. Here, the gasses act inside the spherical entities to form outer spherical entity shells where a gaseous void is formed in the internal central region of each of the spherical entities. This results in the formation of hollow spherical shaped entities. After the hollow bead is formed, the hollow bead is subjected to heat or other energy sources to solidify the outer shell of the hollow bead. These chemical agents or blowing agents comprise organic materials and/or inorganic materials or combinations thereof. There are a variety of expressions in use for these chemical agents including: gas inducing material; hollow sphere forming mixtures; foaming agents; gas-forming substances; and blowing agents.

Near-equal sized spherical agglomerate beads produced by expelling an aqueous or solvent based slurry material from cell hole openings in a sheet or belt can be solid or porous or hollow and can be formed from many materials including ceramics. Hollow beads would be formulated with ceramic and other materials well known in the industry to form slurries that are used to fill mesh screen or perforated hole sheets from where the slurry volumes are ejected by a impinging fluid jet. These spherical beads formed in a heated gas environment or a dehydrating liquid would be collected and processed at high temperatures to form the hollow bead structures.

Hammered-Flat Wire Bead Screens

Problem: It is desired to provide woven wire mesh screens with open cell walls that have more-continuous "walls" than are provided by the individual woven wire strands to form equal sized liquid abrasive slurry dispersion beads. It is desired to use these woven wire screens to produce equal sized abrasive beads because the wire screen material is inexpensive compared to equivalent cell sized perforated or electroplated screens and because a wide variety of sizes of wire screen material is readily available. The woven mesh screens have individual wire strands that are interlaced at right angles to provide cross sectional screen cell openings that have precision controlled rectangular dimensions. These screens allow particles that are smaller than the rectangular openings to pass through the openings but block larger sized particles. The rectangular dimensions of each cell opening in a mesh screen is equal sized and the screen thickness is equal over the full surface of the screen. The rectangular screen openings form a screen cell area and the screen thickness forms a screen cell thickness where the contained screen cell volume is comprised of the cell area and the cell thickness. Here, the screen cell volumes are equal sized over the full surface area of the screen.

However, the woven wire mesh screen cell walls are not uniform flat-surfaced walls because the "walls" are formed of angled single strands of wire that extend across the dimensions of a rectangular screen cell. The equal volume screen cells can be level filled with liquid materials to produce equal volume liquid material entities that can be ejected from the screen to form equal volume liquid material lumps. These ejected liquid lumps are then acted upon by surface tension forces that form the lumps into equal volume spheres that are then solidified to form equal volume material beads. Some of the liquid material that is contained in the screen cells will tend to bridge across the individual screen mesh wire strands from one cell to another adjacent cell. Here, it is necessary to shear the liquid material that joins two adjacent screen cell liquid volumes at the position of the cell wall when the liquid material cell volume entities are ejected from the screen by impinging ejection fluids. It is desired to minimize the amount of the liquid material that bridges across adjacent cells and to form the screen cell wire strand walls into walls that have more-continuous cell wall surfaces.

Solution: The screen material can be flattened by a hammering process where the thickness of the screen is reduced by 30 to 40% while the rectangular screen cell openings retain their original shape. The open cells are reduced in cross sectional size and the thickness of the woven wires increase laterally along the screen surface, which has the desirable effects of providing more gap space between individual beads. Also, the walls that form each rectangular cell opening become more solid with less space between the individual wires that are woven together to form the open cells. There is less liquid material in a screen cell that bridges across adjacent screen cells because the flattened wire strands now form cell walls that are more flat-surfaced than the non-flattened wire strand walls. Hammering the screen reduces the thickness of the screen which reduces the screen cell volumes but the desired cell volumes can be provided by selecting a screen having an initial non-hammered thickness that is greater than the hammered thickness.

The mesh screen can be coated with release agents that are well known to prevent the adhesion of resin or other materials to the screen body. A filler material may be applied to certain areas of the screen to block some of the open screen cells but yet leave patterns of open cells in the screen sheet. Here, island areas of a screen may be left open but all the screen areas that surround the island areas may be filled level with the screen surfaces with materials that include but are not limited to epoxy or other polymers. This screen can then be aligned and placed in contact with a sheet having attached wet resin coated island structures and abrasive beads introduced into the open screen cell openings where they contact and are bonded to the resin. When the screen is separated from the islands, the islands have a monolayer of abrasive beads that have gap spaces between each individual bead and there can be a gap between beads and the outer top surface perimeter of the raised island structures.

Flat Rolled Abrasive Bead Wire Screens

Problem: It is desired to provide woven wire mesh screens with open cell walls that are more continuous than the individual woven wire strands to form equal sized liquid abrasive slurry dispersion beads. It is desired to use woven wire screens to produce equal sized abrasive beads because the wire screen material is inexpensive compared to equivalent cell sized perforated or electroplated screens and because a wide variety of sizes of wire screen material is readily available.

Solution: Woven wire screens can be easily reduced in thickness with reductions in the size of the screen openings by processing the screen through a calendar-roll system. In one example, a bronze wire mesh screen rated for 140 micrometer (0.0055 inches) screening that is constructed from 0.0045 inch (114 micrometers) diameter wire, which had an original sheet thickness of 0.0095 inches (241 micrometers), was reduced by 53% in sheet thickness to 0.0045 inches (114 micrometers). All of the rectangular cell holes in the screen remained rectangular in shape but had smaller cross section dimensions. Also, the open gap areas that connecting adjacent screen cells which were originally located at the corners where the woven right-angle wires strands intersected were significantly reduced in size. Rolling the woven wire flat had the result that the irregular shaped formed wire "walls" rectangular open cells now had near-continuous "walls". These new "walls" reduce the amount of mutual dispersion-fluid that can bridge across two adjacent cells with the result that less of the dispersion has to be separated at these locations when the liquid dispersion volumes are simultaneously ejected from a woven mesh cell screen. Woven screens processed through the nipped calendar roll system had uniform sized rectangular cell openings along the downstream length of the wire screen material with the result that the level-surfaced liquid contained in each of the reduced thickness cells is substantially equal in volume. These equal sized liquid dispersion cell volumes can be ejected from the flat-rolled screens cells to form equal sized abrasive beads. In another example, the same 140 micrometer (0.0055 inches) screen material was calendar roll flattened to 0.0035 inches (89 micrometers) to produce screen cells having even more continuous cell "walls".

The wire mesh screen size and the amount that the screen is reduced in thickness by the calendar rolls are selected to produce the desired liquid volumes contained in the screen cells to create the desired bead sizes. Mesh screens suitable for use to produce 45 micrometer beads can be obtained from TWP, Inc located in Berkley, Calif. wherein the screens are constructed from stainless or bronze woven wire. A 400 mesh screen having 0.0013 inch (33 micrometer) openings that is constructed from 0.001 inch (25.4 micrometer) wires having a screen thickness of 0.002 inches (51 micrometers) can be reduced in screen thickness by 50%. There is also an associated reduction of the cell cross sectional opening dimensions when the screen is rolled flat or hammered flat because the flattening of the individual screen wires results in the flattened individual wires increasing in their widths. The wider screen wires and the reduced screen thickness results in a corresponding equal-sized reduction of the screen cell volumes which allows the production of smaller equal sized material beads. Using flattened mesh screens, ejected liquid material lump entity volumes can be less than 0.001 inches (25 micrometers) in nominal diameter.

Flattened or non-flattened mesh screens or perforated sheets or sheets having small diameter cell holes that have long hole lengths can be used to produce a wide range of equal sized material beads that have diameters that are less than 0.001 inches (25 micrometers) to beads that have diameters that are greater than 0.25 inches (0.64 cm). The standard deviation in the diameter size of these beads are preferred to be less than 30% of the average diameter of the beads produced by the screen cell device for a specific bead material and are more preferred to be less than 20% of the average diameter of the beads produced by the screen cell device for a specific bead material and are even more preferred to be less than 10% of the average diameter of the beads produced by the screen cell device for a specific bead material and are even more preferred to be less than 5% of the average diameter of the beads produced by the screen cell device for a specific bead material.

Multiple Coated Beads

Problem: It is desired to apply one or more coatings to the surface of solidified beads.

Solution: Solidified spherical beads can be placed in the open screen cells of a screen where the screen is advanced forward under a container device that applies a liquid coating to the beads. This process works is particularly well with equal sized beads that are inserted into screens that have equal sized screen cell openings. The liquid coating can be impinged against the bead thereby ejecting the bead and the coating that surrounds the ejected bead from the screen into a coating solidification environment. The coating can be a liquefied hot molten material that becomes solidified upon cooling or the coating can be a solvent based coating where the coating dies in a heated solidification environment. In addition the coating can be a polymer precusor material that becomes polymerized in the solidification environment. After a coating is applied to a bead, additional coatings can be applied to the coated bead where each of the coatings is composed of the same coating material or of different coating materials. The coatings can be solid or the coatings can be porous. Coating materials comprise, organic materials, inorganic materials, metals, polymers, polymer precursors, catalysts, living life forms, drugs, medicines, pharmaceuticals, agricultural materials, seeds, fertilizers, reflective agents, industrial compounds, chemical agents and protective coating materials. The beads can be solid, porous or hollow. Coatings can be applied to the surface of a bead or the coatings can be absorbed into the structure of a porous bead material. Beads can have multiple porous coatings with different materials absorbed by the different porous coatings. Some bead coatings can be applied by well known liquid saturation techniques and prior or subsequent bead coatings applied by the techniques described here. Likewise, beads can be produced and solidified by a variety of methods and coatings can be applied to these beads by the techniques described here.

The bead solidification environments used to produce beads from liquid materials or to apply multiple material coatings on solidified beads can be a singular solidification environment or they can be multiple environments comprised of heat or other energy environments, cooling environments or free-fall or beads suspension environments or combinations thereof. After a bead is ejected from a screen it can be routed to travel progressively through the adjacent multiple environment zones whereby the bead body is solidified or a beat coating is dried or another material is applied to the surface of an existing solidified bead.

Figure 13:
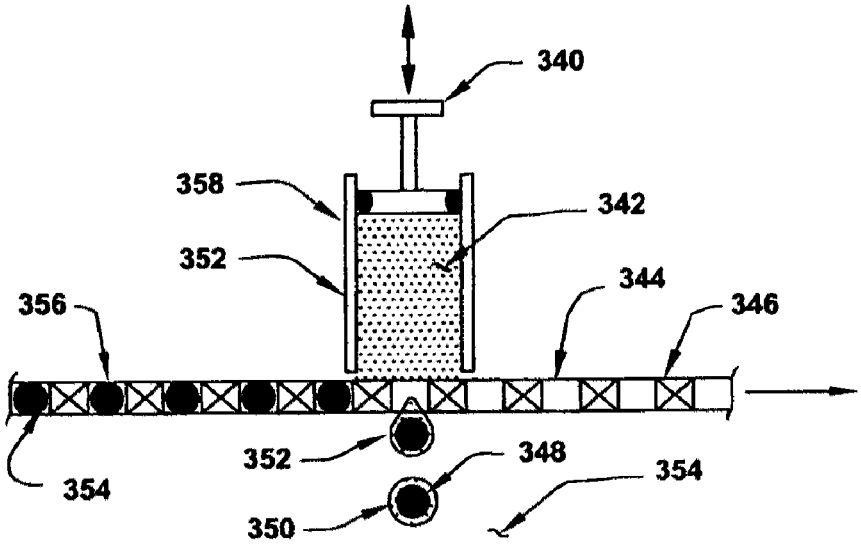
FIG. 13 is a cross sectional view of a bead coater device.

FIG. 13 is a cross sectional view of a bead coater device 352 that has a open cell screen 354 that is filled with solidified beads 356. The screen 354 advances forward under a cylinder 358 that is filed with a liquid coating material 342 that is driven by a plunger 340 to be in impinging contact with the beads 356 to eject the beads 356 from the screen 354. The ejected beads 352 have a solidified bead 350 that is surrounded with a coating material 342 coating 348 that is uniform in coating thickness because of the forces comprising surface tension forces and capillary action forces acting on the liquid coating 342. The screen 354 portion that advances past the coating cylinder 358 has open cells 344 that have screen walls 346. The ejected beads 350 having the coating 348 are ejected into a solidification environment 354 to solidify the bead coating 348.

In another embodiment a liquid coating can be applied to the surface of a open celled screen that is filled with solidified beads where the beads and a portion of the coating are mutually ejected from the screen with the result that the solidified bead is coated with the liquid coating that surrounds the individual beads. A plunger device or a fluid jet can direct an ejection fluid against the surface of the beads to eject the beads and the liquid coating from the screen cells. The screen can be liquid coated on only the plunger side surface of the screen or the screen can be liquid coated on opposite-plunger side surface of the screen or the screen can be liquid coated on both side surfaces of the screen.

Figure 14:
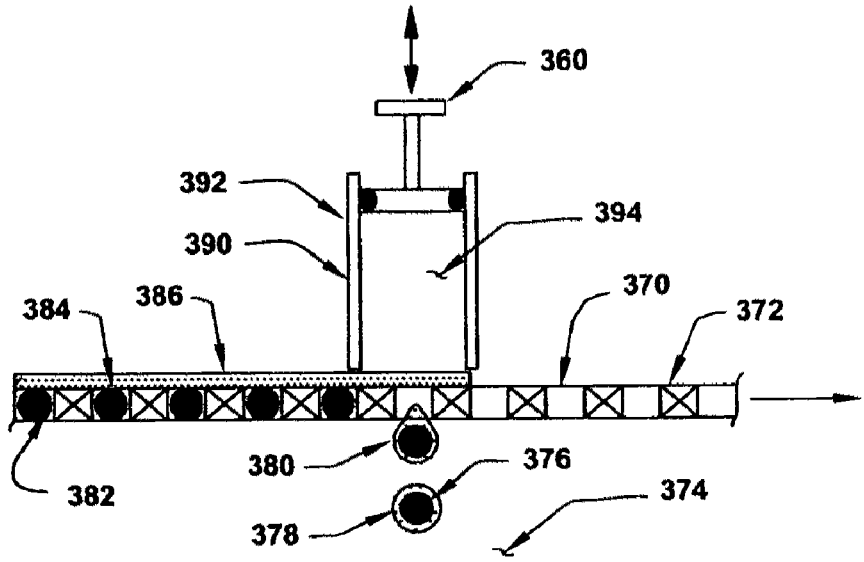
FIG. 14 is a cross sectional view of a bead coater device.

FIG. 14 is a cross sectional view of a bead coater device 390 that has a open cell screen 382 that is filled with solidified beads 384. The screen 382 having a surface coating of liquid coating material 386 advances forward under a cylinder 392 that is filed with an ejection fluid 394 that is driven by a plunger 360 to be in impinging contact with the beads 384 to eject the beads 384 and coating material 386 from the screen 382. The ejected beads 380 have a solidified bead 378 that is surrounded with a coating material 376 that is uniform in coating thickness because of the forces comprising surface tension forces and capillary action forces acting on the liquid coating 386. The screen 382 portion that advances past the coating cylinder 392 has open cells 370 that have screen walls 372. The coating process can be repeated to apply multiple coatings on the beads 384. The ejected beads 378 having the coating 376 are ejected into a solidification environment 374 to solidify the bead coating 376.

A process of making uniform sized spherical beads may include steps of:

a) providing a cell sheet having an array of cell sheet through holes;
   i) the cell sheet through holes each have equal cross sectional areas;
   ii) the cell sheet having a nominal thickness wherein the cell sheet nominal thickness is equal at each cell sheet through hole location;
b) mixing at least two distinct materials into a liquid medium that is hardenable or solidifiable, the liquid medium comprising: at least one i) inorganic molecules, organic materials, metals, and at least one ii) a liquid carrier;
c) filling the cell sheet through holes with the liquid medium to form liquid medium volumes wherein the volume of the liquid medium contained in each liquid medium volume is approximately equal to respective cell sheet cell volumes;
d) ejecting the liquid medium volumes from the cell sheet by subjecting the liquid medium volume contained in each cell to an impinging fluid wherein impact of the impinging fluid dislodges the liquid medium, volumes from the cell sheet thereby forming independent liquid medium entities;
e) shaping the ejected independent liquid medium entities into independent liquid medium spherical entities by at least surface tension forces acting on the liquid medium lump entities; and
i) the independent spherical liquid entities are introduced into and subjected to a solidification environment wherein the independent spherical liquid entities become solidified to form independent mixture equal sized spherical beads.

The mixing materials in this process comprise living life forms, pharmaceuticals, drugs, seeds, agricultural materials, fertilizers, reinforcing materials, fibers and construction materials. The solidified beads can be solid or porous where the porous solidified beads are saturated with or act as carriers for materials comprising living life forms, pharmaceuticals, drugs, seeds, agricultural materials, or fertilizers. The process solidification environment comprises elevated temperature air or other gases or a dehydrating liquid.

The cell sheet can be a perforated sheet, and electroplated sheet, an etched sheet or a woven wire mesh screen where the woven wire mesh screen is reduced in thickness by a hammering process or by the use of calender rolls. Also, the cell sheet can be joined at two opposing ends to form a cell sheet continuous belt. Further, the cell sheet can be a disk shape having an annular pattern of cell sheet through holes. The mixing material can be an oxide material and the spherical beads can be fired at high temperatures to produce beads. In this process, the standard deviation of the average diameter size of the spherical beads can be less than 30% of the average bead diameter size or less than 20% of the average bead diameter size or even less than 10% of the average bead diameter size.

A process of making equal sized melt-solidified spherical beads comprising:

a) using a cell sheet wherein the cell sheet has an array of cell sheet through holes;
b) the cell sheet through holes each have equal cross sectional areas;
c) the cell sheet having a nominal thickness wherein the cell sheet nominal thickness is equal at each cell sheet through hole location;
d) the cell sheet through holes form cell equal sized cell volumes wherein a cell sheet cell volume is equal to the cell sheet through hole cross sectional area multiplied by the cell sheet thickness;
e) melting materials to form a liquid material solution, the liquid material solution comprising inorganic materials or organic materials or metals or solvents or polymers or polymer precursors or combinations thereof;
f) filling the cell sheet through holes with the liquid material solution to form liquid material volumes wherein the volume of the liquid material solution contained in each liquid material volume is equal to the respective cell sheet cell volume;
g) ejecting the liquid material volumes from the cell sheet by subjecting the liquid material solution volume contained in each cell to an impinging fluid wherein the impact of the impinging fluid dislodges the liquid material volumes from the cell sheet thereby forming independent material solution liquid lump entities;
h) wherein the ejected independent material solution liquid lump entities are shaped into independent material solution liquid spherical entities by liquid material solution surface tension forces or other forces acting on the liquid material lump entities;

i) the independent spherical liquid entities are introduced into and subjected to a cooling solidification environment wherein the independent spherical liquid material entities become solidified to form independent material equal sized spherical beads.

A process is described of making equal sized polymerized spherical beads comprising:

a) using a cell sheet wherein the cell sheet has an array of cell sheet through holes;

b) the cell sheet through holes each have equal cross sectional areas;

c) the cell sheet having a nominal thickness wherein the cell sheet nominal thickness is equal at each cell sheet through hole location;

d) the cell sheet through holes form cell equal sized cell volumes wherein a cell sheet cell volume is equal to the cell sheet through hole cross sectional area multiplied by the cell sheet thickness;

e) mixing materials into a liquid solution, the mixture liquid solution comprising inorganic materials or organic materials or metals and water or solvents or polymers or polymer precursors or catalysts or combinations thereof;

f) filling the cell sheet through holes with the liquid mixture solution to form liquid mixture volumes wherein the volume of the liquid mixture solution contained in each liquid mixture volume is equal to the respective cell sheet cell volume;

g) ejecting the liquid mixture volumes from the cell sheet by subjecting the liquid mixture solution volume contained in each cell to an impinging fluid wherein the impact of the impinging fluid dislodges the liquid mixture volumes from the cell sheet thereby forming independent mixture solution liquid lump entities;

h) wherein the ejected independent mixture solution liquid lump entities are shaped into independent mixture solution liquid spherical entities by liquid mixture solution surface tension forces or other forces acting on the liquid mixture lump entities;

i) the independent spherical liquid entities are introduced into and subjected to a solidification environment wherein the independent spherical liquid entities become solidified by a polymerization process to form independent mixture equal sized spherical beads.

In this process, the ejected spherical beads can be suspended in space while the ejected spherical beads are in residence in the solidification environment. Also, the solidification environment comprises heat, electron beam, light sources, ultraviolet light, microwaves and ultrasonic or other vibration or combinations thereof.

A process is described of making equal sized hollow spherical beads comprising:

a) using a cell sheet wherein the cell sheet has an array of cell sheet through holes;

b) the cell sheet through holes each have equal cross sectional areas;

c) the cell sheet having a nominal thickness wherein the cell sheet nominal thickness is equal at each cell sheet through hole location;

d) the cell sheet through holes form cell equal sized cell volumes wherein a cell sheet cell volume is equal to the cell sheet through hole cross sectional area multiplied by the cell sheet thickness;

e) mixing materials into a liquid solution, the mixture liquid solution comprising inorganic materials or organic materials or metals or polymers or water or solvents and blowing agent materials or combinations thereof;

f) filling the cell sheet through holes with the liquid mixture solution to form liquid mixture volumes wherein the volume of the liquid mixture solution contained in each liquid mixture volume is equal to the respective cell sheet cell volume;

g) ejecting the liquid mixture volumes from the cell sheet by subjecting the liquid mixture solution volume contained in each cell to an impinging fluid wherein the impact of the impinging fluid dislodges the liquid mixture volumes from the cell sheet thereby forming independent mixture solution liquid lump entities;

h) wherein the ejected independent mixture solution liquid lump entities are shaped into independent mixture solution liquid spherical entities having an exterior surface by liquid mixture solution surface tension forces or other forces acting on the liquid mixture lump entities;

i) the independent spherical liquid entities are introduced into and subjected to a bead-blowing environment wherein gases form at the interior portion of the spherical liquid entities with the result that portions of the mixture materials form a mixture material hollow shell at the exterior surface of the independent spherical liquid entities;

j) the independent spherical liquid entities are introduced into and subjected to a solidification environment wherein the independent spherical liquid entities become solidified to form independent hollow mixture equal sized spherical beads.

In this process the hollow bead materials comprise ceramics or oxides and are fired at high temperatures. Also, the hollow bead materials can be coated with light or other reflective materials. In addition, the hollow bead materials can be porous and the hollow beads can be filled with gases or liquid materials.

A process of making uniform sized spherical beads may include steps of:

a) providing a cell sheet having an array of cell sheet through holes;

i) the cell sheet through holes each have equal cross sectional areas;

ii) the cell sheet having a nominal thickness wherein the cell sheet nominal thickness is equal at each cell sheet through hole location;

b) mixing at least two distinct materials into a liquid medium that is hardenable or solidifiable, the liquid medium comprising: at least one i) inorganic molecules, organic materials, metals, and at least one ii) a liquid carrier;

c) filling the cell sheet through holes with the liquid medium to form liquid medium volumes wherein the volume of the liquid medium contained in each liquid medium volume is approximately equal to respective cell sheet cell volumes;

d) ejecting the liquid medium volumes from the cell sheet by subjecting the liquid medium volume contained in each cell to an impinging fluid wherein impact of the impinging fluid dislodges the liquid medium, volumes from the cell sheet thereby forming independent liquid medium entities;

e) shaping the ejected independent liquid medium entities into independent liquid medium spherical entities by at least surface tension forces acting on the liquid medium lump entities; and f) the independent spherical liquid entities are introduced into and subjected to a solidification environment wherein the independent spherical liquid entities become solidified to form independent mixture equal sized spherical beads;

i) coating the independent spherical liquid beads with one or more coating layers of coating materials comprising organic materials, inorganic materials, metals, polymers, polymer precursors, catalysts, living life forms, drugs, medicines, pharmaceuticals, agricultural materials, seeds, fertilizers, reflective agents, industrial compounds, chemical agents and protective coating materials by applying the coating materials to the beads.

Although specific numbers and materials are used in descriptions in the present invention, alternatives will be apparent to those skilled in the art. Also, where terms such as "solidify," uniform" or "equal" are used, these are not absolute terms. When a particle is solidified, it retains sufficient shape and coherent strength that it can be at least further processed. A gel-capsule type of solidification (with pliable outer layer and liquid inner layer would be solidified. The uniformity of particles is measured on the basis of standard deviations, as described herein, so that where the term uniform is used, it does not mean 0% standard deviation, but less than 40% number average standard deviation. Similarly, where it is stated that the volume of the liquid medium contained in each liquid medium volume is approximately equal to respective cell sheet cell volumes, there may be a meniscus or less than 40% by total volume overage or underage of the liquid medium associated with the individual cells.

The fluids used to eject the liquid medium volume of the cells may or may not be miscible with the liquid medium, as long as the ejection fluid does not alter the size of the particles to be formed by adding final mass to the solidified particles. For example, if the liquid carrier were alcohol, and the solidification process were drying or sol gel reaction (where the alcohol is driven off from the volume), the ejecting liquid could be an alcohol. If the solidification process were a migratory movement of solids to form a shell on the surface of the entities, or the ejecting liquid actually reacted with the liquid medium, then the ejecting liquid should not be miscible, as that would alter the entity volume after solidification.

What is claimed is:

1. A process of making uniform sized spherical beads comprising: a) providing a cell sheet having an array of cell sheet through holes; i) the cell sheet through holes each have equal cross sectional areas; ii) the cell sheet having a nominal thickness wherein the cell sheet nominal thickness is equal at each cell sheet through hole location; b) mixing at least two distinct materials into a liquid medium that is hardenable or solidifiable, the liquid medium comprising: at least one i) inorganic molecules, organic materials, metals, and at least one ii) a liquid carrier; c) filling the cell sheet through holes with the liquid medium to form liquid medium volumes wherein the volume of the liquid medium contained in each liquid medium volume is approximately equal to respective cell sheet cell volumes; d) ejecting the liquid medium volumes from the cell sheet by subjecting the liquid medium volume contained in each cell to an impinging fluid wherein impact of the impinging fluid dislodges the liquid medium, volumes from the cell sheet thereby forming independent liquid medium entities; e) shaping the ejected independent liquid medium entities into independent liquid medium spherical entities by at least surface tension forces acting on the liquid medium lump entities; and f) introducing the independent spherical liquid medium entities into a solidification environment to at least solidify the surface of the independent spherical liquid medium entities to form independent, uniform sized spherical beads.

2. The process of claim 1 wherein at least one of the at least two distinct materials is selected from the group consisting of microbes, pharmaceuticals, vitamins, seeds, agricultural nutrients, antiseptics, reagents, fertilizers, herbicides and pesticides.

3. The process of claim 1 wherein the spherical beads are porous.

4. The process of claim 3 wherein the porous spherical beads are saturated with or act as carriers for materials selected from the group consisting of pharmaceuticals, vitamins, nutrients, seeds, herbicides, pesticides and fertilizers.

5. The process of claim 1 wherein the solidification environment comprises elevated temperature gas.

6. The process of claim 1 wherein the solidification environment is a dehydrating liquid.

7. The process of claim 1 wherein the cell sheet is a woven wire mesh screen.

8. The process of claim 7 wherein the woven wire mesh screen cell sheet is reduced in thickness by compressive force before the introduction of the liquid mediums.

9. The process of claim 1 wherein the cell sheet forms a continuous belt.

10. The process of claim 1 wherein the cell sheet comprises a disk shape having an annular pattern of cell sheet through holes.

11. The process of claim 1 where at least one component of the mixed liquid comprises an inorganic oxide material.

12. The process of claim 1 where the spherical beads are fired at high temperatures to produce beads.

13. The process of claim 1 where the standard deviation of the average diameter size of the spherical beads is less than 30% of the average bead diameter size.

14. The process of claim 1 where the standard deviation of the average diameter size of the spherical beads is less than 20% of the average bead diameter size.

15. The process of claim 1 where the standard deviation of the average diameter size of the spherical beads is less than 10% of the average bead diameter size.

16. A process of making uniform sized spherical beads comprising: a) providing a cell sheet having an array of cell sheet through holes; i) the cell sheet through holes each have equal cross sectional areas; ii) the cell sheet having a nominal thickness wherein the cell sheet nominal thickness is equal at each cell sheet through hole location; b) mixing at least two distinct materials into a liquid medium that is hardenable or solidifiable, the liquid medium comprising: at least one i) inorganic molecules, organic materials, metals, and at least one ii) a liquid carrier; c) filling the cell sheet through holes with the liquid medium to form liquid medium volumes wherein the volume of the liquid medium contained in each liquid medium volume is approximately equal to respective cell sheet cell volumes; d) ejecting the liquid medium volumes from the cell sheet by subjecting the liquid medium volume contained in each cell to an impinging fluid wherein impact of the impinging fluid dislodges the liquid medium, volumes from the cell sheet thereby forming independent liquid medium entities; e) shaping the ejected independent liquid medium entities into independent liquid medium spherical entities by at least surface tension forces acting on the liquid medium lump entities; and f) introducing the independent spherical liquid entities into a cooling solidification environment and cooling the independent spherical liquid medium entities to at least solidify their surfaces to form independent uniform sized spherical beads.

17. A process of making uniform sized spherical beads comprising: a) providing a cell sheet having an array of cell sheet through holes; i) the cell sheet through holes each have equal cross sectional areas; ii) the cell sheet having a nominal thickness wherein the cell sheet nominal thickness is equal at each cell sheet through hole location; b) mixing at least two distinct materials into a liquid medium that is hardenable or solidifiable, the liquid medium comprising: at least one i) inorganic molecules, organic materials, metals, and at least one ii) a liquid carrier; c) filling the cell sheet through holes with the liquid medium to form liquid medium volumes wherein the volume of the liquid medium contained in each liquid medium volume is approximately equal to respective cell sheet cell volumes; d) ejecting the liquid medium volumes from the cell sheet by subjecting the liquid medium volume contained in each cell to an impinging fluid wherein impact of the impinging fluid dislodges the liquid medium, volumes from the cell sheet thereby forming independent liquid medium entities; e) shaping the ejected independent liquid medium entities into independent liquid medium spherical entities by at least surface tension forces acting on the liquid medium lump entities; and f) introducing the independent spherical liquid entities into to a solidification environment wherein the independent spherical liquid entities become solidified by a polymerization process to form independent, uniform sized spherical beads.

18. The process of claim 17 wherein the ejected spherical beads are suspended in space while the ejected spherical beads are in residence in the solidification environment.

19. The process of claim 17 wherein the solidification environment comprises heat, electron beam, light sources, ultraviolet light, infrared sources, microwaves or ultrasonic sources.

20. A process of making equal sized hollow spherical beads comprising: A process of making uniform sized spherical beads comprising: a) providing a cell sheet having an array of cell sheet through holes; i) the cell sheet through holes each have equal cross sectional areas; ii) the cell sheet having a nominal thickness wherein the cell sheet nominal thickness is equal at each cell sheet through hole location; b) mixing at least two distinct materials into a liquid medium that is hardenable or solidifiable, the liquid medium comprising: at least one i) inorganic molecules, organic materials, metals, and at least one ii) a liquid carrier; c) filling the cell sheet through holes with the liquid medium to form liquid medium volumes wherein the volume of the liquid medium contained in each liquid medium volume is approximately equal to respective cell sheet cell volumes; d) ejecting the liquid medium volumes from the cell sheet by subjecting the liquid medium volume contained in each cell to an impinging fluid wherein impact of the impinging fluid dislodges the liquid medium, volumes from the cell sheet thereby forming independent liquid medium entities; e) shaping the ejected independent liquid medium entities into independent liquid medium spherical entities by at least surface tension forces acting on the liquid medium lump entities; f) introducing the independent spherical liquid entities into bead-blowing environment, generating bead blowing gas within the liquid medium entities wherein gases form at the interior portion of the spherical liquid entities with the result that portions of the mixture materials form a mixture material shell about the gases; and g) the independent spherical liquid entities are introduced into and subjected to a solidification environment wherein the independent spherical liquid entities become solidified to form independent hollow mixture equal sized spherical beads.

21. The process of claim 20 wherein the hollow bead materials comprise ceramics or oxides and are fired at high temperatures.

22. The process of claim 20 wherein the hollow bead materials are coated with light or other reflective materials.

23. The process of claim 20 wherein the hollow bead materials are porous.

24. The process of claim 20 wherein the hollow beads are filled with gases or liquid materials.

25. A process of making uniform sized spherical beads comprising: a) providing a cell sheet having an array of cell sheet through holes; i) the cell sheet through holes each have equal cross sectional areas; ii) the cell sheet having a nominal thickness wherein the cell sheet nominal thickness is equal at each cell sheet through hole location; b) mixing at least two distinct materials into a liquid medium that is hardenable or solidifiable, the liquid medium comprising: at least one i) inorganic molecules, organic materials, metals, and at least one ii) a liquid carrier; c) filling the cell sheet through holes with the liquid medium to form liquid medium volumes wherein the volume of the liquid medium contained in each liquid medium volume is approximately equal to respective cell sheet cell volumes; d) ejecting the liquid medium volumes from the cell sheet by subjecting the liquid medium volume contained in each cell to an impinging fluid wherein impact of the impinging fluid dislodges the liquid medium, volumes from the cell sheet thereby forming independent liquid medium entities; e) shaping the ejected independent liquid medium entities into independent liquid medium spherical entities by at least surface tension forces acting on the liquid medium lump entities; and f) the independent spherical liquid entities are introduced into and subjected to a solidification environment wherein the independent spherical liquid entities become solidified to form independent mixture equal sized spherical beads; and g) coating the independent spherical liquid beads with one or more coating layers of coating material.

* * * * *